US009865132B2

(12) United States Patent
Itagaki et al.

(10) Patent No.: US 9,865,132 B2
(45) Date of Patent: Jan. 9, 2018

(54) GAMING MACHINE

(71) Applicants: Universal Entertainment Corporation, Tokyo (JP); Aruze Gaming America, Inc., Las Vegas, NV (US)

(72) Inventors: Takehisa Itagaki, Tokyo (JP); Yuji Miyagawa, Tokyo (JP); Yukihiro Kawakami, Tokyo (JP); Masahiro Yoshida, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 171 days.

(21) Appl. No.: 14/628,384

(22) Filed: Feb. 23, 2015

(65) Prior Publication Data

US 2015/0287287 A1 Oct. 8, 2015

(30) Foreign Application Priority Data

Apr. 2, 2014 (JP) ..... 2014-076472

(51) Int. Cl.
*G07F 17/32* (2006.01)

(52) U.S. Cl.
CPC ..... *G07F 17/3267* (2013.01); *G07F 17/323* (2013.01)

(58) Field of Classification Search
CPC . G07F 17/3265; G07F 17/3267; G07F 17/323
See application file for complete search history.

(56) References Cited

U.S. PATENT DOCUMENTS 6,190,255 B1 * 2/2001 Thomas ..... G07F 17/32 463/20
6,398,217 B1 * 6/2002 Shimizu ..... A63F 13/005 273/121 B
8,192,281 B2 * 6/2012 Williams ..... G07F 17/3211 463/31
2005/0192085 A1 * 9/2005 Iwamoto ..... G07F 17/32 463/20
2012/0295688 A1 * 11/2012 Watkins ..... G07F 17/3211 463/20

FOREIGN PATENT DOCUMENTS

JP 2007-020954 2/2007

* cited by examiner

*Primary Examiner* — William H McCulloch, Jr.
*Assistant Examiner* — Yingchuan Zhang
(74) *Attorney, Agent, or Firm* — Lex IP Meister, PLLC

(57) ABSTRACT

Provided is a gaming machine that presents a prediction of the start of free games provided in bonus games to be easily noted by the player, to attain the player's expectation for the free games. When a free game trigger or retrigger is established, the gaming machine controls selection and implementation of predictive effects for indicating that free games are to be started (or retriggered) depending on the positions of the symbols to stop, before displaying stopped symbols.

8 Claims, 74 Drawing Sheets

FIG 4A

SYMBOL ARRAYS IN NORMAL GAMES

| CODE NO. | FIRST REEL | SECOND REEL | THIRD REEL | FOURTH REEL | FIFTH REEL |
|---|---|---|---|---|---|
| 0 | RED | BLUE | GREEN | PINK | BLACK |
| 1 | RED | BLUE | GREEN | PINK | BLACK |
| 2 | RED | BLUE | GREEN | PINK | BLACK |
| 3 | RED | BLUE | GREEN | PINK | BLACK |
| 4 | BLUE | PINK | RED | GREEN | RED |
| 5 | BLUE | PINK | RED | GREEN | RED |
| 6 | BLUE | PINK | RED | GREEN | RED |
| 7 | BLUE | PINK | RED | GREEN | RED |
| 8 | PINK | GREEN | BLUE | RED | BLUE |
| 9 | PINK | GREEN | BLUE | RED | BLUE |
| 10 | PINK | GREEN | BLUE | RED | BLUE |
| 11 | PINK | GREEN | BLUE | RED | BLUE |
| 12 | GREEN | RED | PINK | BLUE | PINK |
| 13 | GREEN | RED | PINK | BLUE | PINK |
| 14 | GREEN | RED | PINK | BLUE | PINK |
| 15 | GREEN | RED | PINK | BLUE | PINK |
| 16 | BLACK | BLACK | BLACK | BLACK | GREEN |
| 17 | BLACK | BLACK | BLACK | BLACK | GREEN |
| 18 | BLACK | BLACK | BLACK | BLACK | GREEN |
| 19 | BLACK | BLACK | BLACK | BLACK | GREEN |
| 20 | BLACK | BLACK | BLACK | BLACK | BLACK |
| 21 | BLACK | BLACK | BLACK | BLACK | BLACK |
| 22 | BLACK | BLACK | BLACK | BLACK | BLACK |
| 23 | BLACK | BLACK | BLACK | BLACK | BLACK |
| 24 | ACE | WILD | WILD | WILD | BLACK |

FIG 4B

| CODE NO. | FIRST REEL | SECOND REEL | THIRD REEL | FOURTH REEL | FIFTH REEL |
|---|---|---|---|---|---|
| 25 | ACE | WILD | WILD | WILD | BLACK |
| 26 | ACE | WILD | WILD | WILD | BLACK |
| 27 | ACE | WILD | WILD | WILD | BLACK |
| 28 | RED | PINK | RED | RED | WILD |
| 29 | RED | PINK | RED | RED | WILD |
| 30 | RED | PINK | RED | RED | WILD |
| 31 | RED | PINK | RED | RED | WILD |
| 32 | KING | WILD | WILD | QUEEN | BLUE |
| 33 | KING | GREEN | TEN | QUEEN | BLUE |
| 34 | KING | GREEN | TEN | QUEEN | BLUE |
| 35 | KING | GREEN | TEN | QUEEN | BLUE |
| 36 | BLUE | GREEN | TEN | BLUE | WILD |
| 37 | BLUE | WILD | BLUE | BLUE | KING |
| 38 | BLUE | RED | BLUE | BLUE | KING |
| 39 | BLUE | RED | BLUE | BLUE | KING |
| 40 | QUEEN | RED | BLUE | WILD | KING |
| 41 | QUEEN | RED | WILD | KING | PINK |
| 42 | QUEEN | WILD | NINE | KING | PINK |
| 43 | QUEEN | BLUE | NINE | KING | PINK |
| 44 | PINK | BLUE | NINE | KING | PINK |
| 45 | PINK | BLUE | NINE | PINK | WILD |
| 46 | PINK | BLUE | WILD | PINK | GREEN |
| 47 | PINK | WILD | PINK | PINK | GREEN |
| 48 | JACK | NINE | PINK | PINK | GREEN |
| 49 | JACK | NINE | PINK | WILD | GREEN |

FIG. 4C

| CODE NO. | FIRST REEL | SECOND REEL | THIRD REEL | FOURTH REEL | FIFTH REEL |
|---|---|---|---|---|---|
| 50 | JACK | NINE | PINK | ACE | ACE |
| 51 | JACK | NINE | WILD | ACE | ACE |
| 52 | GREEN | WILD | GREEN | ACE | ACE |
| 53 | GREEN | GREEN | GREEN | ACE | ACE |
| 54 | GREEN | GREEN | GREEN | GREEN | WILD |
| 55 | GREEN | GREEN | GREEN | GREEN | RED |
| 56 | RED | GREEN | KING | GREEN | RED |
| 57 | RED | WILD | KING | GREEN | RED |
| 58 | RED | TEN | KING | WILD | RED |
| 59 | RED | TEN | KING | JACK | QUEEN |
| 60 | PINK | TEN | WILD | JACK | QUEEN |
| 61 | PINK | TEN | PINK | JACK | QUEEN |
| 62 | PINK | WILD | PINK | JACK | QUEEN |
| 63 | PINK | BLUE | PINK | BLUE | WILD |
| 64 | TEN | BLUE | PINK | BLUE | PINK |
| 65 | TEN | BLUE | WILD | BLUE | PINK |
| 66 | TEN | BLUE | TEN | BLUE | PINK |
| 67 | TEN | WILD | TEN | TEN | PINK |
| 68 | FEATURE | JACK | TEN | TEN | TEN |
| 69 | FEATURE | JACK | TEN | TEN | TEN |
| 70 | FEATURE | JACK | WILD | TEN | TEN |
| 71 | FEATURE | JACK | GREEN | WILD | TEN |
| 72 | FEATURE | WILD | GREEN | GREEN | WILD |
| 73 | FEATURE | PINK | GREEN | GREEN | BLUE |
| 74 | FEATURE | PINK | GREEN | GREEN | BLUE |

FIG 4D

| CODE NO. | FIRST REEL | SECOND REEL | THIRD REEL | FOURTH REEL | FIFTH REEL |
|---|---|---|---|---|---|
| 75 | FEATURE | PINK | WILD | GREEN | BLUE |
| 76 | FEATURE | PINK | ACE | NINE | BLUE |
| 77 | FEATURE | WILD | ACE | NINE | ACE |
| 78 | FEATURE | QUEEN | ACE | NINE | ACE |
| 79 | FEATURE | QUEEN | ACE | NINE | ACE |
| 80 | FEATURE | QUEEN | WILD | WILD | ACE |
| 81 | FEATURE | QUEEN | RED | RED | WILD |
| 82 | FEATURE | WILD | RED | RED | RED |
| 83 | FEATURE | RED | RED | RED | RED |
| 84 | FEATURE | RED | RED | RED | RED |
| 85 | FEATURE | RED | NINE | KING | RED |
| 86 | FEATURE | RED | NINE | KING | JACK |
| 87 | FEATURE | WILD | NINE | KING | JACK |
| 88 | NINE | KING | NINE | KING | JACK |
| 89 | NINE | KING | BLUE | WILD | JACK |
| 90 | NINE | KING | BLUE | PINK | WILD |
| 91 | NINE | KING | BLUE | PINK | GREEN |
| 92 | BLACK | FEATURE | BLUE | PINK | GREEN |
| 93 | BLACK | FEATURE | QUEEN | PINK | GREEN |
| 94 | BLACK | FEATURE | QUEEN | ACE | GREEN |
| 95 | BLACK | FEATURE | QUEEN | ACE | NINE |
| 96 | BLACK | FEATURE | QUEEN | ACE | NINE |
| 97 | BLACK | FEATURE | FEATURE | ACE | NINE |
| 98 | BLACK | FEATURE | FEATURE | FEATURE | NINE |
| 99 | BLACK | FEATURE | FEATURE | FEATURE | FEATURE |

FIG 5A

SYMBOL ARRAYS IN NORMAL GAMES

| CODE NO. | FIRST REEL | SECOND REEL | THIRD REEL | FOURTH REEL | FIFTH REEL |
|---|---|---|---|---|---|
| 100 | | FEATURE | FEATURE | FEATURE | FEATURE |
| 101 | | FEATURE | FEATURE | FEATURE | FEATURE |
| 102 | | FEATURE | FEATURE | FEATURE | FEATURE |
| 103 | | FEATURE | FEATURE | FEATURE | FEATURE |
| 104 | | FEATURE | FEATURE | FEATURE | FEATURE |
| 105 | | FEATURE | FEATURE | FEATURE | FEATURE |
| 106 | | FEATURE | FEATURE | FEATURE | FEATURE |
| 107 | | FEATURE | FEATURE | FEATURE | FEATURE |
| 108 | | FEATURE | FEATURE | FEATURE | FEATURE |
| 109 | | FEATURE | FEATURE | FEATURE | FEATURE |
| 110 | | FEATURE | FEATURE | FEATURE | FEATURE |
| 111 | | FEATURE | FEATURE | FEATURE | FEATURE |
| 112 | | FEATURE | FEATURE | FEATURE | FEATURE |
| 113 | | FEATURE | FEATURE | FEATURE | FEATURE |
| 114 | | FEATURE | FEATURE | FEATURE | FEATURE |
| 115 | | FEATURE | FEATURE | FEATURE | FEATURE |
| 116 | | ACE | FEATURE | FEATURE | FEATURE |
| 117 | | ACE | FEATURE | FEATURE | FEATURE |
| 118 | | ACE | JACK | QUEEN | FEATURE |
| 119 | | ACE | JACK | QUEEN | KING |
| 120 | | WILD | JACK | QUEEN | KING |
| 121 | | WILD | JACK | QUEEN | KING |
| 122 | | WILD | WILD | WILD | KING |
| 123 | | WILD | WILD | WILD | WILD |
| 124 | | BLACK | WILD | WILD | WILD |

FIG. 5B

| CODE NO. | FIRST REEL | SECOND REEL | THIRD REEL | FOURTH REEL | FIFTH REEL |
|---|---|---|---|---|---|
| 125 | | BLACK | WILD | WILD | WILD |
| 126 | | BLACK | BLACK | BLACK | WILD |
| 127 | | BLACK | BLACK | BLACK | BLACK |
| 128 | | BLACK | BLACK | BLACK | BLACK |
| 129 | | BLACK | BLACK | BLACK | BLACK |
| 130 | | BLACK | BLACK | BLACK | BLACK |
| 131 | | BLACK | BLACK | BLACK | |
| 132 | | | BLACK | BLACK | |
| 133 | | | BLACK | BLACK | |
| 134 | | | | | |
| 135 | | | | | |
| 136 | | | | | |
| 137 | | | | | |
| 138 | | | | | |
| 139 | | | | | |
| 140 | | | | | |
| 141 | | | | | |
| 142 | | | | | |
| 143 | | | | | |
| 144 | | | | | |
| 145 | | | | | |
| 146 | | | | | |
| 147 | | | | | |
| 148 | | | | | |
| 149 | | | | | |

FIG 6A

SYMBOL ARRAYS IN FREE GAMES

| CODE NO. | FIRST REEL | SECOND REEL | THIRD REEL | FOURTH REEL | FIFTH REEL |
|---|---|---|---|---|---|
| 0 | RED | BLUE | GREEN | PINK | WILD |
| 1 | RED | BLUE | GREEN | PINK | WILD |
| 2 | RED | BLUE | GREEN | PINK | WILD |
| 3 | RED | BLUE | GREEN | PINK | WILD |
| 4 | BLUE | PINK | RED | GREEN | RED |
| 5 | BLUE | PINK | RED | GREEN | RED |
| 6 | BLUE | PINK | RED | GREEN | RED |
| 7 | BLUE | PINK | RED | GREEN | RED |
| 8 | PINK | GREEN | BLUE | RED | BLUE |
| 9 | PINK | GREEN | BLUE | RED | BLUE |
| 10 | PINK | GREEN | BLUE | RED | BLUE |
| 11 | PINK | GREEN | BLUE | RED | BLUE |
| 12 | GREEN | RED | PINK | BLUE | PINK |
| 13 | GREEN | RED | PINK | BLUE | PINK |
| 14 | GREEN | RED | PINK | BLUE | PINK |
| 15 | GREEN | RED | PINK | BLUE | PINK |
| 16 | ACE | PINK | RED | RED | GREEN |
| 17 | ACE | PINK | RED | RED | GREEN |
| 18 | ACE | PINK | RED | RED | GREEN |
| 19 | ACE | PINK | RED | RED | GREEN |
| 20 | RED | WILD | WILD | QUEEN | BLUE |
| 21 | RED | GREEN | TEN | QUEEN | BLUE |
| 22 | RED | GREEN | TEN | QUEEN | BLUE |
| 23 | RED | GREEN | TEN | QUEEN | BLUE |
| 24 | KING | GREEN | TEN | BLUE | WILD |

FIG. 6B

| CODE NO. | FIRST REEL | SECOND REEL | THIRD REEL | FOURTH REEL | FIFTH REEL |
|---|---|---|---|---|---|
| 25 | KING | WILD | BLUE | BLUE | KING |
| 26 | KING | RED | BLUE | BLUE | KING |
| 27 | KING | RED | BLUE | BLUE | KING |
| 28 | BLUE | RED | BLUE | WILD | KING |
| 29 | BLUE | RED | WILD | KING | PINK |
| 30 | BLUE | WILD | NINE | KING | PINK |
| 31 | BLUE | BLUE | NINE | KING | PINK |
| 32 | QUEEN | BLUE | NINE | KING | PINK |
| 33 | QUEEN | BLUE | NINE | PINK | WILD |
| 34 | QUEEN | BLUE | WILD | PINK | GREEN |
| 35 | QUEEN | WILD | PINK | PINK | GREEN |
| 36 | PINK | NINE | PINK | PINK | GREEN |
| 37 | PINK | NINE | PINK | WILD | GREEN |
| 38 | PINK | NINE | PINK | ACE | ACE |
| 39 | PINK | NINE | WILD | ACE | ACE |
| 40 | JACK | WILD | GREEN | ACE | ACE |
| 41 | JACK | GREEN | GREEN | ACE | ACE |
| 42 | JACK | GREEN | GREEN | GREEN | WILD |
| 43 | JACK | GREEN | GREEN | GREEN | RED |
| 44 | GREEN | GREEN | KING | GREEN | RED |
| 45 | GREEN | WILD | KING | GREEN | RED |
| 46 | GREEN | TEN | KING | WILD | RED |
| 47 | GREEN | TEN | KING | JACK | QUEEN |
| 48 | RED | TEN | WILD | JACK | QUEEN |
| 49 | RED | TEN | PINK | JACK | QUEEN |

FIG 6C

| CODE NO. | FIRST REEL | SECOND REEL | THIRD REEL | FOURTH REEL | FIFTH REEL |
|---|---|---|---|---|---|
| 50 | RED | WILD | PINK | JACK | QUEEN |
| 51 | RED | BLUE | PINK | BLUE | WILD |
| 52 | PINK | BLUE | PINK | BLUE | PINK |
| 53 | PINK | BLUE | WILD | BLUE | PINK |
| 54 | PINK | BLUE | TEN | BLUE | PINK |
| 55 | PINK | WILD | TEN | TEN | PINK |
| 56 | TEN | JACK | TEN | TEN | TEN |
| 57 | TEN | JACK | TEN | TEN | TEN |
| 58 | TEN | JACK | WILD | TEN | TEN |
| 59 | TEN | JACK | GREEN | WILD | TEN |
| 60 | FEATURE | WILD | GREEN | GREEN | WILD |
| 61 | FEATURE | PINK | GREEN | GREEN | BLUE |
| 62 | FEATURE | PINK | GREEN | GREEN | BLUE |
| 63 | FEATURE | PINK | WILD | GREEN | BLUE |
| 64 | FEATURE | PINK | ACE | NINE | BLUE |
| 65 | FEATURE | WILD | ACE | NINE | ACE |
| 66 | FEATURE | QUEEN | ACE | NINE | ACE |
| 67 | FEATURE | QUEEN | ACE | NINE | ACE |
| 68 | FEATURE | QUEEN | WILD | WILD | ACE |
| 69 | FEATURE | QUEEN | RED | RED | WILD |
| 70 | FEATURE | WILD | RED | RED | RED |
| 71 | FEATURE | RED | RED | RED | RED |
| 72 | FEATURE | RED | RED | RED | RED |
| 73 | FEATURE | RED | NINE | KING | RED |
| 74 | FEATURE | RED | NINE | KING | JACK |

FIG 6D

| CODE NO. | FIRST REEL | SECOND REEL | THIRD REEL | FOURTH REEL | FIFTH REEL |
|---|---|---|---|---|---|
| 75 | FEATURE | WILD | NINE | KING | JACK |
| 76 | FEATURE | KING | NINE | KING | JACK |
| 77 | FEATURE | KING | BLUE | WILD | JACK |
| 78 | FEATURE | KING | BLUE | PINK | WILD |
| 79 | FEATURE | KING | BLUE | PINK | GREEN |
| 80 | NINE | FEATURE | BLUE | PINK | GREEN |
| 81 | NINE | FEATURE | QUEEN | PINK | GREEN |
| 82 | NINE | FEATURE | QUEEN | ACE | GREEN |
| 83 | NINE | FEATURE | QUEEN | ACE | NINE |
| 84 | BLACK | FEATURE | QUEEN | ACE | NINE |
| 85 | BLACK | FEATURE | FEATURE | ACE | NINE |
| 86 | BLACK | FEATURE | FEATURE | FEATURE | NINE |
| 87 | BLACK | FEATURE | FEATURE | FEATURE | FEATURE |
| 88 | BLACK | FEATURE | FEATURE | FEATURE | FEATURE |
| 89 | BLACK | FEATURE | FEATURE | FEATURE | FEATURE |
| 90 | BLACK | FEATURE | FEATURE | FEATURE | FEATURE |
| 91 | BLACK | FEATURE | FEATURE | FEATURE | FEATURE |
| 92 | BLACK | FEATURE | FEATURE | FEATURE | FEATURE |
| 93 | BLACK | FEATURE | FEATURE | FEATURE | FEATURE |
| 94 | BLACK | FEATURE | FEATURE | FEATURE | FEATURE |
| 95 | BLACK | FEATURE | FEATURE | FEATURE | FEATURE |
| 96 | BLACK | FEATURE | FEATURE | FEATURE | FEATURE |
| 97 | BLACK | FEATURE | FEATURE | FEATURE | FEATURE |
| 98 | BLACK | FEATURE | FEATURE | FEATURE | FEATURE |
| 99 | BLACK | FEATURE | FEATURE | FEATURE | FEATURE |

FIG. 7A

SYMBOL ARRAYS IN FREE GAMES

| CODE NO. | FIRST REEL | SECOND REEL | THIRD REEL | FOURTH REEL | FIFTH REEL |
|---|---|---|---|---|---|
| 100 | BLACK | FEATURE | FEATURE | FEATURE | FEATURE |
| 101 | BLACK | FEATURE | FEATURE | FEATURE | FEATURE |
| 102 | BLACK | FEATURE | FEATURE | FEATURE | FEATURE |
| 103 | BLACK | FEATURE | FEATURE | FEATURE | FEATURE |
| 104 | BLACK | ACE | FEATURE | FEATURE | FEATURE |
| 105 | BLACK | ACE | FEATURE | FEATURE | FEATURE |
| 106 | BLACK | ACE | JACK | QUEEN | FEATURE |
| 107 | BLACK | ACE | JACK | QUEEN | KING |
| 108 | BLACK | WILD | JACK | QUEEN | KING |
| 109 | BLACK | WILD | JACK | QUEEN | KING |
| 110 | | WILD | WILD | WILD | KING |
| 111 | | WILD | WILD | WILD | WILD |
| 112 | | BLACK | WILD | WILD | WILD |
| 113 | | BLACK | WILD | WILD | WILD |
| 114 | | BLACK | BLACK | BLACK | WILD |
| 115 | | BLACK | BLACK | BLACK | BLACK |
| 116 | | BLACK | BLACK | BLACK | BLACK |
| 117 | | BLACK | BLACK | BLACK | BLACK |
| 118 | | BLACK | BLACK | BLACK | BLACK |
| 119 | | BLACK | BLACK | BLACK | BLACK |
| 120 | | BLACK | BLACK | BLACK | BLACK |
| 121 | | BLACK | BLACK | BLACK | BLACK |
| 122 | | BLACK | BLACK | BLACK | BLACK |
| 123 | | BLACK | BLACK | BLACK | BLACK |
| 124 | | BLACK | BLACK | BLACK | BLACK |

FIG 7B

| CODE NO. | FIRST REEL | SECOND REEL | THIRD REEL | FOURTH REEL | FIFTH REEL |
|---|---|---|---|---|---|
| 125 | | BLACK | BLACK | BLACK | BLACK |
| 126 | | BLACK | BLACK | BLACK | BLACK |
| 127 | | BLACK | BLACK | BLACK | BLACK |
| 128 | | BLACK | BLACK | BLACK | BLACK |
| 129 | | BLACK | BLACK | BLACK | BLACK |
| 130 | | BLACK | BLACK | BLACK | BLACK |
| 131 | | BLACK | BLACK | BLACK | BLACK |
| 132 | | BLACK | BLACK | BLACK | BLACK |
| 133 | | BLACK | BLACK | BLACK | BLACK |
| 134 | | BLACK | BLACK | BLACK | BLACK |
| 135 | | BLACK | BLACK | BLACK | BLACK |
| 136 | | BLACK | BLACK | BLACK | BLACK |
| 137 | | BLACK | BLACK | BLACK | BLACK |
| 138 | | WILD | BLACK | BLACK | BLACK |
| 139 | | WILD | BLACK | BLACK | BLACK |
| 140 | | WILD | WILD | WILD | BLACK |
| 141 | | WILD | WILD | WILD | |
| 142 | | | WILD | WILD | |
| 143 | | | WILD | WILD | |
| 144 | | | | | |
| 145 | | | | | |
| 146 | | | | | |
| 147 | | | | | |
| 148 | | | | | |
| 149 | | | | | |

FIG 9A

WINNING LINE PATTERN (No. 1)

| FIRST REEL | SECOND REEL | THIRD REEL | FOURTH REEL | FIFTH REEL | |
|---|---|---|---|---|---|
| | | | | | FIRST ROW |
| | | | | | SECOND ROW |
| | | | | | THIRD ROW |
| | | | | | FOURTH ROW |

FIG 9B

WINNING LINE DEFINITION TABLE

| No. | FIRST REEL | SECOND REEL | THIRD REEL | FOURTH REEL | FIFTH REEL |
|---|---|---|---|---|---|
| 1 | 0 | 0 | 0 | 0 | 0 |
| 2 | 0 | 0 | 0 | 1 | 0 |
| 3 | 0 | 0 | 0 | 1 | 2 |
| 4 | 0 | 0 | 1 | 1 | 1 |
| 5 | 0 | 1 | 0 | 0 | 0 |
| 6 | 0 | 1 | 2 | 3 | 2 |
| 7 | 0 | 0 | 1 | 0 | 0 |
| 8 | 0 | 1 | 2 | 1 | 0 |
| 9 | 0 | 1 | 0 | 1 | 0 |
| 10 | 0 | 1 | 1 | 1 | 0 |
| 11 | 0 | 0 | 1 | 1 | 0 |
| 12 | 0 | 1 | 1 | 0 | 0 |
| 13 | 1 | 1 | 1 | 1 | 1 |
| 14 | 1 | 1 | 1 | 0 | 1 |
| 15 | 1 | 1 | 1 | 2 | 1 |
| 16 | 1 | 0 | 1 | 1 | 1 |
| 17 | 1 | 2 | 1 | 1 | 1 |
| 18 | 1 | 0 | 1 | 2 | 3 |
| 19 | 1 | 1 | 2 | 1 | 1 |
| 20 | 1 | 1 | 0 | 1 | 1 |
| 21 | 1 | 0 | 0 | 0 | 1 |
| 22 | 1 | 0 | 1 | 0 | 1 |
| 23 | 1 | 2 | 2 | 2 | 1 |
| 24 | 1 | 2 | 1 | 2 | 1 |
| 25 | 1 | 2 | 3 | 2 | 1 |
| 26 | 2 | 2 | 2 | 2 | 2 |
| 27 | 2 | 2 | 2 | 1 | 2 |
| 28 | 2 | 2 | 2 | 3 | 2 |
| 29 | 2 | 1 | 2 | 2 | 2 |
| 30 | 2 | 2 | 1 | 2 | 2 |
| 31 | 2 | 3 | 2 | 1 | 0 |
| 32 | 2 | 3 | 2 | 2 | 2 |
| 33 | 2 | 2 | 3 | 2 | 2 |
| 34 | 2 | 1 | 1 | 1 | 2 |
| 35 | 2 | 1 | 2 | 1 | 2 |
| 36 | 2 | 1 | 0 | 1 | 2 |
| 37 | 2 | 3 | 2 | 3 | 2 |
| 38 | 2 | 3 | 3 | 3 | 2 |
| 39 | 3 | 3 | 3 | 3 | 3 |
| 40 | 3 | 3 | 3 | 2 | 1 |
| 41 | 3 | 3 | 3 | 2 | 3 |
| 42 | 3 | 2 | 3 | 3 | 3 |
| 43 | 3 | 3 | 2 | 2 | 2 |
| 44 | 3 | 2 | 1 | 0 | 1 |
| 45 | 3 | 2 | 2 | 3 | 3 |
| 46 | 3 | 3 | 2 | 2 | 3 |
| 47 | 3 | 3 | 2 | 3 | 3 |
| 48 | 3 | 2 | 1 | 2 | 3 |
| 49 | 3 | 2 | 2 | 2 | 3 |
| 50 | 3 | 2 | 3 | 2 | 3 |

FIG. 10A

PAYOUT TABLE (LINE PAYOUT)

| SYMBOL | 1 | 2 | 3 | 4 | 5 |
|---|---|---|---|---|---|
| WILD | 0 | 0 | 0 | 0 | 0 |
| BLACK | 0 | 2 | 15 | 25 | 50 |
| RED | 0 | 1 | 10 | 20 | 40 |
| BLUE | 0 | 1 | 10 | 20 | 40 |
| PINK | 0 | 1 | 8 | 15 | 30 |
| GREEN | 0 | 1 | 8 | 15 | 30 |
| ACE | 0 | 0 | 5 | 10 | 15 |
| KING | 0 | 0 | 4 | 9 | 14 |
| QUEEN | 0 | 0 | 3 | 8 | 13 |
| JACK | 0 | 0 | 2 | 7 | 12 |
| TEN | 0 | 0 | 1 | 6 | 11 |
| NINE | 0 | 0 | 1 | 6 | 11 |

FIG. 10B

PAYOUT TABLE (BONUS PAYOUT)

| NUMBER OF FEATURE SYMBOLS | PAYOUT |
|---|---|
| 1－2 | 0 |
| 3－9 | 1 |
| 10－12 | 2 |
| 13, 14 | 3 |
| 15 | 4 |
| 16 | 5 |
| 17 | 6 |
| 18 | 7 |
| 19 | 8 |
| 20 | 10 |

FIG. 10C

SYMBOL DEFINITION TABLE

| SYMBOL | GRAPHIC DISPLAY FILE |
|---|---|
| WILD | — |
| BLACK | BLACK |
| RED | RED |
| BLUE | BLUE |
| PINK | PINK |
| GREEN | GREEN |
| ACE | A |
| KING | K |
| QUEEN | Q |
| JACK | J |
| TEN | 10 |
| NINE | 9 |
| FEATURE | ORB |

FIG. 11A

PREDICTIVE EFFECTS LOTTERY TABLE

| No. | EFFECTS | TABLE A | TABLE B | TABLE C | TABLE D | TABLE E | TABLE F |
|---|---|---|---|---|---|---|---|
| 0 | NO EFFECTS | 100 | 80 | 70 | 70 | 70 | 0 |
| 1 | PREDICTION 1 | 0 | 0 | 0 | 15 | 15 | 0 |
| 2 | PREDICTION 2 | 0 | 0 | 0 | 0 | 0 | 100 |
| 3 | PREDICTION 3 | 0 | 0 | 0 | 15 | 15 | 0 |
| 4 | PREDICTION 4 | 0 | 20 | 15 | 0 | 0 | 0 |
| 5 | PREDICTION 5 | 0 | 0 | 15 | 0 | 0 | 0 |
| | TOTAL | 100 | 100 | 100 | 100 | 100 | 100 |

FIG. 11B

| EFFECTS | DESCRIPTION |
|---|---|
| PREDICTION 1 | IMAGE OF SMALL DIAMOND APPEARS |
| PREDICTION 2 | IMAGE OF SMALL DIAMOND APPEARS; IMAGE OF BIG DIAMOND APPEARS; AND THEN REELS SHOWING FEATURE SYMBOLS ARE NUDGED |
| PREDICTION 3 | REELS ARE SPUN IN REVERSE DIRECTION |
| PREDICTION 4 | SMALL GROUP OF ANIMALS MOVE ACROSS SCREEN |
| PREDICTION 5 | LARGE GROUP OF ANIMALS MOVE ACROSS SCREEN |

FIG. 12A

ORDER MANAGEMENT TABLE

| FIRST REEL | SECOND REEL | THIRD REEL | FOURTH REEL | FIFTH REEL | |
|---|---|---|---|---|---|
| 1 | 5 | 9 | 13 | 17 | FIRST ROW |
| 2 | 6 | 10 | 14 | 18 | SECOND ROW |
| 3 | 7 | 11 | 15 | 19 | THIRD ROW |
| 4 | 8 | 12 | 16 | 20 | FOURTH ROW |

FIG. 12B

SPIN TABLE LOTTERY TABLE FOR NUMBER-OF-FREE-GAMES LOTTERY

| SPIN TABLE | NUMBER OF FREE GAMES GAINED BY FEATURE SYMBOL | | | | | |
|---|---|---|---|---|---|---|
| | 1 | 2 | 3 | 5 | 7 | 10 |
| TABLE 1 | 80 | 0 | 0 | 0 | 0 | 0 |
| TABLE 2 | 0 | 60 | 0 | 0 | 0 | 0 |
| TABLE 3 | 20 | 0 | 80 | 0 | 0 | 0 |
| TABLE 4 | 0 | 40 | 0 | 60 | 0 | 0 |
| TABLE 5 | 0 | 0 | 20 | 40 | 100 | 0 |
| TABLE 6 | 0 | 0 | 0 | 0 | 0 | 100 |
| TOTAL | 100 | 100 | 100 | 100 | 100 | 100 |

FIG. 13A

INCREMENTING SPEED MANAGEMENT TABLE

| NUMBER OF FREE GAMES TO BE ADDED | INCREMENTING SPEED PER GAME (FRAME) | TOTAL INCREMENTING TIME (SEC) |
|---|---|---|
| 1 | 8 | 0. 13 |
| 2 | 8 | 0. 27 |
| 3 | 8 | 0. 4 |
| 5 | 8 | 0. 67 |
| 7 | 8 | 0. 93 |
| 10 | 8 | 1. 33 |

FIG. 13B

INCREMENTING SOUND CONTROL TABLE

| NUMBER OF FREE GAMES | SOUND EFFECT FILE |
|---|---|
| 0～9 | FILE A |
| 10～19 | FILE B |
| 20～49 | FILE C |
| 50～99 | FILE D |
| 100～200 | FILE E |

FIG. 29A

| FIRST REEL | SECOND REEL | THIRD REEL | FOURTH REEL | FIFTH REEL |
|---|---|---|---|---|
| 60 | 80 | 85 | 86 | 87 |
| 61 | 81 | 86 | 87 | 88 |
| 62 | 82 | 87 | 88 | 89 |
| 63 | 83 | 88 | 89 | 90 |

UPWARD NUDGE

FIG. 29B

| FIRST REEL | SECOND REEL | THIRD REEL | FOURTH REEL | FIFTH REEL |
|---|---|---|---|---|
| 76 | 100 | 102 | 102 | 103 |
| 77 | 101 | 103 | 103 | 104 |
| 78 | 102 | 104 | 104 | 105 |
| 79 | 103 | 105 | 105 | 106 |

DOWNWARD NUDGE

FIG. 30A

STOP POSITION DETERMINED BY SYMBOL LOTTERY PROCESSING

| FIRST REEL |
|---|
| 60 |
| 61 |
| 62 |
| 63 |

(DETERMINES ONE OF THREE BY LOTTERY)

CANDIDATE PSEUDO STOP POSITIONS (A-1)

| | |
|---|---|
| 57 | TEN |
| 58 | TEN |
| 59 | TEN |
| 60 | FEATURE |

(A-2)

| | |
|---|---|
| 58 | TEN |
| 59 | TEN |
| 60 | FEATURE |
| 61 | FEATURE |

(A-3)

| | |
|---|---|
| 59 | TEN |
| 60 | FEATURE |
| 61 | FEATURE |
| 62 | FEATURE |

FIG. 30B

STOP POSITION DETERMINED BY SYMBOL LOTTERY PROCESSING

| FIRST REEL |
|---|
| 76 |
| 77 |
| 78 |
| 79 |

(DETERMINES ONE OF THREE BY LOTTERY)

CANDIDATE PSEUDO STOP POSITIONS (B-1)

| | |
|---|---|
| 79 | FEATURE |
| 80 | NINE |
| 81 | NINE |
| 82 | NINE |

(B-2)

| | |
|---|---|
| 78 | FEATURE |
| 79 | FEATURE |
| 80 | NINE |
| 81 | NINE |

(B-3)

| | |
|---|---|
| 77 | FEATURE |
| 78 | FEATURE |
| 79 | FEATURE |
| 80 | NINE |

22
FREE GAMES
402 SECOND SCREEN
415
22
FREE GAMES
401 FIRST SCREEN

TOTAL
22
FREE GAMES
402 SECOND SCREEN
FREE GAMES
TOTAL
22
FREE GAMES
PRESS START FEATURE BUTTON
401 FIRST SCREEN

| FIRST REEL | SECOND REEL | THIRD REEL | FOURTH REEL | FIFTH REEL |
|---|---|---|---|---|
| 108 | 136 | 138 | 138 | 139 |
| 109 | 137 | 139 | 139 | 140 |
| 0 | 138 | 140 | 140 | 0 |
| 1 | 139 | 141 | 141 | 1 |

| FIRST REEL | SECOND REEL | THIRD REEL | FOURTH REEL | FIFTH REEL |
|---|---|---|---|---|
| 106 | 134 | 136 | 136 | 137 |
| 107 | 135 | 137 | 137 | 138 |
| 108 | 136 | 138 | 138 | 139 |
| 109 | 137 | 139 | 139 | 140 |

| SYMBOL | WINNING LINE | SPECIFICS OF LINE | REQUIRED NUMBER | PAYOUT |
|---|---|---|---|---|
| ★ (BLACK) | 10 | (0, 1, 1, 1, 0) | 4 | 25 |
| | 12 | (0, 1, 1, 0, 0) | 3 | 15 |
| | 13 | (1, 1, 1, 1, 1) | 3 | 15 |
| | 34 | (2, 1, 1, 1, 2) | 3 | 15 |
| | 4 | (0, 0, 1, 1, 1) | 3 | 15 |
| | 5 | (0, 1, 0, 0, 0) | 2 | 2 |
| | 6 | (0, 1, 2, 3, 2) | 2 | 2 |
| | 9 | (0, 1, 0, 1, 0) | 3 | 15 |
| | 11 | (0, 0, 1, 1, 0) | 3 | 15 |
| | 14 | (1, 1, 1, 0, 1) | 2 | 2 |
| | 15 | (1, 1, 1, 2, 1) | 2 | 2 |
| | 16 | (1, 0, 1, 1, 1) | 2 | 2 |
| | 17 | (1, 2, 1, 1, 1) | 2 | 2 |
| J (JACK) | 39 | (3, 3, 3, 3, 3) | 3 | 2 |
| | 40 | (3, 3, 3, 2, 1) | 3 | 2 |
| | 41 | (3, 3, 3, 2, 3) | 3 | 2 |

FIG. 53A
| TOTAL WINS IN SPIN | EFFECTS FOR WIN SIGN |
|---|---|
| LESS THAN 20 TIMES OF TOTAL BETS | SILVER SIGN |
| NOT LESS THAN 20 TIMES AND LESS THAN 50 TIMES OF TOTAL BETS | GOLD SIGN + COINS |
| NOT LESS THAN 50 TIMES OF TOTAL BETS | GOLD SIGN + COINS + BILLS |
FIG. 53B
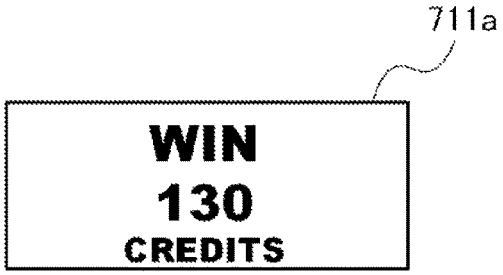
FIG. 53C
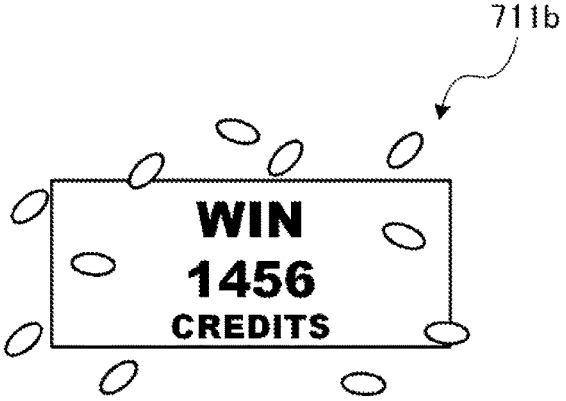

FIG. 54

WIN SIGN INCREMENTING SPEED MANAGEMENT TABLE

| WIN CLASS | CRITERION (TOTAL BETS) | | INCREMENTING TIME (SEC) |
|---|---|---|---|
| | NOT LESS THAN | LESS THAN | |
| win_1 | — | 0. 1 | 0. 50 |
| win_2 | 0. 1 | 0. 2 | 0. 60 |
| win_3 | 0. 2 | 0. 3 | 0. 70 |
| win_4 | 0. 3 | 0. 4 | 0. 90 |
| win_5 | 0. 4 | 0. 5 | 0. 90 |
| win_6 | 0. 5 | 0. 75 | 1. 50 |
| win_7 | 0. 75 | 1 | 2. 00 |
| win_8 | 1 | 1. 25 | 2. 50 |
| win_9 | 1. 25 | 1. 5 | 2. 70 |
| win_10 | 1. 5 | 2 | 3. 90 |
| win_11 | 2 | 3 | 5. 60 |
| win_12 | 3 | 4 | 6. 10 |
| win_13 | 4 | 5 | 9. 90 |
| win_14 | 5 | 6 | 9. 90 |
| win_15 | 6 | 7 | 9. 90 |
| win_16 | 7 | 8 | 11. 90 |
| win_17 | 8 | 10 | 19. 60 |
| win_18 | 10 | 12 | 19. 70 |
| win_19 | 12 | 15 | 23. 80 |
| win_20 | 15 | 20 | 30. 30 |
| win_21 | 20 | 30 | 34. 60 |
| win_22 | 30 | 40 | 43. 00 |
| win_23 | 40 | 50 | 50. 00 |
| win_24 | 50 | — | 72. 00 |

FIG. 63A
| TOTAL GAINED CREDITS | EFFECTS FOR TOTAL WIN SIGN | INDICATION TIME (SEC) |
|---|---|---|
| LESS THAN 20 TIMES OF TOTAL BETS | SILVER SIGN | 3. 6 |
| NOT LESS THAN 20 TIMES AND LESS THAN 50 TIMES OF TOTAL BETS | GOLD SIGN + COINS | 6 |
| NOT LESS THAN 50 TIMES OF TOTAL BETS | GOLD SIGN + COINS + BILLS | 10 |
FIG. 63B
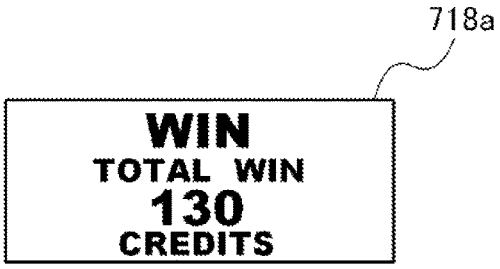
FIG. 63C
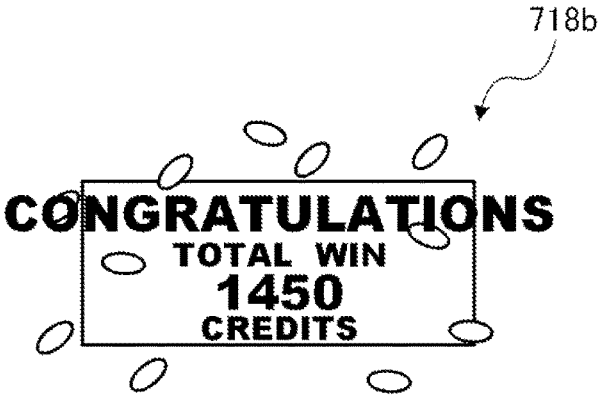

GAMING MACHINE

CROSS-REFERENCE TO RELATED APPLICATIONS

This application claims the benefit of Japanese Patent Application No. 2014-076472 filed on Apr. 2, 2014, which application is incorporated herein by reference in its entirety.

FIELD OF THE INVENTION

The present invention relates to a gaming machine that can repetitively provide unit games.

BACKGROUND OF THE INVENTION

A traditionally known gaming machine operates as follows: in response to insertion of a play medium such as a coin and press of the SPIN button by a player, extracts a random number for symbol determination; determines the symbols to be displayed for the player when a plurality of video reels on the display are stopped; starts scrolling the symbol arrays on the video reels; stops the scrolling to rearrange the symbols so that the determined symbols are displayed for the player; determines whether or not the displayed combination of symbols corresponds to a prize; and, if it corresponds to a prize, provides the player with a benefit for the pattern of the combination of symbols.

Such a gaming machine determines and sets the number of payouts payable during a bonus game in response to winning a BB (big bonus) that triggers the bonus (for example, refer to Japanese unexamined patent application publication No. 2007-20954). This gaming machine offers bonus games until the player fully receives the set number of payouts.

BRIEF SUMMARY OF THE INVENTION

The traditional gaming machines, however, do not include a system that, in response to determination of start of free games, changes candidates of predictive effects depending on the number of expected free games (the number of rearranged special symbols) and selects predictive effects to be implemented from the candidates by lottery. The free games are conducted in response to winning a BB that triggers a bonus. The predictive effects are to hint at start of free games.

An object of the present invention is therefore to provide a gaming machine including a system that, if the symbols determined to be rearranged by lottery are to trigger or retrigger free games, controls implementation of predetermined predictive effects to the symbol display region before rearranging the symbols; the gaming machine changes candidates of predictive effects for hinting at start of free games depending on the number of expected free games (the number of rearranged specific symbols) and selects predictive effects to be implemented from the candidates by lottery.

Another object of the present invention is to provide a gaming machine that implements predictive effects in starting a free game promising a big benefit by pretending first that the free game to be started will provide a small benefit (by spinning and stopping the reels) and subsequently indicating that the free game will actually provide a big benefit (by repositioning the reels by a little).

According to the first aspect of the present invention, provided is a gaming machine for determining a payout based on rearranged symbols. The gaming machine comprises a plurality of reels (e.g., five video reels 3*a* to 3*e* displayed in a symbol display region 4) on outer surfaces of which a plurality of symbols are attached, a display device (e.g., a lower image display panel 141), and a controller (e.g., a main CPU 71, a body PCB 110, etc.) for controlling first games (e.g., normal games or free games). Each of the first games rearranges a part of the plurality of symbols (e.g., the symbols on symbol arrays on the five video reels 3*a* to 3*e* illustrated in FIGS. 4A to 7B) in a display region (e.g., a symbol display region 4) of the display device by spinning and stopping the plurality of reels. The controller is programmed to perform the following processing of (1-1) to (1-3).

The processing of (1-1) is determining, by a first lottery, symbols to be rearranged in a first game;

the processing of (1-2) is, if the processing of (1-1) determines, by the first lottery (e.g., a lottery for determining to-be stopped symbols in a normal game or free game), that symbols are to be rearranged in the display region in an arrangement satisfying first conditions including appearance of a specific number of a specific type of symbols (e.g., at least one feature symbol appears on each of the first reel, the second reel, and the third reel), determining, by a second lottery (e.g., a lottery using Table C, Table D, or Table E illustrated in FIG. 11A), whether to implement predictive effects for informing a player in advance of start of second games (e.g., free games) by spinning and stopping the plurality of reels; and the processing of (1-3) is, if the processing of (1-2) determines to implement the predictive effects, controlling the predictive effects to be implemented before showing the symbols to be rearranged in the display region.

The configuration in the foregoing aspect of the present invention allows various predictive effects to be selected and implemented depending on the result of lottery for symbols to be rearranged, attaining more interest and expectation from the player to play games.

The second aspect of the present invention is configured such that, in the first aspect of the present invention, the predictive effects include a phase in which a part of the specific number of the specific type of symbols on at least a part of the plurality of reels are temporarily stopped at pseudo stop positions (e.g., stop positions which are upper or lower than the positions to stop the symbols by one to three symbols as illustrated in FIGS. 31A and 31B) in the display region a nudge phase (e.g., performance that nudges the symbols on the reels upward or downward by one to three symbols as indicated by the arrows in FIGS. 31A and 31B to show four feature symbols on each of the reels), and a phase in which the symbols to be rearranged determined by the first lottery are rearranged in the display region.

The configuration in the foregoing aspect of the present invention allows various predictive effects to be selected and implemented depending on the result of lottery for symbols to be rearranged, attaining more interest and expectation from the player to play games. In addition, since the predictive effects in starting a free game promising a big benefit begin as if the free game would provide a small benefit, the player's interest in and expectation for the free game increase much more.

The third aspect of the present invention is configured such that, in the second aspect of the present invention, the pseudo stop positions in the predictive effects are determined by a third lottery based on positions of the symbols to be rearranged determined by the first lottery (e.g., the symbols to stop at the stop positions are moved upward or downward by one to three symbols by lottery as illustrated in FIG. 30A or 30B).

The configuration in the foregoing aspect of the present invention allows various predictive effects to be selected and implemented depending on the result of lottery for symbols to be rearranged, attaining more interest and expectation from the player to play games. In addition, since the predictive effects in starting a free game promising a big benefit begin as if the free game would provide a small benefit, the player's interest in and expectation for the free game increase much more.

The fourth aspect of the present invention is configured such that, in the second aspect of the present invention, the predictive effects further include:

a phase in which a first image (e.g., an image of a small diamond as illustrated in FIG. 25A) is displayed in the display region before the spinning of the plurality of reels is started; and a phase in which a second image (e.g., an image of a big diamond as illustrated in FIG. 27B) is displayed in the display region after the part of the specific number of the specific type of symbols are temporarily stopped at the pseudo stop positions in the display region and before the nudge phase is started.

The configuration in the foregoing aspect of the present invention allows various predictive effects to be selected and implemented depending on the result of lottery for symbols to be rearranged, attaining more interest and expectation from the player to play games. In addition, since the predictive effects in starting a free game promising a big benefit begin as if the free game would provide a small benefit, the player's interest in and expectation for the free game increase much more.

The fifth aspect of the present invention is configured such that, in the first aspect of the present invention, the processing of (1-2) includes the following processing of (1-2-1). The processing of (1-2-1) is, if the processing of (1-1) determines, by the first lottery, that symbols are to be rearranged in the display region in an arrangement satisfying second conditions including appearance of a specific number or more of the specific type of symbols (e.g., one or more feature symbols appear on each of the first reel, the second reel, and the third reel and the feature symbols are not suitable for nudging), determining, by a fourth lottery (e.g., a lottery using Table C or Table D as illustrated in FIG. 11A), whether to implement predictive effects for informing a player in advance of start of second games, the predictive effects including a phase in which a first image (e.g., an image of a small diamond as illustrated in FIG. 25A) is displayed in the display region before the spinning of the plurality of reels is started.

The configuration in the foregoing aspect of the present invention allows various predictive effects to be selected and implemented depending on the result of lottery for symbols to be rearranged, attaining more interest and expectation from the player to play games. In addition, since the predictive effects in starting a free game promising a big benefit begin as if the free game would provide a small benefit, the player's interest in and expectation for the free game increase much more.

The sixth aspect of the present invention is configured such that, in the third aspect of the present invention, the specific type of symbols are consecutively attached on each of the reels, and that the controller is programmed to perform the following processing of:

determining, by the first lottery, the symbols to be rearranged in an arrangement satisfying a condition that the specific type of symbols consecutively appear in the display region;

switching the first games to the second games under a condition where the first conditions are satisfied; and determining a number of second games by conducting fifth lotteries for the specific number of times in the switching to the second games.

Since the specific type of symbols consecutively appear along the reels in the display region, the specific number can be made greater to increase second games.

The seventh aspect of the present invention is configured such that, in the sixth aspect of the present invention, the display region shows a predetermined number of symbols on each of the plurality of reels along a direction of the scrolling, that numbers of the specific type of symbols attached on the plurality of reels are larger than the predetermined number, and that the processing of determining by the first lottery determines the symbols to be rearranged in an arrangement satisfying a condition that the predetermined number of the specific type of symbols consecutively appear in the display region.

Since the display region shows a predetermined number of symbols along the direction of scrolling of the reels, the specific type of symbols consecutively appearing in the display region can be increased up to the predetermined number, so that the number of second games can be further increased.

The eighth aspect of the present invention is configured such that, in the seventh aspect of the present invention, the symbols attached on each of the plurality of reels include an uppermost symbol located uppermost among the specific type of symbols consecutively attached on the reel and a lowermost symbol located lowermost among the specific type of symbols consecutively attached on the reel, that the controller is programmed to perform the processing of:

determining, by the third lottery, the pseudo stop position satisfying a condition that the uppermost symbol appears in the display region, if the symbols to be rearranged includes the uppermost symbol; and determining, by the third lottery, the pseudo stop position satisfying a condition that the lowermost symbol appears in the display region, if the symbols to be rearranged includes the lowermost symbol.

Since the specific type of symbols are consecutively displayed at the final phase after the specific type of symbols and other types of symbols are temporarily stopped, the effects are implemented in short time to increase game media consumption. Further, the player's expectation can be increased.

The ninth aspect of the present invention is configured such that, in the eighth aspect of the present invention, the controller is programmed to perform the processing of:

implementing the nudge phase by moving the symbols in a forward direction to show the symbols to be rearranged including the specific type of symbols in the display region, if the uppermost symbol stops at the pseudo stop position; and implementing the nudge phase by moving the symbols in a direction opposite to the forward direction to show the symbols to be rearranged including the specific type of symbols in the display region, if the lowermost symbol stops at the pseudo stop position.

Since the directions of nudging are predetermined for the uppermost symbol and the lowermost symbol, the effects are implemented in minimum time to increase game media consumption.

The configuration in the foregoing aspect of the present invention allows various predictive effects to be selected and implemented depending on the result of lottery for symbols to be rearranged, attaining more interest and expectation from the player to play games. In addition, since the predictive effects in starting a free game promising a big benefit begin as if the free game would provide a small benefit, the player's interest in and expectation for the free game increase much more.

These and other aspects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which:

FIGS. 4A, 4B, 4C, and 4D are views partially illustrating arrangement of symbols for normal games drawn on the peripheral surfaces of the reels of the gaming machine;

FIGS. 5A and 5B are views partially illustrating arrangement of symbols for normal games drawn on the peripheral surfaces of the reels of the gaming machine;

FIGS. 6A, 6B, 6C, and 6D are views partially illustrating arrangement of symbols for free games drawn on the peripheral surfaces of the reels of the gaming machine;

FIGS. 7A and 7B are views partially illustrating arrangement of symbols for free games drawn on the peripheral surfaces of the reels of the gaming machine;

FIGS. 9A and 9B are views illustrating a pattern of winning line and a winning line definition table in the gaming machine;

FIGS. 10A, 10B, and 10C are views illustrating payout tables and a symbol definition table in the gaming machine;

FIGS. 11A and 11B are views illustrating a predictive effects lottery table and the specifics of predictive effects in the gaming machine;

FIGS. 12A and 12B are views illustrating an order management table and a spin table lottery table for number-of-free-games lottery table in the gaming machine;

FIGS. 13A and 13B are views illustrating an incrementing speed management table and an incrementing sound control table;

FIGS. 29A and 29B are views for illustrating predictive effects implementation processing for predictive effects of Prediction 2;

FIGS. 30A and 30B are views for illustrating predictive effects implementation processing for predictive effects of Prediction 2;

FIGS. 53A, 53B, 53C, and 53D are views for illustrating effects for a WIN sign;

FIG. 54 is a view for illustrating a WIN sign incrementing speed management table in the gaming machine;

FIGS. 63A, 63B, 63C, and 63D are views for illustrating effects in displaying a total WIN sign at the end of free games.

DETAILED DESCRIPTION OF THE PREFERRED EMBODIMENT

[Explanation of Function Flow Diagram]

Figure 1:
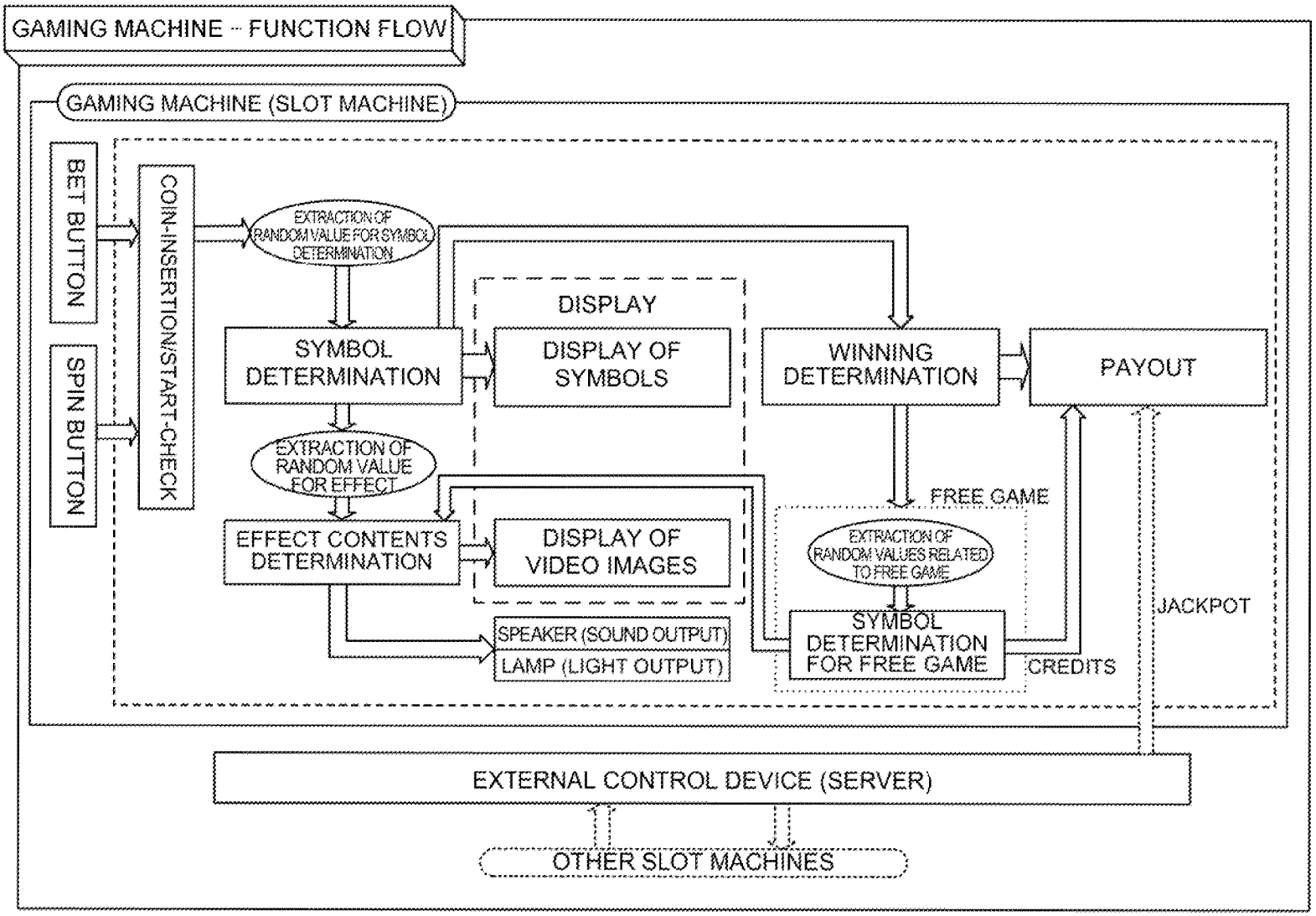
FIG. 1 is a view illustrating a function flow of a gaming machine.

With reference to FIG. 1, basic functions of a gaming machine according to the present embodiment are described. FIG. 1 is a view illustrating a function flow of the gaming machine according to an embodiment of the present invention.

<Coin-Insertion/Start-Check>

First, the gaming machine checks whether or not a coin has been inserted by a player or whether the credit counter indicate a non-zero value, and subsequently, checks whether or not a BET button has been pressed by a player. Thereafter, the gaming machine checks whether or not a SPIN button has been pressed by the player.

<Symbol Determination>

Next, when the SPIN button has been pressed by the player in a normal game, the gaming machine extracts random values for symbol determination, and determines symbols to be displayed at the time of stopping scrolling of symbol arrays for the player, for a plurality of respective video reels displayed to a display.

<Symbol Display>

Next, the gaming machine starts scrolling of the symbol array of each of the video reels and then stops scrolling so that the determined symbols are displayed for the player to rearrange the symbols.

<Winning Determination>

When scrolling of the symbol array of each video reel has been stopped, the gaming machine determines whether or not a combination of symbols displayed for the player is a combination related to winning.

<Payout>

When the combination of symbols displayed for the player is a combination related to winning, the gaming machine offers benefits according to the combination to the player. For example, when a combination of symbols related to a payout of coins has been displayed, the gaming machine pays out coins of the number corresponding to the combination of symbols to the player.

<Free Games>

Further, when a combination of symbols related to a free game trigger has been displayed, the gaming machine starts free games as many as determined by lottery. A free game is a game in which a lottery to determine the symbols is held without using coins.

When the SPIN button has been pressed by the player in a free game, the gaming machine extracts random values for symbol determination like in a normal game, and determines symbols to be displayed at the time of stopping scrolling of the symbol arrays for the player, for a plurality of respective video reels displayed to a display. Next, the gaming machine stops scrolling so that the determined symbols are displayed for the player to rearrange the symbols. If the combination of the rearranged symbols is a combination related to winning, the gaming machine pays out coins like in a normal game.

When a combination of symbols related to a free game trigger (retrigger) is displayed in a free game, free games are added. When the number of free games becomes zero, the free games are ended and the game mode is returned to normal games.

When a combination related to a free game trigger is determined by lottery to be displayed in a normal game or a free game, the gaming machine implements a predictive effects determined depending on the positions and the number of the symbols.

The gaming machine can also provide jackpot games. In response to winning a predetermined level in a jackpot game, the gaming machine pays out coins in an amount of jackpot to the player. The jackpot refers to a function which accumulates parts of coins used by players as the amount of jackpot and, in response to winning a predetermined level in the jackpot, pays out a payout corresponding to the level. In each game, the gaming machine calculates the amount (amount for accumulation) to be accumulated to the amount of jackpot and adds it to the amount of jackpot.

The jackpot in the gaming machine of the present invention can be configured as a standalone type that is provided for the single gaming machine and accumulates parts of coins used in the gaming machine as the amount of jackpot or a network type that is shared with other gaming machines (slot machines) connected in a single or a plurality of game facilities and informs an external control device of the amounts for accumulation.

In the network type, each gaming machine inform the external control device of parts of coins used by the players as the amounts for accumulation and the external control device accumulates the amounts to the amount of jackpot to be shared by the gaming machines. When a predetermined level of the jackpot is won, the external control device provides a corresponding amount from the jackpot amount to the gaming machine.

<Determination of Effects>

The gaming machine produces effects by displaying images to the display, outputting the light from lamps, and outputting sounds from speakers. The gaming machine refers to an effect content definition table associated with a situation, such as counting a payout or counting free games, to implement effects.

[Overall Game System]

Figure 2:
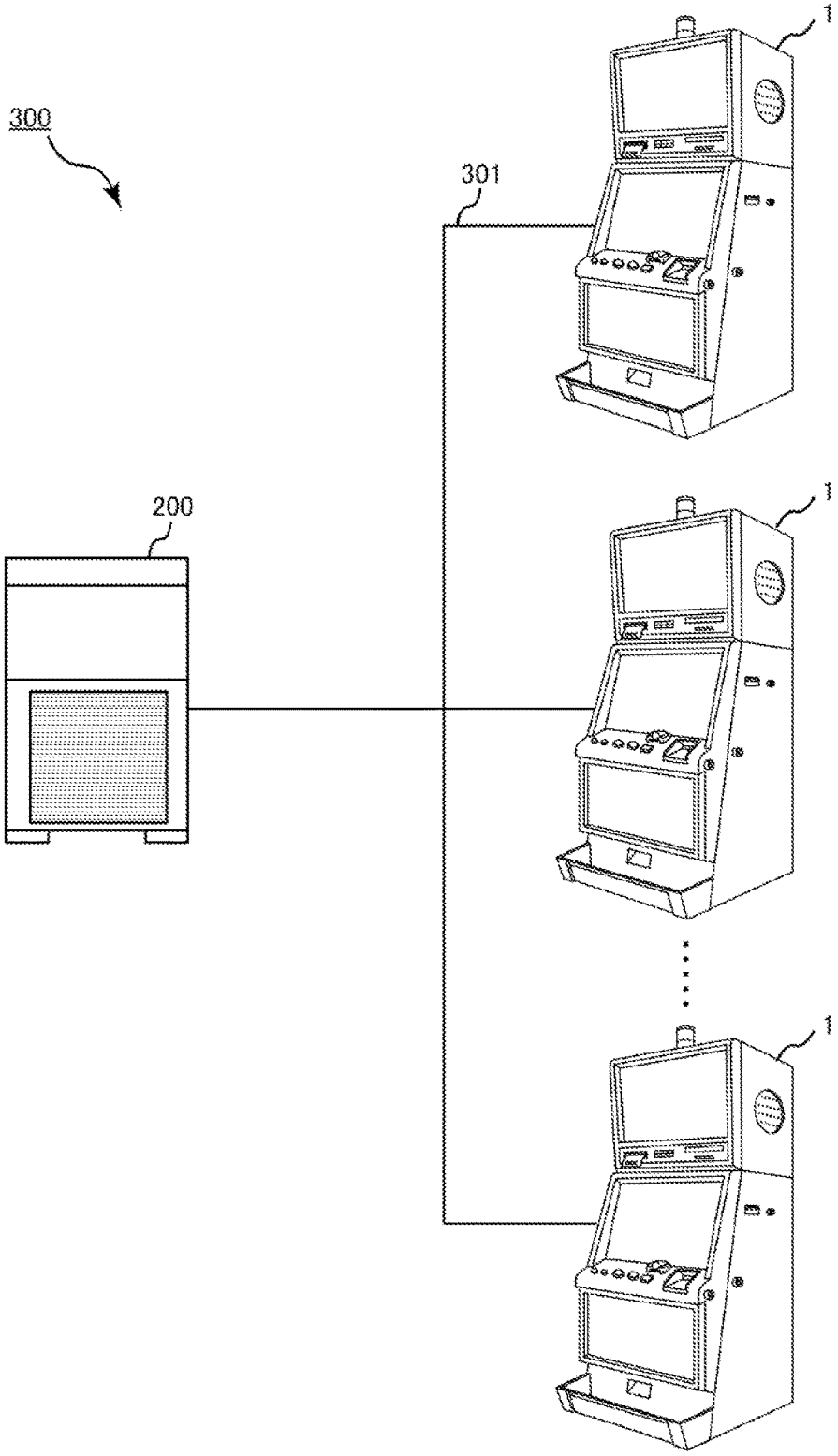
FIG. 2 is a view illustrating a game system including the gaming machine.

Next, with reference to FIG. 2, a game system including the gaming machine is described. FIG. 2 is a view illustrating the game system including the gaming machine according to the embodiment of the present invention.

A game system 300 includes a plurality of gaming machines 1, and an external control device 200 that is connected to each of the gaming machines 1 through a communication line 301.

The external control device 200 is for controlling the plurality of gaming machines 1. In the present embodiment, the external control device 200 is a so-called hall server which is installed in a game facility having the plurality of gaming machines 1. Each of the gaming machines 1 is provided with a unique identification number, and the external control device 200 identifies transmission sources of data transmitted from the respective gaming machines 1 by using the identification numbers. Also in the case where the external control device 200 transmits data to a gaming machine 1, the identification numbers are used for specifying the transmission destination.

It is to be noted that the game system 300 may be constructed within a single game facility where various games can be conducted, such as a casino, or may be constructed among a plurality of game facilities. Further, when the game system 300 is constructed in a single game facility, the game system 300 may be constructed in each floor or section of the game facility. The communication line 301 may be a wired or wireless line, and can adopt a dedicated line, an exchange line or the like.

[Overall Configuration of Gaming Machine]

Figure 3:
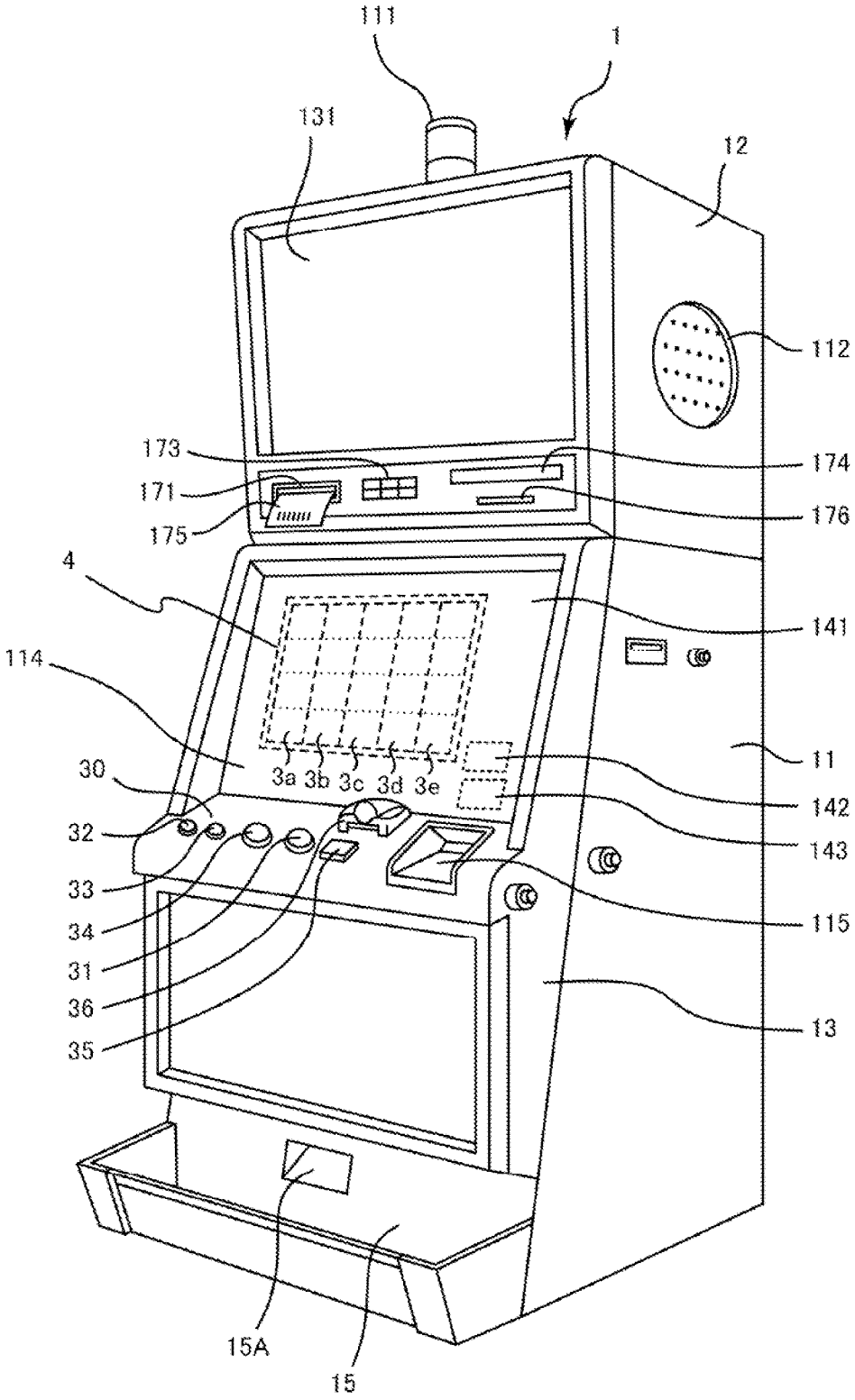
FIG. 3 is a view illustrating an overall configuration of the gaming machine.

Next, with reference to FIG. 3, an overall configuration of the gaming machine 1 is described. FIG. 3 is a view illustrating the overall configuration of the gaming machine according to the embodiment of the present invention.

A coin, a bill, or electrically valuable information corresponding to these is used as a game medium in the gaming machine 1. Further, in the present embodiment, a later-described ticket with a barcode is also used. It is to be noted that the game medium is not limited to these, and for example a medal, a token, electric money or the like can be adopted.

The gaming machine 1 includes a cabinet 11, a top box 12 installed on the upper side of the cabinet 11, and a main door 13 provided at the front face of the cabinet 11.

A lower image display panel 141 is provided at the center of the main door 13. The lower image display panel 141 includes a liquid crystal panel, and forms the display. The lower image display panel 141 has a symbol display region 4. To the symbol display region 4, five video reels 3 (3*a*, 3*b*, 3*c*, 3*d*, 3*e*) are displayed. In the present embodiment, a video reel depicts through videos the rotational and stop motions of a mechanical reel having a plurality of symbols drawn on the peripheral surface thereof. To each of the video reels 3, a symbol array comprised of a previously determined plurality of symbols is assigned (see FIGS. 4A to 7B which are described later).

In the symbol display region 4, the symbol arrays assigned to the respective video reels 3 are separately scrolled, and are stopped after predetermined time has elapsed. As a result, a part (four consecutive symbols in the present embodiment) of the symbol array corresponding to each video reel is displayed for the player. The symbol display region 4 has four regions, namely an upper region, an upper central region, a lower central region, and a lower region, for each video reel 3, and a single symbol is to be displayed to each region. That is, 20 (=5 columns×4 symbols) symbols are to be displayed in the symbol display region 4.

In the present embodiment, a line formed by selecting one of the aforementioned four regions (the upper region, the upper central region, the lower central region, and the lower region) for each of the video reels 3 and connecting the respective regions is referred to as a winning line. It is to be noted that any desired shape of the winning line can be adopted, and examples of the shape of the winning line may include a straight line formed by connecting the upper central regions for the respective video reels 3, a V-shaped line, and a bent line. Also, any desired number of lines can be adopted, and the number can be for example 50 lines. Specific examples of winning lines are described later with reference to FIG. 9B.

Further, the lower image display panel 141 has a number-of-credits display region 142 and a number-of-payouts display region 143. The number-of-credits display region 142 displays the number of coins (hereinafter also referred to as "the number of credits") owned by the player and retained inside the gaming machine 1. The number-of-payouts display region 143 displays the number of coins (hereinafter also referred to as "the number of payouts") to be paid out to the player when winning is established.

The lower image display panel 141 has a built-in touch panel 114. The player can input various commands by touching the lower image display panel 141.

On the lower side of the lower image display panel 141, there are arranged various buttons set in a control panel 30, and various devices to be operated by the player.

A SPIN button 31 is used when starting scrolling of the symbol arrays of the respective video reels 3. A CHANGE button 32 is used when requesting a game facility staff member to exchange money. A CASHOUT button 33 is used when paying out the coins retained inside the gaming machine 1 to a coin tray 15.

A 1-BET button 34 and a maximum BET button 35 are used for determining the number of coins (hereinafter also referred to as "the number of BETs") to be used in the game from the coins retained inside the gaming machine 1. The 1-BET button 34 is used when determining one coin at a time for the aforementioned number of BETs. The maximum BET button 35 is used when setting the aforementioned number of BETs to a defined upper limit number.

A coin accepting slot 36 is provided to accept coins. A bill validator 115 is provided to accept bills. The bill validator 115 validates a bill, and accepts a valid bill into the cabinet 11. It is to be noted that the bill validator 115 may be configured so as to be capable of reading a later-described ticket 175 with a barcode.

An upper image display panel 131 is provided at the front face of the top box 12. The upper image display panel 131 includes a liquid crystal panel, and forms the display. The upper image display panel 131 displays images related to effects and a later-described WIN sign related to free games (indicator informing the player of winning and gained credits with effects) as well as images showing introduction of the game contents and explanation of the game rules. Further, the top box 12 is provided with a speaker 112 and a lamp 111. The gaming machine 1 produces effects by displaying images on the lower image display panel 141 or the upper image display panel 131, outputting sounds, and outputting the light.

A ticket printer 171, a card slot 176, a data display 174, and a keypad 173 are provided on the lower side of the upper image display panel 131.

The ticket printer 171 prints on a ticket a barcode representing encoded data of the number of credits, date, the identification number of the gaming machine 1, and the like, and outputs the ticket as the ticket 175 with a barcode. The player can make a gaming machine read the ticket 175 with a barcode so as to play a game thereon, and can also exchange the ticket 175 with a barcode with a bill or the like at a predetermined place (e.g. a cashier in a casino) in the game facility.

The card slot 176 is for inserting a card in which predetermined data is stored. For example, the card stores data for identifying the player, and data about the history of games played by the player. When the card is inserted into the card slot 176, a later-described card reader 172 reads data from the card or writes data into the card. It is to be noted that the card may store data corresponding to a coin, a bill or a credit.

The data display 174 includes a fluorescent display, LEDs and the like, and displays the data read by the card reader 172 or the data inputted by the player via the keypad 173, for example. The keypad 173 is for inputting a command and data related to ticket issuance or the like.

The gaming machine according to the present embodiment controls the rendering of video reels on the display; however, the gaming machine may be a type of gaming machine in which a stepping motor drives mechanical reels to show symbols to the player. Although this description provides a gaming machine 1 configured as above in order to explain the technical idea of the present invention, the configuration of the gaming machine 1 is not limited to this. The present invention can be implemented in various gaming machines having different configurations.

[Symbol Arrays of Video Reels]

Next, with reference to FIGS. 4A to 7B, configurations of the symbol arrays on the video reels 3 of the gaming machine 1 are described. FIGS. 4A to 5B constitute a view illustrating arrangement of symbols for normal games that are drawn on the peripheral surfaces of the reels of the gaming machine according to the embodiment of the present invention. FIGS. 6A to 7B constitute a view illustrating arrangement of symbols for free games that are drawn on the peripheral surfaces of the reels of the gaming machine according to the embodiment of the present invention.

The symbol arrays for normal games are obtained by combining the symbol arrays shown in FIGS. 4A to 5B. That is to say, the first reel (the first video reel 3*a*) is assigned a symbol array consisting of 100 symbols of code numbers=0 to 99; the second reel (the second video reel 3*b*) is assigned a symbol array consisting of 132 symbols of code numbers=0 to 131; the third reel (the third video reel 3*c*) is assigned a symbol array consisting of 134 symbols of code numbers=0 to 133; the fourth reel (the fourth video reel 3*d*) is assigned a symbol array consisting of 134 symbols of code numbers=0 to 133; and the fifth reel (the fifth video reel 3*e*) is assigned a symbol array consisting of 131 symbols of code numbers=0 to 130.

Provided types of the symbols are WILD, BLACK, RED, BLUE, PINK, GREEN, ACE, KING, QUEEN, JACK, TEN, NINE, and FEATURE; icons corresponding to these are displayed on the video reels. In the present embodiment, the WILD symbols function as wild cards, so that they are substitute symbols in completing winning lines; the BLACK symbols are top symbols for providing the highest payout. The FEATURE symbols (hereinafter, referred to as feature symbols) are independent from winning lines; if a predetermined number of feature symbols appear in a symbol display region 4 composed of 20 symbols of 5 columns×4 symbols, a payout associated with the number of feature symbols in the symbol display region 4 is provided to the player.

The gaming machine according to the embodiment of the present invention switches the symbol arrays to be displayed on the video reels between normal games and free games. The symbol array for free games is obtained by combining the symbol arrays shown in FIGS. 6A to 7B. That is to say, the first reel (the first video reel 3*a*) is assigned a symbol array consisting of 110 symbols of code numbers=0 to 109; the second reel (the second video reel 3*b*) is assigned a symbol array consisting of 142 symbols of code numbers=0 to 141; the third reel (the third video reel 3*c*) is assigned a symbol array consisting of 144 symbols of code numbers=0 to 143; the fourth reel (the fourth video reel 3*d*) is assigned a symbol array consisting of 144 symbols of code numbers=0 to 143; and the fifth reel (the fifth video reel 3*e*) is assigned a symbol array consisting of 141 symbols of code numbers=0 to 140.

The symbol arrays for free games illustrated in FIGS. 6A to 7B show arrangements different from the symbol arrays for normal games; each of the symbol arrays of the video reels is configured to include ten more BLACK symbols of the top symbols compared to the symbol array for normal games. Specifically, the first to the fifth reels each have 16 BLACK symbols in the symbol array for normal games. In contrast, in the symbol array for free games, the first to the fifth reels each have 26 BLACK symbols.

Although the configurations of the symbol arrays of the video reels 3 in the gaming machine 1 have been described with reference to FIGS. 4A to 7B, these configurations are merely examples. The symbol arrays for normal games and the symbol arrays for free games can be configured differently from the patterns of the above-described examples.

[Configuration of Circuit Included in Gaming Machine]

Figure 8:
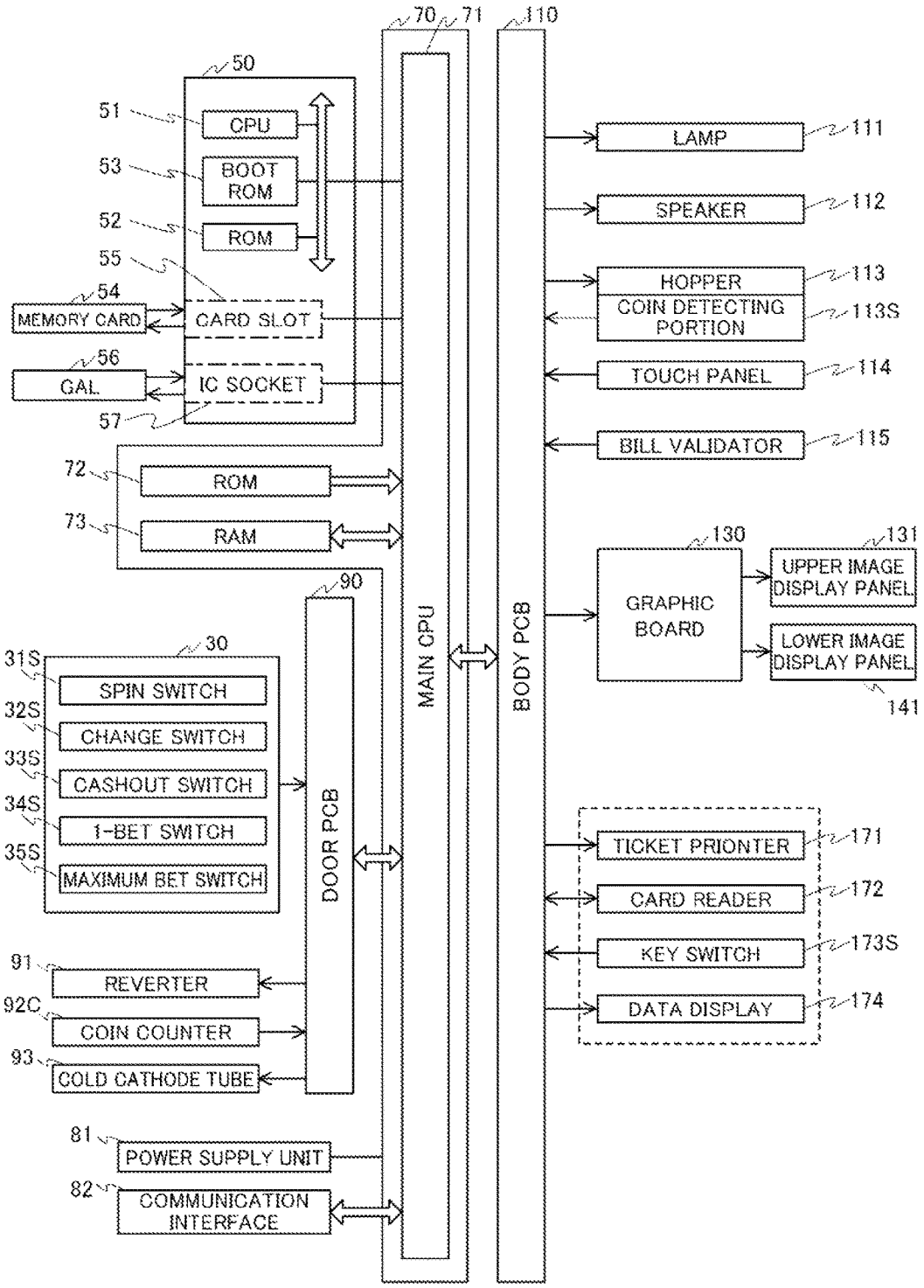
FIG. 8 is a block diagram illustrating an internal configuration of the gaming machine.

Next, with reference to FIG. 8, a configuration of a circuit included in the gaming machine 1 is described. FIG. 8 is a block diagram illustrating an internal configuration of the gaming machine according to the embodiment of the present invention.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a game system program. The game program includes a program related to game progression, a lottery program, and a program for producing effects by images and sounds (e.g. see FIGS. 15 to 24 which are described later). Further, the aforementioned game program includes data (see FIGS. 4A to 7B) specifying the configuration of the symbol array assigned to each video reel 3.

The lottery program is a program for determining to-be stopped symbol of each video reel 3 by lottery. The to-be stopped symbol is data for determining four symbols to be displayed to the symbol display region 4 out of the plurality of symbols forming each symbol array. The gaming machine 1 of the present embodiment determines as the to-be stopped symbol the symbol to be displayed in a predetermined region (e.g. the upper region) out of the four regions provided for each of the video reels 3 of the symbol display region 4.

The aforementioned lottery program includes symbol determination data. The symbol determination data is data that specifies random values so that each of the symbols forming the symbol array is determined at an equal probability, for each video reel 3. The probabilities of the symbols being determined are basically equal. However, the numbers of the respective types of symbols included in the symbols vary as illustrated in FIGS. 4A to 7B, and thus the probabilities of the respective types of symbols being determined vary (i.e. different weights on the probabilities are generated). For example, with reference to FIGS. 4A to 5B, the symbol array of the first reel (first video reel 3*a*) includes four symbols of "ACE", and includes eight symbols of "BLUE". Hence, the former is determined at the probability of "4/100", whereas the latter is determined at the probability of "8/100". Alternatively, different winning probabilities can be set depending on the type, combination, or location (code numbers) of the symbols.

It is to be noted that, although the data specifies that the different numbers of symbols be provided to form the symbol arrays of the respective video reels 3 in the present embodiment, the equal numbers of symbols may form the respective video reels 3. For example, the symbol array of the first reel (first video reel 3*a*) to the fifth reel (fifth video reel 3*e*) may each consist of 120 symbols.

Further, the card slot 55 is configured so that the memory card 54 can be inserted thereinto and removed therefrom, and is connected to a motherboard 70 by an IDE bus.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the gaming machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like. The authentication program is a program (tamper check program) for authenticating the game program and the game system program. The pre-authentication program is a program for authenticating the aforementioned authentication program. The authentication program and the pre-authentication program are written along a procedure (authentication procedure) for proving that the program to be the subject has not been tampered.

The motherboard 70 is provided with a main CPU 71, a ROM 72, a RAM 73, and a communication interface 82.

The ROM 72 includes a memory device such as a flash memory, and stores a program such as BIOS to be executed by the main CPU 71, and permanent data. When the BIOS is executed by the main CPU 71, processing for initializing predetermined peripheral devices is conducted; further, through the gaming board 50, processing of loading the game program and the game system program stored in the memory card 54 is started.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations in execution of these programs. Examples of the areas include: an area that stores the number of games, the number of BETs, the number of payouts, the number of credits and the like; and an area that stores symbols (code numbers) determined by lottery.

The communication interface 82 is for communicating with the external control device 200 such as a server, through the communication line 301. Further, the motherboard 70 is connected with a later-described door PCB (Printed Circuit Board) 90 and a body PCB 110 by respective USBs. The motherboard 70 is also connected with a power supply unit 81. When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

The control panel 30 is provided with a spin switch 31S, a change switch 32S, a CASHOUT switch 33S, a 1-BET switch 34S and a maximum BET switch 35S which correspond to the aforementioned respective buttons. Each of the switches outputs a signal to the main CPU 71 upon detection of press of the button corresponding thereto by the player.

The coin counter 92C validates a coin inserted into the coin accepting slot 36 based on its material, shape and the like, and outputs a signal to the main CPU 71 upon detection of a valid coin. Invalid coins are discharged from a coin payout exit 15A.

The reverter 91 operates based on a control signal outputted from the main CPU 71, and distributes valid coins validated by the coin counter 92C into a hopper 113 or a cash box (not illustrated). That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the upper image display panel 131 and the lower image display panel 141, and lights up based on a control signal outputted from the main CPU 71.

The body PCB 110 is connected with the lamp 111, the speaker 112, the hopper 113, a coin detecting portion 113S, the touch panel 114, the bill validator 115, a graphic board 130, the ticket printer 171, the card reader 172, a key switch 173S and the data display 174.

The lamp 111 lights up based on a control signal outputted from the main CPU 71. The speaker 112 outputs sounds such as SE (Sound Effect) and BGM, based on a control signal outputted from the main CPU 71.

The hopper 113 operates based on a control signal outputted from the main CPU 71, and pays out coins of the specific number of payouts from the coin payout exit 15A to the coin tray 15. The coin detecting portion 113S outputs a signal to the main CPU 71 upon detection of coins paid out by the hopper 113.

The touch panel 114 detects a place on the lower image display panel touched by the player's finger or the like, and outputs to the main CPU 71 a signal corresponding to the detected place. In similar, the upper image display panel 131 can also be provided with a touch panel. Upon acceptance of a valid bill, the bill validator 115 outputs to the main CPU 71 a signal corresponding to the face amount of the bill.

The graphic board 130 controls display of images conducted by the respective upper image display panel 131 and lower image display panel 141, based on a control signal outputted from the main CPU 71. The symbol display region 4 of the lower image display panel 141 displays the five video reels 3 by which the scrolling and stop motions of the symbol arrays included in the respective video reels 3 are displayed. The number-of-credits display region 142 of the lower image display panel 141 displays the number of credits stored in the RAM 73. The number-of-payouts display region 143 of the lower image display panel 141 displays the number of payouts of coins.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

Based on a control signal outputted from the main CPU 71, the ticket printer 171 prints on a ticket a barcode representing encoded data of the number of credits stored in the RAM 73, date, the identification number of the gaming machine 1, and the like, and then outputs the ticket as the ticket 175 with a barcode.

The card reader 172 reads data stored in a card inserted into the card slot 176 and transmits the data to the main CPU 71, or writes data into the card based on a control signal outputted from the main CPU 71.

The key switch 173S is provided in the keypad 173, and outputs a predetermined signal to the main CPU 71 when the keypad 173 has been operated by the player.

The data display 174 displays data read by the card reader 172 and data inputted by the player through the keypad 173, based on a control signal outputted from the main CPU 71.

[Patterns of Winning Lines]

Next, winning lines in free games are described with reference to FIG. 9A. FIG. 9A shows a winning line of Pattern 1; this winning line connects the first row of the first reel (first video reel 3*a*), the first row of the second reel (second video reel 3*b*), the first row of the third reel (third video reel 3*c*), the first row of the fourth reel (fourth video reel 3*d*), and the first row of the fifth reel (fifth video reel 3*e*).

Denoting the first row of each reel as "0", the second row as "1", the third row as "2", and the fourth row as "3", the 50 lines defined in the present embodiment are as indicated in the winning line definition table in FIG. 9B. For example, Pattern 1 shown in FIG. 9A is denoted by all "0" for the first to the fifth reels. Pattern 2 is denoted by "0" for the first to the third and the fifth reels and "1" for the fourth reel.

Although this section describes the winning line definition table for free games, winning lines for normal games are likewise defined. The patterns and the number of patterns of winning lines can be defined differently from those of free games.

[Configurations of Payout Tables]

Next, with reference to FIG. 10A, a payout table defining line payouts in free games is described. In the present embodiment, a payout is determined by how many symbols of the same type appear on one of the lines defined by the winning line definition table in FIG. 9B. The determined payout is multiplied by the number of BETs designated by the player and the result is added to the payout counter as the number of payouts.

For example, if two BLACK symbols appear on one of the winning lines, a win is determined and the payout is "2". If five BLACK symbols, a win with a payout of "50" is determined. Two BLACK symbols and three RED symbols may appear on one winning line. In this case, two wins are simultaneously determined for the winning line; the payout should be "12", which is the sum of the payouts of these wins.

As described above, determination of wins is made about a single winning line and the same determination is made about the 50 winning lines defined in a symbol display region 4 composed of 20 symbols of 5 columns by 4 symbols. Accordingly, one winning line may provide multiple wins and further, multiple winning lines may each provide one or more wins.

Although this section describes a payout table for line payouts and winning determination in free games, the same winning determination is made in normal games. The payout table and the winning determination in normal games can be defined differently from those in free games.

Next, with reference to FIG. 10B, a payout table defining bonus payouts in free games is described. In the present embodiment, a payout is determined in accordance with the number of feature symbols and the payout table in FIG. 10B. The payout is determined depending on the number of feature symbols, independent from the winning lines defined in the winning line definition table in FIG. 9B. The payout determined in this way is multiplied by the number of BETs designated by the player and the result is added to the payout counter.

For example, if three feature symbols appear, the payout is "1". If ten feature symbols, the payout is "2". However, the present embodiment requires appearance of the feature symbols on at least the first, the second, and the third reels together to provide a payout. Accordingly, for example, if nine feature symbols appear but no feature symbol appears on the third reel, the payout is "0".

Although this section describes a payout table for bonus payouts and winning determination in free games, the same winning determination is made in normal games. The payout table and the winning determination in normal games can be defined differently from those in free games.

[Configuration of Symbol Definition Table]

Next, with reference to FIG. 10C, a symbol definition table defining graphic display of symbols in normal games and free games. In the present embodiment, each symbol displayed on the symbol array of each video reel 3 is displayed in accordance with the associated graphic display file defined in the symbol definition table. For example, for a BLACK symbol, the graphic display file named "black" is used to display the symbol as defined in this graphic display file. For a JACK symbol, the graphic display file named "J" is used to display a symbol shaped a letter of "J". The data defined as a graphic display file for a symbol specifies the name of image data to be used to display the symbol or the name of a folder storing the image data. A symbol may be displayed as a motion picture (animation), not only a still picture.

[Configuration of Predictive Effects Lottery Table]

Next, with reference to FIG. 11A, a predictive effects lottery table is described. The predictive effects lottery table is used to determine predictive effects to be implemented in normal games and free games. In the present embodiment, one predictive effects lottery table (one of Table A to Table F) is determined depending on the positions and the number of symbols to appear determined by lottery. Each predictive effects lottery table defines which predictive effects are implemented at which probabilities. FIG. 11A shows Table A to Table F of predictive effects lottery tables all together. A predictive effects lottery table is determined depending on, for example, whether the feature symbols appear on at least the first, the second, and the third reels (whether a free game trigger is established). In FIG. 11A, the column of "No." and the row of "TOTAL" are provided for convenience of explanation.

For example, when Table B is determined for the predictive effects lottery table, Prediction 4 is selected at 20% probability and No effects is selected at 80% probability as the predictive effects to be implemented. When Table E is determined for the predictive effects lottery table, Prediction 1 is selected at 15% probability; Prediction 3 is selected at 15% probability; and No effects is selected at 70% probability as the predictive effects to be implemented.

FIG. 11B illustrates the specifics of the predictive effects defined in the predictive effects lottery table in FIG. 11A. The effects of Prediction 1 show an image of a small diamond for a predetermined time before start of scrolling the symbol arrays in the symbol display region 4 of the gaming machine 1. The effects of Prediction 2 show the following phases in the symbol display region 4 of the gaming machine 1. An image of a small diamond appears for a predetermined time before start of scrolling of the symbol arrays; the symbol arrays are scrolled and then stopped; an image of a big diamond appears for a predetermined time; and the reels showing feature symbols are nudged (the video reels are rotated upward or downward by some symbols). This performance is called nudge performance.

The effects of Prediction 3 show the symbol arrays scrolling in a reverse direction and then stopped in the symbol display region 4 of the gaming machine 1. The effects of Prediction 4 show a motion picture of a small group of animals moving across the symbol display region 4 when the symbol arrays are being scrolled in the symbol display region 4 of the gaming machine 1. The effects of Prediction 5 show a motion picture of a large group of animals moving across the symbol display region 4 when the symbol arrays are being scrolled in the symbol display region 4 of the gaming machine 1.

The present embodiment implements such predetermined predictive effects to the symbol display region 4 of the gaming machine 1; accordingly, the player can feel a prediction of start of free games to have an expectation for free games. Further, even if the numbers of feature symbols are the same, different predictive effects can be implemented depending on the predictive effects lottery table, as described above. Accordingly, the player cannot predict the result of a game from the performance in the predictive effects. As a result, more variations are provided to the effects of games to increase the player's expectation and interest.

[Configuration of Order Management Table]

Next, with reference to FIG. 12A, an order management table is described. When a free game trigger is established in a normal game, number-of-free-games determination processing is performed to start free games; the processing determines the number of free games for each feature symbol displayed in the symbol display region 4 of the gaming machine 1. The effects implemented in this processing are that each number of free games is serially added to increment the number of free games. The order management table defines the order of feature symbols to add free games.

In the present embodiment, addition is conducted from the upper region (the first row) of the first reel, the upper central region (the second row) of the first reel, the lower central region (the third row) of the first reel, and the lower region (the fourth row) of the first reel in this order. Subsequently, addition is conducted from the upper region to the lower region of the second reel, from the upper region to the lower region of the third reel, from the upper region to the lower region of the fourth reel, and from the upper region to the lower region of the fifth reel in this order. If no feature symbol appears at the corresponding place, the addition at the place is skipped.

The order management table is also referred to in number-of-additional-free-games determination processing, which is performed to add free games when a free game trigger (retrigger) is established in a free game. The order management table for this event may be defined differently from the order management table referred to when a free game trigger is established in a normal game.

[Configuration of Spin Table Lottery Table for Number-of-Free-Games Lottery]

Next, with reference to FIG. 12B, a spin table lottery table for number-of-free-games lottery is described. To start free games when a free game trigger is established in a normal game, the number of free games is determined by lottery from 1, 2, 3, 5, 7, and 10 for each of the feature symbols. The spin table lottery table for number-of-free-games lottery determines a spin table to be used with a lottery weight which depends on the number of free games determined as described above. The spin tables are tables defining the specifics of the effects, such as indicating the determined number of free games at the place the corresponding feature symbol appears. In FIG. 12B, the row of TOTAL in the spin table lottery table for number-of-free-games lottery is provided for convenience of explanation.

For example, when the number of free games corresponding to a feature symbol is determined to be "1", Table 1 is used at 80% probability and Table 3 is used at 20% probability as the spin table. When the number of free games corresponding to a feature symbol is determined to be "7", Table 5 is used as the spin table at 100% probability.

The spin table lottery table for number-of-free-games lottery is also referred to in adding free games when a free game trigger (retrigger) is established in a free game. The spin table lottery table for number-of-free-games lottery for this event may be defined differently from the table to be referred to in normal games.

[Configuration of Incrementing Speed Management Table]

Next, with reference to FIG. 13A, an incrementing speed management table is described. In number-of-free-games determination processing performed to start free games in response to establishment of a free game trigger in a normal game, the number of free games is determined for each of the feature symbols displayed in the symbol display region 4 of the gaming machine 1. The effects implemented in this processing are that each number of free games is serially added to increment the number of free games. The incrementing speed management table defines the speeds in incrementing the number of free games. Although FIG. 13A includes a column of total times of the incrementing for convenience of explanation, this column is optional.

For example, the incrementing speed management table in FIG. 13A defines the incrementing speed per game as 8 frames (approximately 0.13 seconds) when the number of free games is determined to be any of 1, 2, 3, 5, 7, and 10 for a feature symbol. That is to say, the incrementing speed in adding free games one by one is constant. Accordingly, if ten free games are determined for a feature symbol, the first increment adds one free game in the first 0.13 seconds and the second increment adds one free game in the next 0.13 seconds, so that counting ten free games takes approximately 1.33 seconds.

The incrementing speed management table is also referred to in adding free games when a free game trigger (retrigger) is established in a free game. The incrementing speed management table for this event may be defined differently from the table to be referred to in normal games.

[Incrementing Sound Control Table]

Next, with reference to FIG. 13B, an incrementing sound control table is described. In number-of-free-games determination processing performed to start free games in response to establishment of a free game trigger in a normal game, the number of free games is determined for each of the feature symbols displayed in the symbol display region 4 of the gaming machine 1. The effects implemented in this processing are that each number of free games is serially added to increment the number of free games. The incrementing sound control table defines the sounds to be outputted in incrementing the number of free games.

For example, the incrementing sound control table in FIG. 13B defines to use File A as the sound effect file when the number of free games being incremented indicates 0 to 9, to use File B as the sound effect file when the number of free games being incremented indicates 10 to 19, to use File C as the sound effect file when the number of free games being incremented indicates 20 to 49, to use File D as the sound effect file when the number of free games being incremented indicates 50 to 99, and to use File E as the sound effect file when the number of free games being incremented indicates 100 to 200.

The incrementing sound control table is also referred to in adding free games when a free game trigger (retrigger) is established in a free game. The incrementing sound control table for this event may be defined differently from the table to be referred to in normal games.

[Game Flow]

Figure 14:
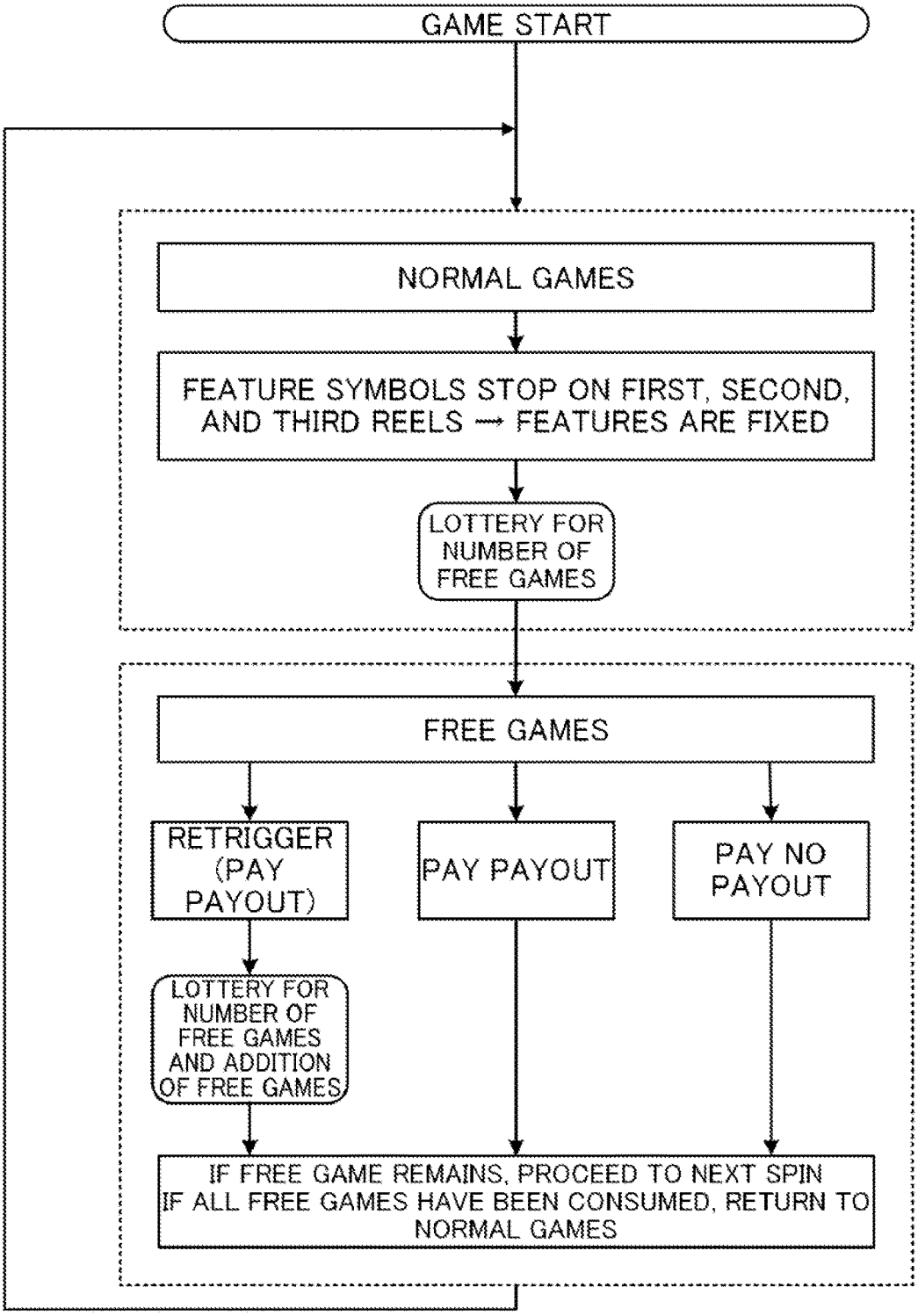
FIG. 14 is a view illustrating transitions between normal games and free games in the gaming machine.

Next, with reference to FIG. 14, a game flow provided by the gaming machine according to the present embodiment is described. When the player starts playing games by putting a coin, pressing a selected BET button, and then pressing the SPIN button, a normal game is started. In a normal game, symbols are determined in response to the press of the SPIN button by the player and scrolling of the symbol arrays is stopped to display the determined symbols for the player.

In a normal game, symbol arrays for normal games are set to the video reels 3. For example, images corresponding to BLACK symbols, RED symbols, BLUE symbols, PINK symbols, GREEN symbols, ACE symbols, KING symbols, QUEEN symbols, JACK symbols, TEN symbols, NINE symbols, and feature symbols are displayed.

When feature symbols are stopped on the first, the second, and the third reels in the display, features are fixed so that free games are started. In the free games, symbol arrays for free games are used. In the present embodiment, the symbol array of each reel includes more symbols than the symbol array for normal games; BLACK symbols of top symbols are increased compared to those for normal games.

In this phase, a lottery for the number of free games is conducted. During the free games, the player can play free games as many as determined by the lottery without newly inserting a coin (without consuming credits). In a free game, payouts are determined depending on the stopped symbols and the winning lines and payouts for the winning pattern are calculated based on the determined payout and the number of BETs, like in a normal game.

When feature symbols are stopped on the first, the second, and the third reels during the free games (a retrigger is established), free games are added. The number of free games to be added is also determined by lottery. The free games are ended when the number of remaining free games becomes zero and the game mode returns to normal games.

[Contents of Program]

Next, with reference to FIGS. 15 to 24, the program to be executed by the gaming machine 1 is described.

<Main Control Processing>

Figure 15:
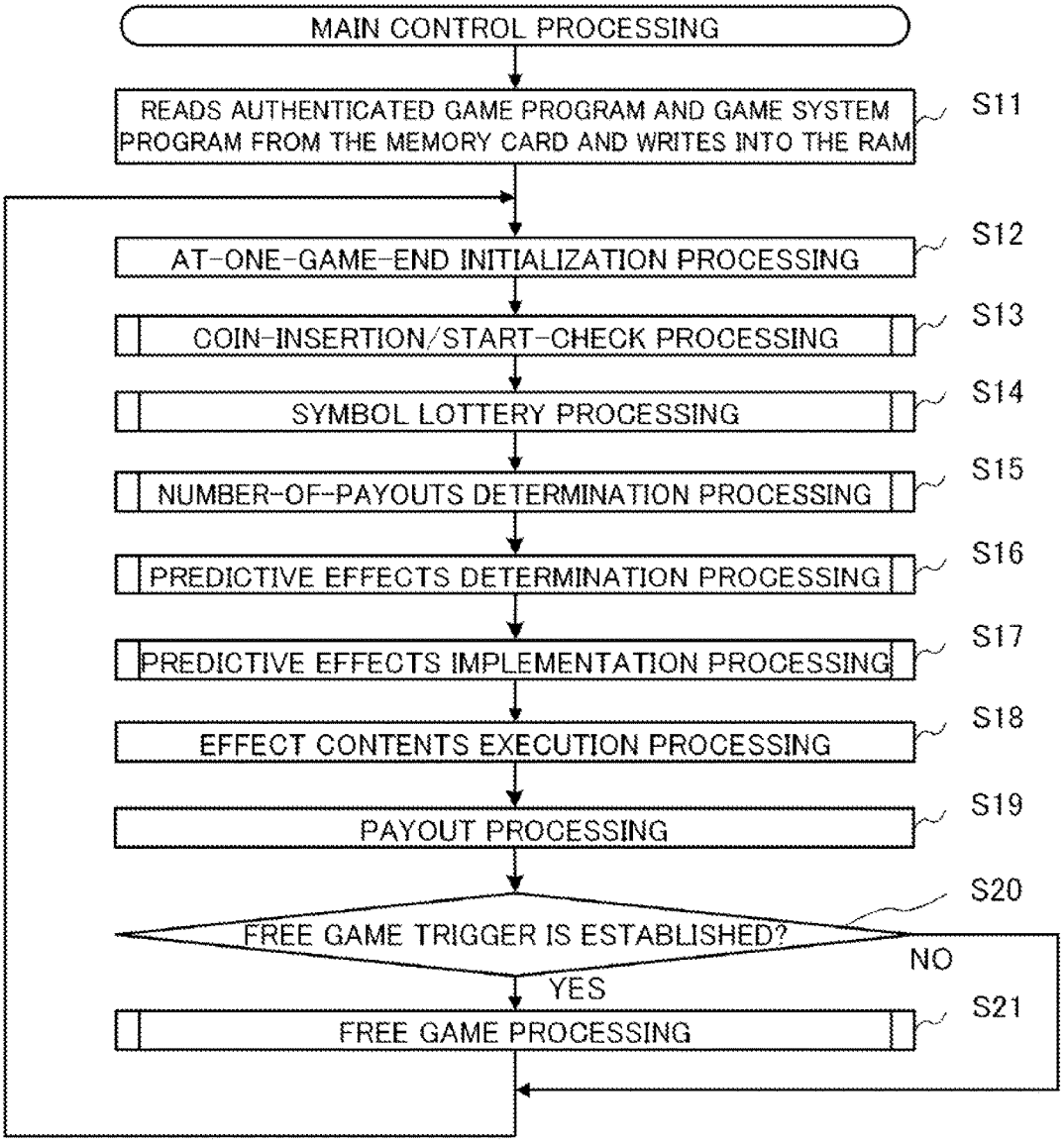
FIG. 15 is a view illustrating a flowchart of main control processing for the gaming machine.

First, with reference to FIG. 15, main control processing is described. FIG. 15 is a view illustrating a flowchart of the main control processing for the gaming machine according to the embodiment of the present invention.

First, when the power is supplied to the gaming machine 1, the main CPU 71 reads the authenticated game program and game system program from the memory card 54 through the gaming board 50, and writes the programs into the RAM 73 (step S11).

Next, the main CPU 71 conducts at-one-game-end initialization processing (step S12). For example, data that becomes unnecessary after each game in the working areas of the RAM 73, such as the number of BETs and the symbols determined by lottery, is cleared.

The main CPU 71 conducts coin-insertion/start-check processing which is described later with reference to FIG. 16 (step S13). In the processing, input from the BET switch and the spin switch is checked.

The main CPU 71 then conducts symbol lottery processing which is described later with reference to FIG. 18 (step S14). In the processing, to-be stopped symbols are determined based on the random values for symbol determination.

Next, the main CPU 71 conducts number-of-payouts determination processing which is described later with reference to FIG. 19 (step S15). In the processing, a line payout is determined based on the number of symbols displayed along each winning line and the payout table; a bonus payout is determined based on the number of feature symbols and the payout table; and the number of payouts is determined based on these payouts and stored into a number-of-payouts storage area provided in the RAM 73.

Next, the main CPU 71 conducts predictive effects determination processing which is described later with reference to FIG. 20 (step S16). In the processing, one of the predictive effects lottery tables (Tables A to F) is determined based on the positions and the number of feature symbols appearing in the symbol display region 4 and predictive effects are determined based on the determined predictive effects lottery table.

Next, the main CPU 71 conducts predictive effects implementation processing which is described later with reference to FIG. 21 (step S17). The main CPU 71 implements predictive effects including symbol display control with reference to the spin table for implementing the predictive effects determined in the predictive effects determination processing and other information.

The main CPU 71 then conducts payout effects implementation processing (step S18). The main CPU 71 implements effects counting a payout on each winning line and further implements effects to a WIN sign depending on the payout.

The main CPU 71 conducts payout processing (step S19). The main CPU 71 adds the value stored in the number-of-payouts storage area to a value stored in a number-of-credits storage area provided in the RAM 73. It is to be noted that operations of the hopper 113 may be controlled based on input from the CASHOUT switch 33S, and coins of the number corresponding to the value stored in the number-of-payouts storage area may be discharged from the coin payout exit 15A. Further, operations of the ticket printer 171 may be controlled and a ticket with a barcode may be issued on which a value stored in the number-of-payouts storage area is recorded.

Next, the main CPU 71 determines whether a free game trigger is established (step S20). When determining that a free game trigger is established (for example, when feature symbols are stopped on the first, the second, and the third reels in the display), the main CPU 71 executes free game processing which is described later with reference to FIG. 22 (step S21).

<Coin-Insertion/Start-Check Processing>

Figure 16:
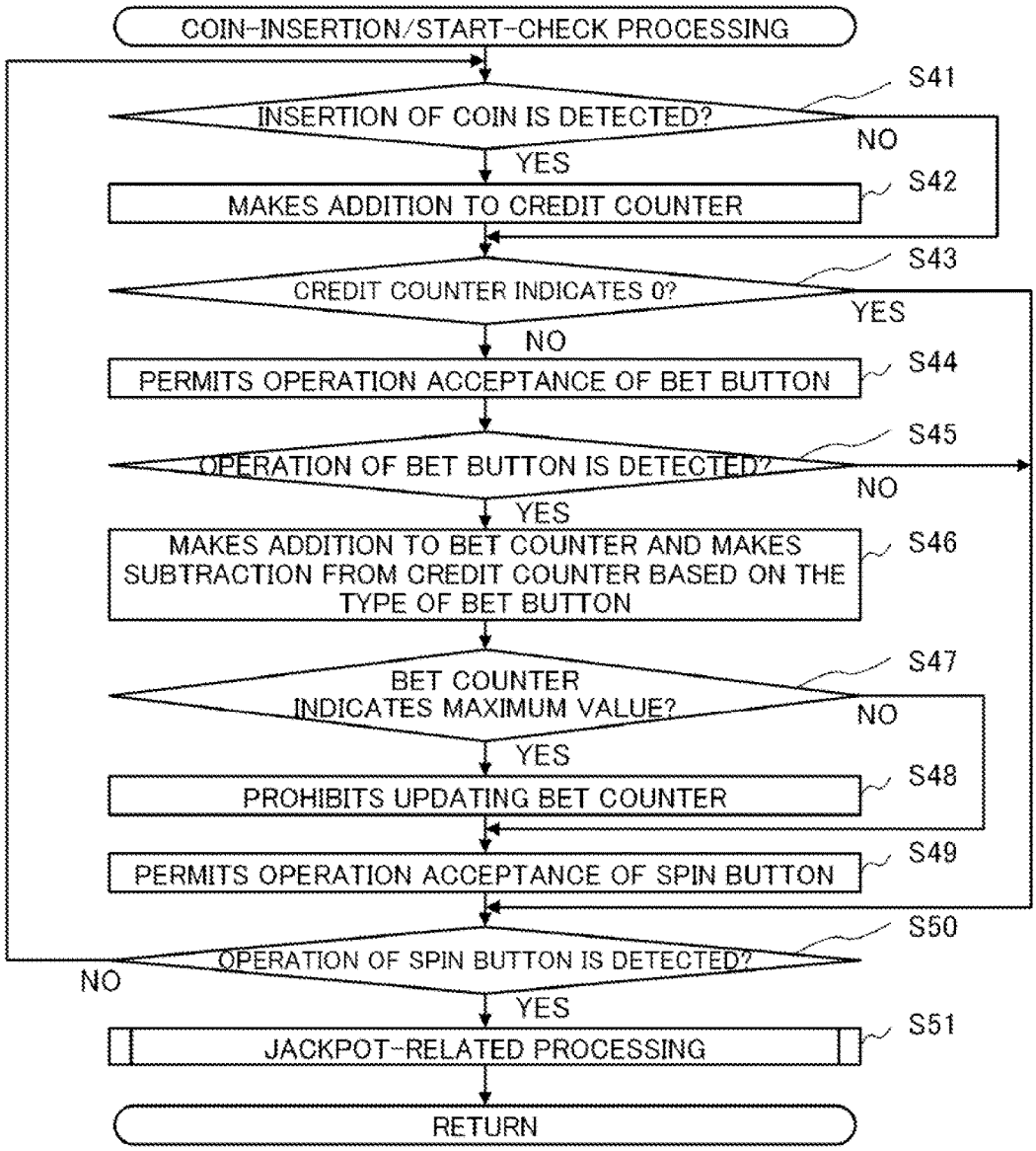
FIG. 16 is a view illustrating a flowchart of coin-insertion/start-check processing for the gaming machine.

Next, with reference to FIG. 16, coin-insertion/start-check processing is described. FIG. 16 is a view illustrating a flowchart of the coin-insertion/start-check processing for the gaming machine according to the embodiment of the present invention.

First, the main CPU 71 determines whether or not insertion of a coin has been detected by the coin counter 92C (step S41). When determining that the insertion of a coin has been detected, the main CPU 71 makes an addition to the value stored in the number-of-credits storage area (the credit counter) (step S42). It is to be noted that, in addition to the insertion of a coin, the main CPU 71 may determine whether or not insertion of a bill has been detected by the bill validator 115, and when determining that the insertion of a bill has been detected, the main CPU 71 may add a value according to the bill to the value stored in the number-of-credits storage area.

After step S42 or when determining in step S41 that the insertion of a coin has not been detected, the main CPU 71 determines whether or not the value stored in the number-of-credits storage area is zero (step S43). When the main CPU 71 determines that the value stored in the number-of-credits storage area is not zero, the main CPU 71 permits operation acceptance of the BET buttons (step S44).

Next, the main CPU 71 determines whether or not operation of any of the BET buttons has been detected (step S45). When the main CPU 71 determines that the BET switch has detected press of the BET button by the player, the main CPU 71 makes an addition to a value stored in a number-of-BETs storage area provided in the RAM 73 and makes a subtraction from the value stored in the number-of-credits storage area, based on the type of the BET button (step S46).

The main CPU 71 then determines whether or not the value stored in the number-of-BETs storage area is at its maximum (step S47). When the main CPU 71 determines that the value stored in the number-of-BETs storage area is at its maximum, the main CPU 71 prohibits updating of the value stored in the number-of-BETs storage area (step S48). After step S48 or when determining in step S47 that the value stored in the number-of-BETs storage area is not at its maximum, the main CPU 71 permits operation acceptance of the SPIN button (step S49).

After step S49 or when determining in step S45 that the operation of any of the BET buttons has not been detected, or when determining in step S43 that the value stored in the number-of-credits storage area is zero, the main CPU 71 determines whether or not operation of the SPIN button has been detected (step S50). When the main CPU 71 determines that the operation of the SPIN button has not been detected, the processing is shifted to step S41.

When the main CPU 71 determines that the operation of the SPIN button has been detected, the main CPU 71 conducts jackpot-related processing which is described later with reference to FIG. 17 (step S51). In the processing, the amount to be accumulated to the amount of jackpot (the amount for accumulation) is calculated; the amount for accumulation is added to the amount of jackpot; and the sum is stored in the jackpot amount storage area. After the processing has been conducted, the coin-insertion/start-check processing is completed.

<Jackpot-Related Processing>

Figure 17:
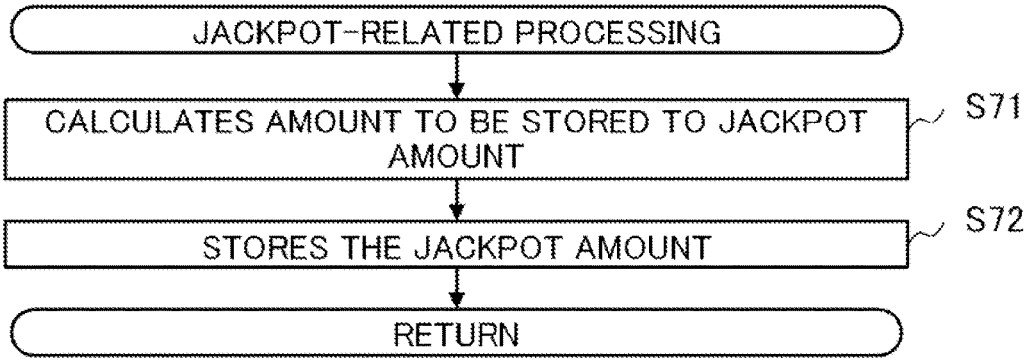
FIG. 17 is a view illustrating a flowchart of jackpot-related processing for the gaming machine.

Now, with reference to FIG. 17, the jackpot-related processing is described. FIG. 17 is a view illustrating a flowchart of the jackpot-related processing for the gaming machine according to the embodiment of the present invention.

First, the main CPU 71 calculates the amount to be stored to the amount of jackpot (step S71). The main CPU 71 obtains the product of the value stored in the number-of-BETs storage area and a preset accumulation ratio, so that the amount to be stored to the amount of jackpot is calculated.

Next, the main CPU 71 sums the amount to be stored and the amount of jackpot and stores the sum in the jackpot amount storage area (step S72). After the processing has been conducted, the jackpot-related processing is completed. If the jackpot is a network type, the main CPU 71 transmits the amount to be stored to the amount of jackpot to the external control device 200; upon reception of the amount to be stored to the amount of jackpot, the external control device 200 updates the amount of jackpot.

<Symbol Lottery Processing>

Figure 18:
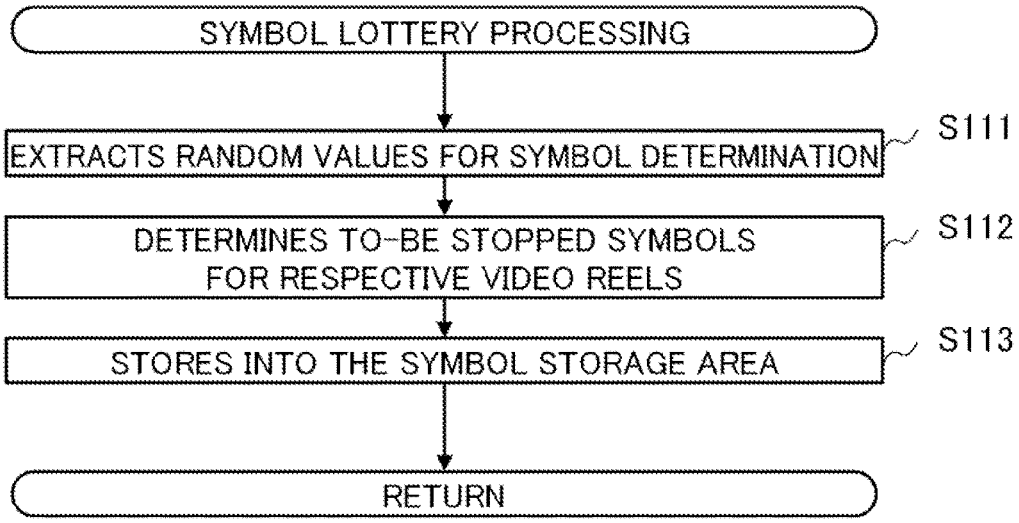
FIG. 18 is a view illustrating a flowchart of symbol lottery processing for the gaming machine.

Next, with reference to FIG. 18, the symbol lottery processing is described. FIG. 18 is a view illustrating a flowchart of the symbol lottery processing for the gaming machine according to the embodiment of the present invention.

First, the main CPU 71 extracts random values for symbol determination (step S111). The main CPU 71 then determines to-be stopped symbols for the respective video reels 3 by lottery (step S112). The main CPU 71 holds a lottery for each video reel 3, and determines any one of the plurality of symbols as a to-be stopped symbol. Taking an example of the first reel in a normal game, each of the 100 symbols (code number="00" to "99") is determined at an equal probability (i.e. 1/100) at this time.

The main CPU 71 then stores the determined to-be stopped symbols (for example, the code numbers or identifiers indicating the symbols) for the respective video reels 3 into a symbol storage area provided in the RAM 73 (step S113). After the processing has been conducted, the symbol lottery processing is completed.

<Number-of-Payouts Determination Processing>

Figure 19:
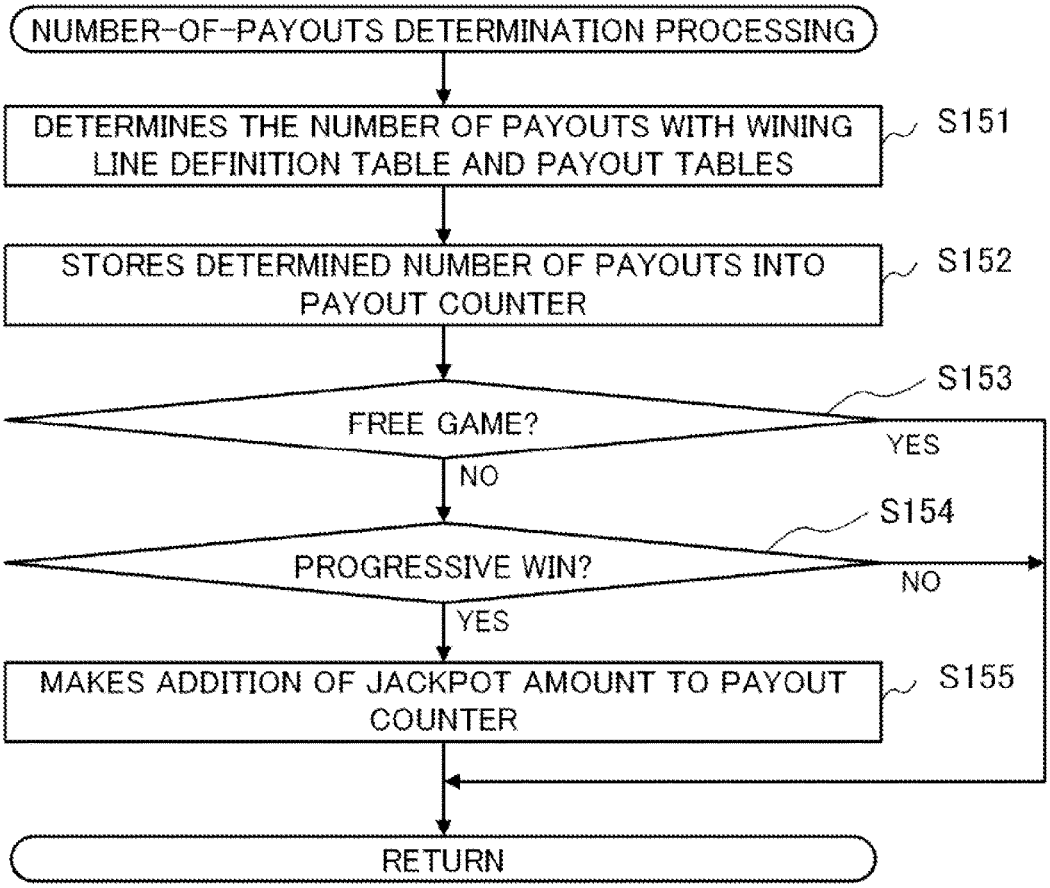
FIG. 19 is a view illustrating a flowchart of number-of-payouts determination processing for the gaming machine.

Next, with reference to FIG. 19, the number-of-payouts determination processing is described. FIG. 19 is a view illustrating a flowchart of the number-of-payouts determination processing for the gaming machine according to the embodiment of the present invention.

The main CPU 71 first determines a line payout and a bonus payout based on the symbol storage area with reference to the winning line definition table and the payout tables (step S151). For example, when a specific number of a specific type of symbols are displayed on a winning line (so as to be defined in the payout table), the main CPU 71 determines a corresponding payout (line payout) defined in the payout table, and further determines the number of payouts based on the line payout and the number of BETs. It is to be noted that the main CPU 71 determines "0" as the number of payouts in the case where the game is lost. Next, the main CPU 71 determines a bonus payout based on the number of feature symbols and the payout table and subsequently determines the number of payouts based on this bonus payout and the number of BETs.

Next, the main CPU 71 stores the determined number of payouts into the number-of-payouts storage area (step S152).

Next, the main CPU 71 determines whether the game being played is a free game with reference to the number of free games (Step S153). When determining that the game is not a free game, the main CPU 71 further determines whether the game result is a progressive win (step S154). When determining that the game result is a progressive win, the main CPU 71 adds the amount of jackpot to the number of payouts and stores the sum in the number of payout storage area (step S155). After the processing has been conducted, the number-of-payouts determination processing is completed.

When determining that the game being played is a free game in step S153 or when determining that the game result is not a progressive win in step S154, the main CPU 71 exits the number-of-payouts determination processing.

<Predictive Effects Determination Processing>

Figure 20:
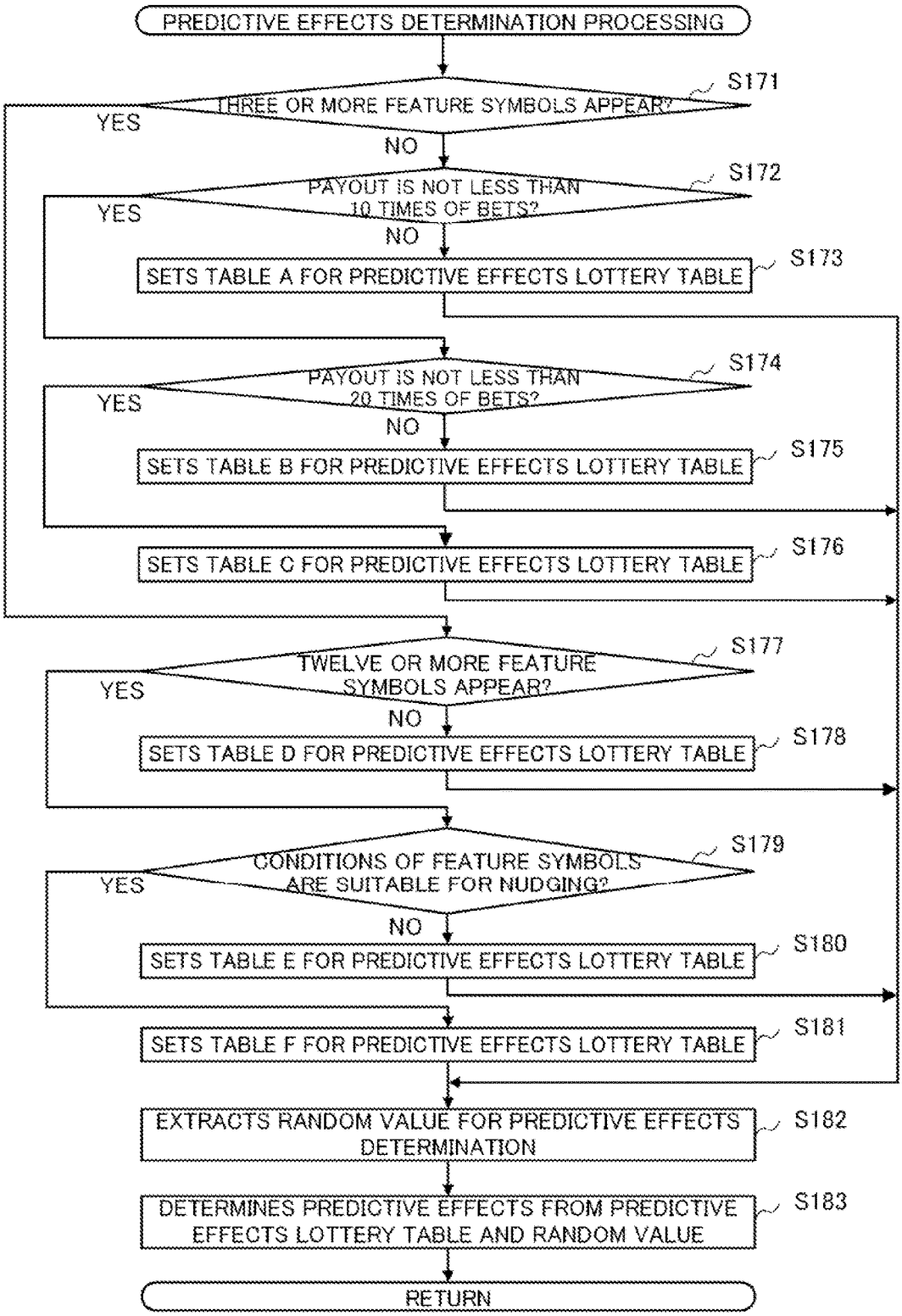
FIG. 20 is a view illustrating a flowchart of predictive effects determination processing for the gaming machine.

Next, with reference to FIG. 20, predictive effects determination processing is described. FIG. 20 is a view illustrating a flowchart of the predictive effects determination processing for the gaming machine according to the embodiment of the present invention.

First, the main CPU 71 determines whether a free game trigger is established, that is to say, whether at least one feature symbol appears on each of the first reel, the second reel, and the third reel (step S171). If a free game trigger is not established, the main CPU 71 determines whether the payout is not less than ten times of the number of BETs (step S172). If the payout is less than ten times of the number of BETs, the main CPU 71 sets Table A for the predictive effects lottery table (step S173). The positions in the symbol display region 4 of the feature symbols and the symbols involving the payout can be obtained by the determined to-be stopped symbols of the video reels 3 that are stored in the symbol storage area through the symbol lottery processing illustrated in FIG. 18.

If the payout is not less than ten times of the number of BETs, the main CPU 71 determines whether the payout is not less than 20 times of the number of BETs (step S174). If the payout is less than 20 times of the number of BETs, the main CPU 71 sets Table B for the predictive effects lottery table (step S175). If the payout is not less than 20 of the number of BETs, the main CPU 71 sets Table C for the predictive effects lottery table (step S176).

If a free game trigger is established, the main CPU 71 determines whether twelve or more feature symbols appear in the symbol display region 4 (step S177). If twelve or more feature symbols do not appear, the main CPU 71 sets Table D for the predictive effects lottery table (step S178). If twelve or more of feature symbols appear, the main CPU 71 further determines whether the feature symbols appear suitably for nudging (step S179).

If the feature symbols do not appear suitably for nudging, the main CPU 71 sets Table E for the predictive effects lottery table (step S180). If the feature symbols appear suitably for nudging, the main CPU 71 sets Table F for the predictive effects lottery table (step S181)

Next, the main CPU 71 extracts a random value for predictive effects determination (step S182) and determines predictive effects based on the selected predictive effects lottery table and the extracted random value (step S183). After this processing, the main CPU 71 exits the predictive effects determination processing.

The foregoing predictive effects determination processing leads to predictive effects of Prediction 4 or Prediction 5 with higher possibility as the payout is higher when feature symbols do not satisfy the requirements for a free game trigger. When feature symbols satisfy the requirements for a free game trigger, the processing leads to predictive effects of Prediction 1, Prediction 2, or Prediction 3 with high possibility (refer to the predictive effects lottery table in FIG. 11A). If the conditions of the feature symbols are suitable for nudging, the predictive effects of Prediction 2 (nudge performance) are implemented without exception. The conditions suitable for nudging are that feature symbols appear at predetermined positions; details thereof are described later. Although the program of this example is configured to implement the predictive effects of Prediction 2 without exception when the conditions of feature symbols are suitable for nudging as illustrated in the predictive effects lottery table in FIG. 11A, the program can be configured to implement different effects or combination of effects with specific probabilities.

<Predictive Effects Implementation Processing>

Figure 21:
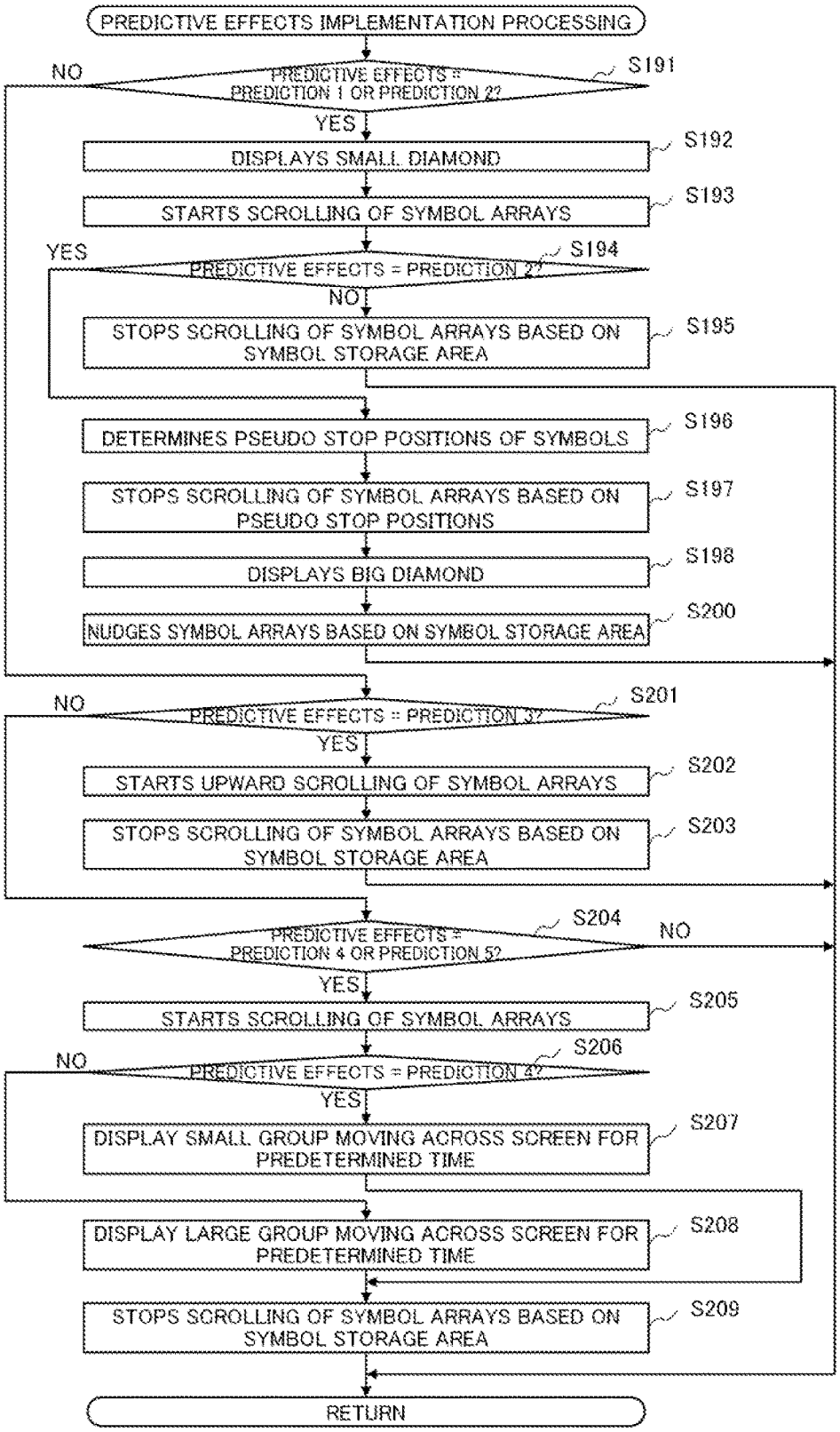
FIG. 21 is a view illustrating a flowchart of predictive effects implementation processing for the gaming machine.

Next, with reference to FIG. 21, predictive effects implementation processing is described. FIG. 21 is a view illustrating a flowchart of the predictive effects implementation processing for the gaming machine according to the embodiment of the present invention.

First, the main CPU 71 determines whether the predictive effects determined by the predictive effects determination processing illustrated in FIG. 20 are either Prediction 1 or Prediction 2 (step S191). If the determined predictive effects are Prediction 1 or Prediction 2, the main CPU 71 displays an image of a small diamond in the symbol display region 4 for a predetermined period (step S192). Subsequently, the main CPU 71 erases the image of the small diamond and starts scrolling the symbol arrays (step S193).

Next, the main CPU 71 determines whether the predictive effects are Prediction 2 (step S194). If the predictive effects are Prediction 1, the main CPU 71 stops the scrolling of the symbol arrays based on the information of the to-be stopped symbols stored in the symbol storage area to display the stopped symbols which are to appear (step S195). After this step, the main CPU 71 exits the predictive effects implementation processing.

If the predictive effects are Prediction 2 or nudge performance, the main CPU 71 determines pseudo stop positions of the symbols (step S196). The predictive effects of Prediction 2 in this embodiment is nudging feature symbols in predetermined directions; the pseudo stop positions are positions suitable to nudge the feature symbols and different from the original positions to stop the symbols. The main CPU 71 stops scrolling of the symbol arrays based on the determined pseudo stop positions (step S197).

Next, the main CPU 71 displays an image of a big diamond in the symbol display region 4 for a predetermined period (step S198). Subsequently, the main CPU 71 erases the image of the big diamond and nudges the symbol arrays based on the information of the to-be stopped symbols stored in the symbol storage area so that the symbols to appear are stopped in the display (step S200). Although the program of this example is configured to determine the pseudo stop positions immediately before step S197, the determination of the pseudo stop positions can be made at an earlier stage. After this step, the main CPU 71 exits the predictive effects implementation processing.

If the predictive effects are neither Prediction 1 nor Prediction 2, the main CPU 71 determines whether the predictive effects are Prediction 3 (step S201). If the predictive effects are Prediction 3, the main CPU 71 starts scrolling the symbol arrays upward (which is the opposite direction to the normal direction) in the symbol display region 4 (step 202). Then, the main CPU 71 stops the scrolling of the symbol arrays based on the information of the to-be stopped symbols stored in the symbol storage area to display the stopped symbols which are to appear (step S203). After this step, the main CPU 71 exits the predictive effects implementation processing.

If the predictive effects are not Prediction 3, the main CPU 71 determines whether the predictive effects are either Prediction 4 or Prediction 5 (step S204). If the predictive effects are either Prediction 4 or Prediction 5, the main CPU 71 starts scrolling the symbol arrays in the symbol display region 4 (step S205). Subsequently, the main CPU 71 determines whether the predictive effects are Prediction 4 (step S206). If the predictive effects are Prediction 4, the main CPU 71 keeps displaying the scrolling symbols in the background and further displays a small group (some images of animals, for example) in the symbol display region 4 for a predetermined time in such a manner that they move across the symbol display region 4 (step S207). Although the program of this example controls the display so that the small group moves across the symbol display region 4 from the right to the left, the group may be moved in any direction.

If the predictive effects are not Prediction 4 (meaning that the predictive effects are Prediction 5), the main CPU 71 keeps displaying the scrolling symbols in the background and further displays a large group (some images of animals, for example) in the symbol display region 4 for a predetermined time in such a manner that they move across the symbol display region 4 (step S208). Although the program of this example controls the display so that the large group moves across the symbol display region 4 from the right to the left, the group may be moved in any direction. The large group includes more images (of animals, for example) than the small group displayed in the foregoing effects of Prediction 4.

After displaying the small group in the effects of Prediction 4 or the large group in the effects of Prediction 5, the main CPU 71 stops the scrolling of the symbol arrays based on the information of the to-be stopped symbols stored in the symbol storage area and displays the stopped symbols which are to appear (step S209). After this step, the main CPU 71 exits the predictive effects implementation processing.

If the predictive effects are none of Prediction 1 to Prediction 5, the determined is No effects; accordingly, the main CPU 71 does not implement any effect and exits the predictive effects implementation processing.

<Free Game Processing>

Figure 22:
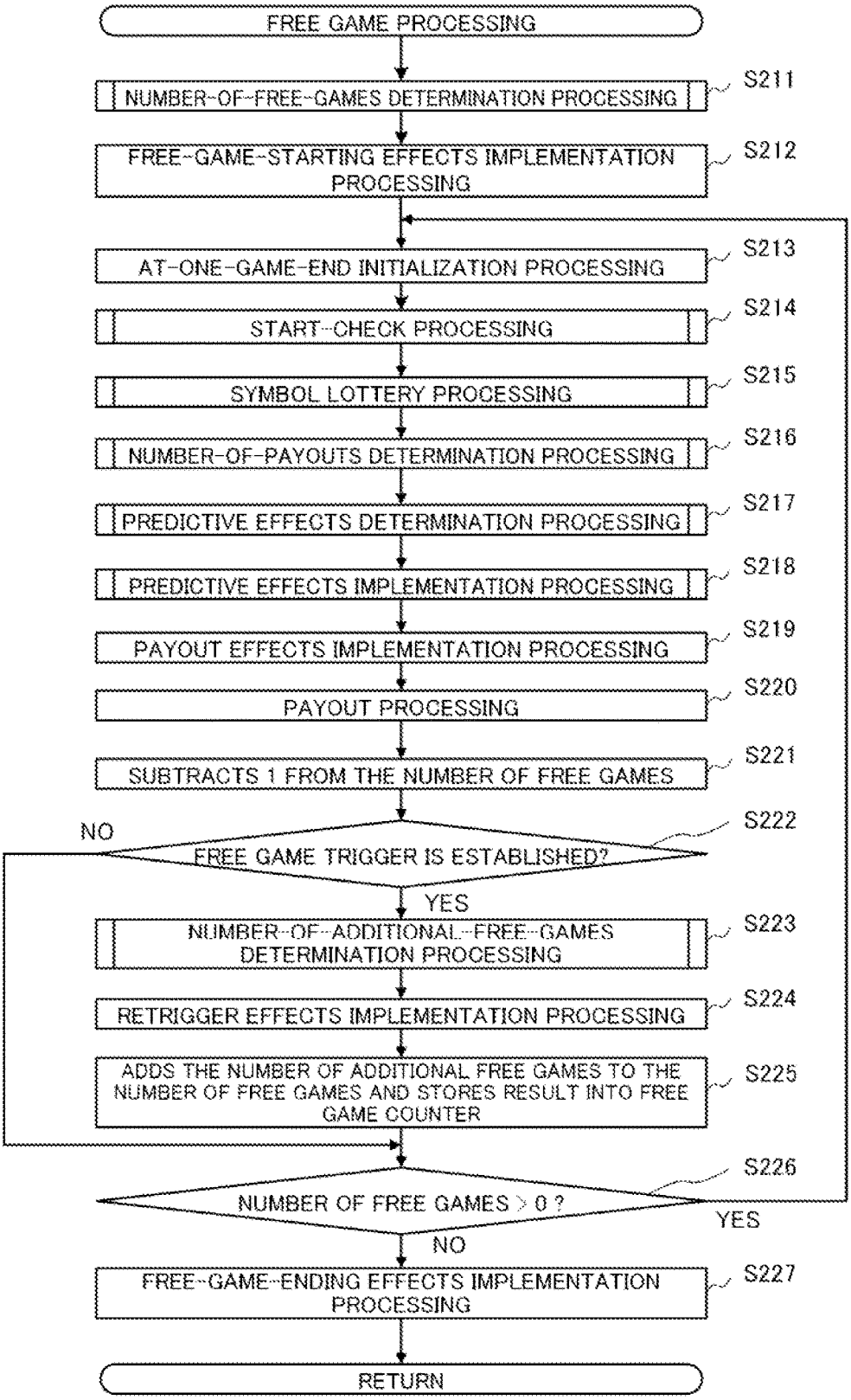
FIG. 22 is a view illustrating a flowchart of free game processing for the gaming machine.

Next, with reference to FIG. 22, free game processing is described. FIG. 22 is a view illustrating a flowchart of the free game processing for the gaming machine according to the embodiment of the present invention.

The main CPU 71 conducts number-of-free-games determination processing, which is described later with reference to FIG. 23 (step S211). This processing is to determine the number of free games, for example by summing the numbers of free games associated by lotteries with the feature symbols to appear.

Next, the main CPU 71 conducts free-game-starting effects implementation processing (step S212). This processing is to display free game introductory effects, such as number-of-free-games lottery effects, on the lower image display panel 141 in starting free games when a free game trigger is established in a normal game. Effects in starting free games are described later in detail.

Next, the main CPU 71 conducts at-one-game-end initialization processing (step S213). For example, data that becomes unnecessary after each game in the working areas of the RAM 73, such as the symbols determined by lottery, is cleared.

Next, the main CPU 71 conducts start check processing (step S214). This processing is the same as the coin-insertion/start-check processing illustrated in FIG. 16; however, the steps related to coin insertion and the credit counter (steps S41, S42, and S43) are not necessary in a free game. The jackpot-related processing (step S51) is not conducted, either.

Next, the main CPU 71 conducts symbol lottery processing (step S215). This processing is the same as the symbol lottery processing illustrated in FIG. 18.

Next, the main CPU 71 conducts number-of-payouts determination processing (step S216). This processing is the same as the number-of-payouts determination processing illustrated in FIG. 19; however, the steps related to the jackpot (steps S154 and S155) are not executed because the game is a free game.

Next, the main CPU 71 conducts predictive effects determination processing (step S217). This processing is the same as the predictive effects determination processing illustrated in FIG. 20. Subsequently, the main CPU 71 conducts predictive effects implementation processing (step S218). This processing is the same as the predictive effects implementation processing illustrated in FIG. 21.

Next, the main CPU 71 conducts payout effects implementation processing (step S219) and subsequently, conducts payout processing (step S220). These are the same as the payout effects implementation processing and the payout processing illustrated in FIG. 15.

Next, the main CPU 71 subtracts 1 from the number of free games and stores the result to the number-of-free-games storage area provided in the RAM 73 (step S221). Next, the main CPU 71 determines whether a free game trigger is established in the free game (step S222). When determining that a free game trigger is established (for example, when feature symbols are displayed on the first, the second, and the third reels), the main CPU 71 conducts number-of-additional-free-games determination processing, which is described later with reference to FIG. 24 (step S223). This processing is to determine the number of free games, for example by summing the numbers of free games associated by lottery with the feature symbols to appear.

Next, the main CPU 71 conducts retrigger effects implementation processing (step S224). For example, when a free game trigger is established, the main CPU 71 makes the speaker 112 output sound effect (SE) related to the retrigger and the lower image display panel 141 display a notice indicating a retrigger is established. The retrigger effects implementation processing is described later in detail.

Next, the main CPU 71 adds the number of free games to be newly added because of the establishment of a free game trigger to the number of free games stored in the number-of-free-games storage area provided in the RAM 73 (step S225). If determining at step S222 that a free game trigger is not established, the main CPU 71 proceeds to step S226 to determine the number of free games.

Next, the main CPU 71 determines whether the number of free games stored in the number-of-free-games storage area provided in the RAM 73 is greater than zero (step S226); if determining that the number of free games is greater than zero, the main CPU 71 proceeds to step S213 to start a new free game. If the number of free games is zero, the free games end; the main CPU 71 conducts free-game-ending effects implementation processing (step S227). For example, when determining the end of free games, the main CPU 71 makes the speaker 112 output sound effects (SE) related to ending free games and the lower image display panel 141 display a notice indicating the end of free games. The free-game-ending effects implementation processing is described later in detail. After this step, the main CPU 71 exits the free game processing.

<Number-of-Free-Games Determination Processing>

Figure 23:
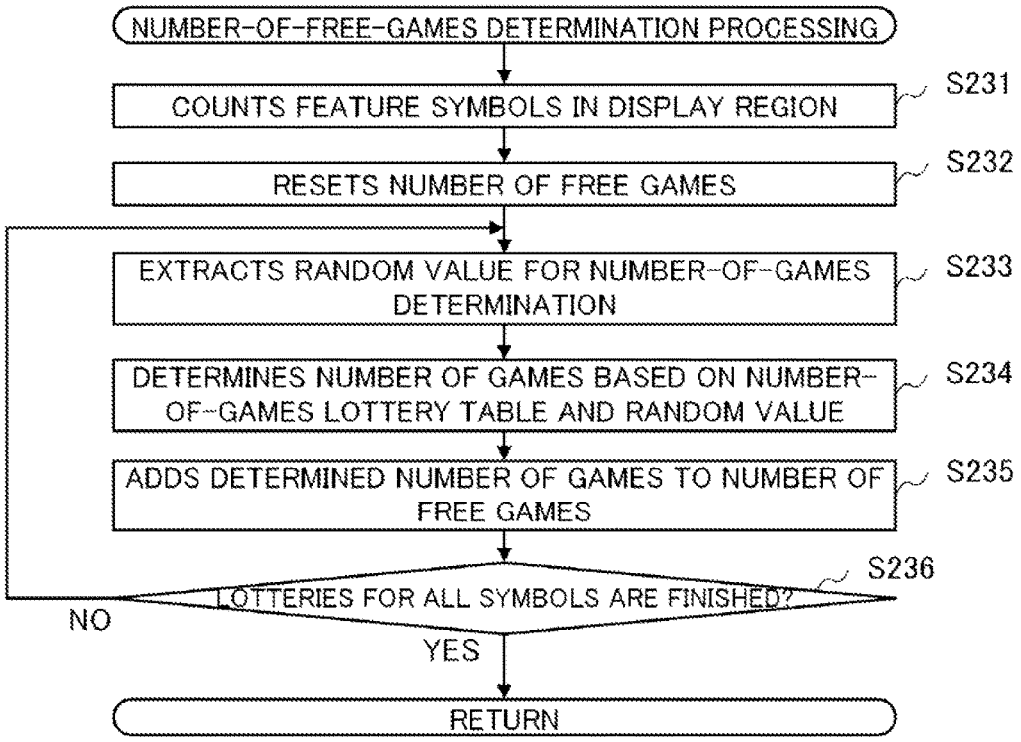
FIG. 23 is a view illustrating a flowchart of number-of-free-games determination processing for the gaming machine.

Next, with reference to FIG. 23, number-of-free-games determination processing is described. FIG. 23 is a view illustrating a flowchart of the number-of-free-games determination processing for the gaming machine according to the embodiment of the present invention.

First, the main CPU 71 counts the feature symbols stopped in the symbol display region 4 (step S231) and resets the number of free games stored in the number-of-free-games storage area provided in the RAM 73 (step S232).

Next, the main CPU 71 extracts a random value for number-of-games determination in order to determine the number of games for a feature symbol by lottery (step S233). Next, the main CPU 71 determines the number of games using a number-of-games lottery table (not shown) and the extracted random value for number-of-games determination (step S234). The number-of-games lottery table is a table associating specific ranges of values with the numbers of games 1, 2, 3, 5, 7, and 10; the number of games is determined to be one of the values 1, 2, 3, 5, 7, and 10 in accordance with the extracted random value.

Next, the main CPU 71 adds the determined number of games to the number of free games (step S235). The main CPU 71 determines whether the numbers of games have been determined by lottery for all the feature symbols (step S236). If the numbers of games for all the feature symbols have not been determined, the main CPU 71 proceeds to step S233 to repeat the processing of steps S233 to S235. If the numbers of games for all the feature symbols are determined, the main CPU 71 exits the number-of-free-games determination processing.

<Number-of-Additional-Free-Games Determination Processing>

Figure 24:
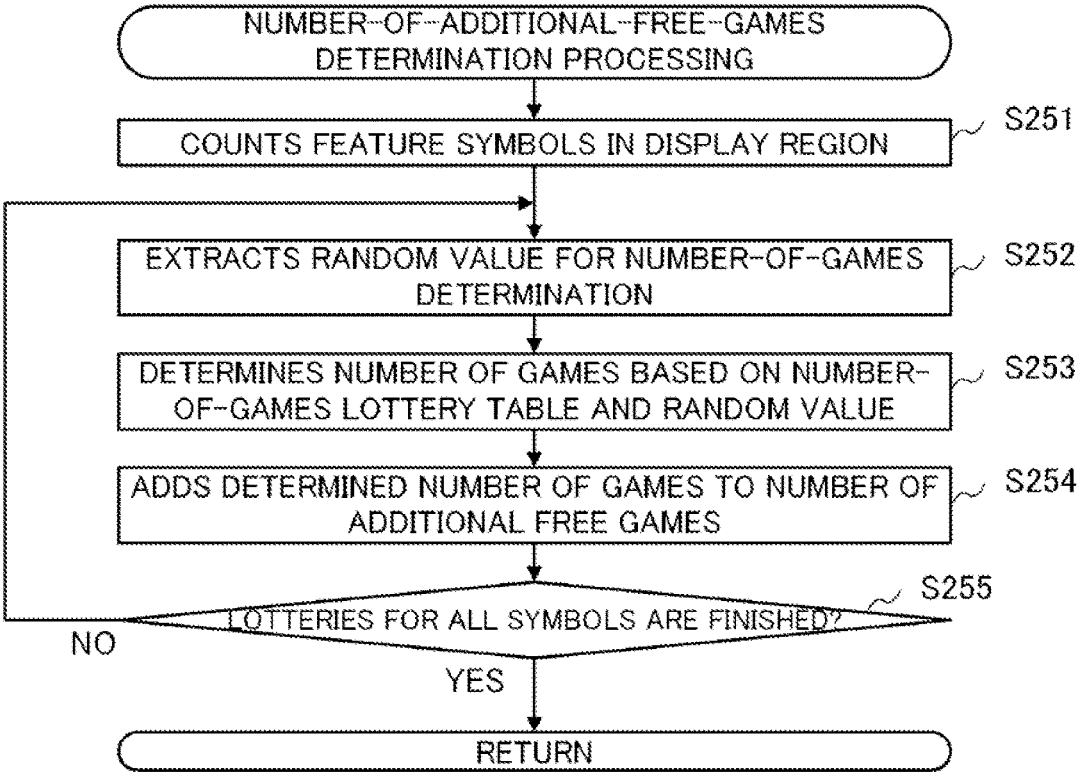
FIG. 24 is a view illustrating a flowchart of number-of-additional-free-games determination processing for the gaming machine.

Next, with reference to FIG. 24, number-of-additional-free-games determination processing is described. FIG. 24 is a view illustrating a flowchart of the number-of-additional-free-games determination processing for the gaming machine according to the embodiment of the present invention. This processing is to determine the number of additional free games to be added to the number of free games at the time of establishment of a retrigger.

First, the main CPU 71 counts the feature symbols stopped in the symbol display region 4 (step S251).

Next, the main CPU 71 extracts a random value for number-of-games determination in order to determine the number of games for a feature symbol by lottery (step S252). Next, the main CPU 71 determines the number of games using a number-of-games lottery table (not shown) and the extracted random value for number-of-games determination (step S253). The number-of-games lottery table is a table associating specific ranges of values with the numbers of games 1, 2, 3, 5, 7, and 10; the number of games is determined to be one of the values 1, 2, 3, 5, 7, and 10 in accordance with the extracted random value.

Next, the main CPU 71 adds the determined number of games to the number of additional free games (step S254). The main CPU 71 determines whether the numbers of games have been determined by lottery for all the feature symbols (step S255). If the numbers of games for all the feature symbols have not been determined, the main CPU 71 proceeds to step S252 to repeat the processing of steps S252 to S254. If the numbers of games for all the feature symbols are determined, the main CPU 71 exits the number-of-additional-free-games determination processing.

<Predictive Effects Implementation Processing for Prediction 1>

Figure 25A:
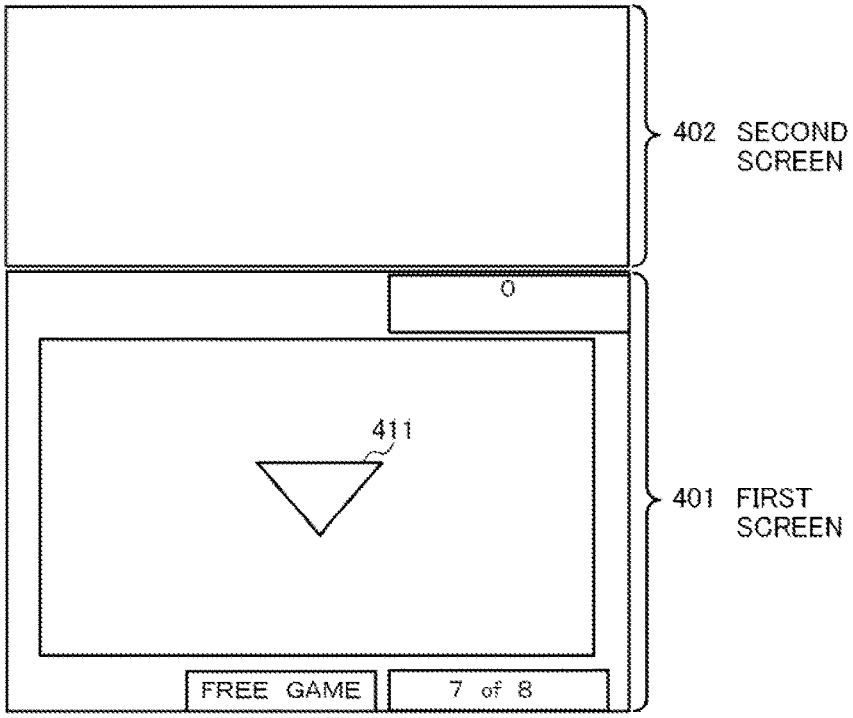
FIGS. 25A and 25B are views for illustrating predictive effects implementation processing for predictive effects of Prediction 1.
Figure 25B:
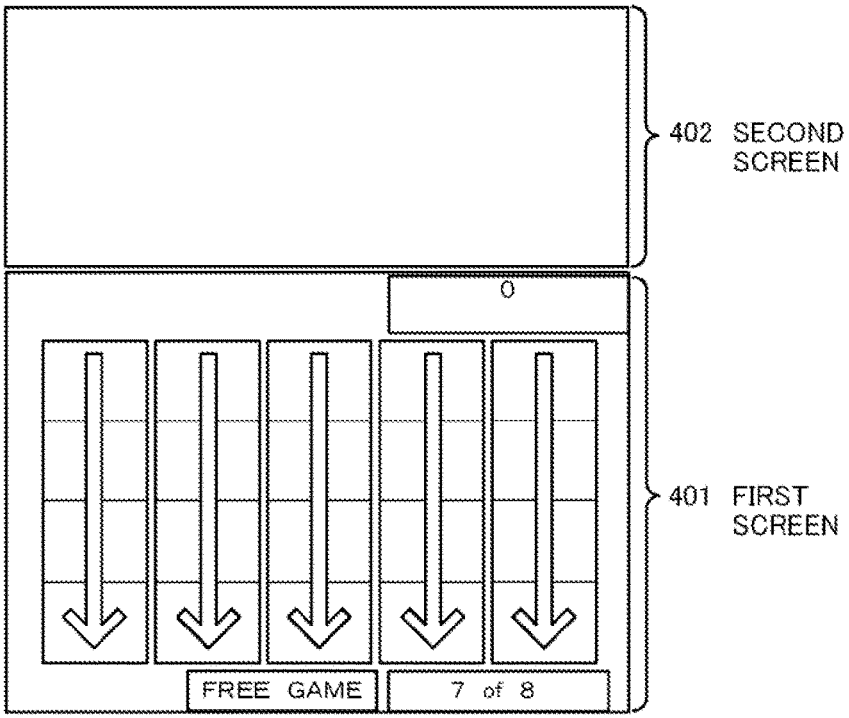
Figure 26:
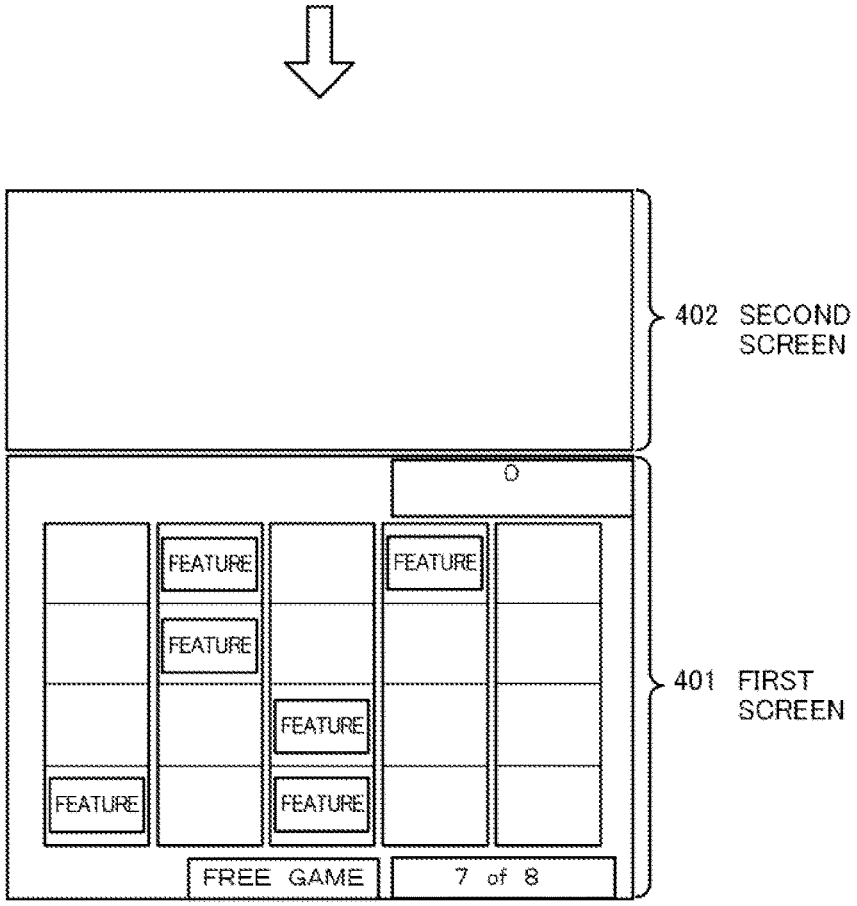
FIG. 26 is a view for illustrating predictive effects implementation processing for predictive effects of Prediction 1.

Next, with reference to FIGS. 25A to 26, predictive effects implementation processing for predictive effects of Prediction 1 is described. FIGS. 25A to 26 are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects. This section describes predictive effects implemented in a free game by way of example, although the predictive effects are implemented in a normal game as well.

FIG. 25A shows the initial state of a free game when feature symbols are determined to be stopped on the first, the second, and the third reels and Prediction 1 is determined through the predictive effects determination processing. Before start of scrolling the symbol arrays, the symbol display region 4 shows an image 411 of a small diamond. At this time, the symbol display region 4 does not show the symbol arrays.

After showing the image 411 of a small diamond as shown in FIG. 25A for a predetermined time, the symbol display region 4 changes to the state of FIG. 25B where the symbol arrays are scrolled based on a relevant spin table. After a predetermined time, the scrolling of the symbol arrays is stopped in the symbol display region 4 as shown in FIG. 26. Subsequently, payout effects for a line payout for each winning line and payout effects for a bonus payout depending on the feature symbols are implemented based on the stopped symbols in the display and free games are started.

Prediction 1 is selected at a given probability in the case where a free game trigger is established and the feature symbols are not suitable for nudging; accordingly, the player can feel expectation for free games when seeing the effects.

<Predictive Effects Implementation Processing for Prediction 2>

Next, with reference to FIGS. 27A to 31B, predictive effects implementation processing for predictive effects of Prediction 2 is described. FIGS. 27A to 28B, 31A, and 31B are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects. This section describes predictive effects implemented in a free game by way of example, although the predictive effects are implemented in a normal game as well.

Figure 27A:
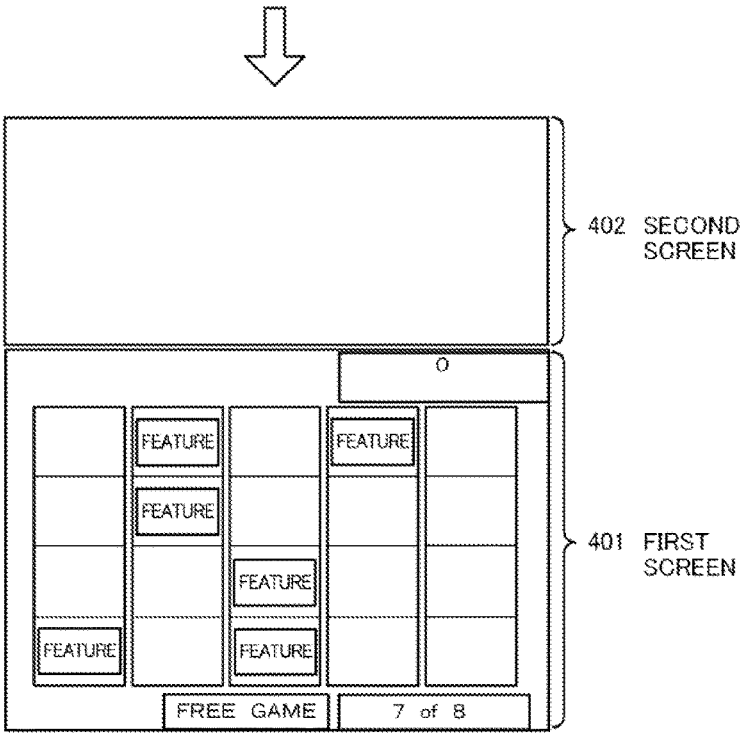
FIGS. 27A and 27B are views for illustrating predictive effects implementation processing for predictive effects of Prediction 2.

FIG. 27A shows a state of a free game when feature symbols are determined to be stopped on the first, the second, and the third reels, the feature symbols are determined to be suitable for nudging, and Prediction 2 is determined through the predictive effects determination processing. In Prediction 2, after displaying a small diamond, scrolling of the symbol arrays, and stopping the scrolling of the symbol arrays like the effects of Prediction 1 illustrated in FIGS. 25A to 26, the state of FIG. 27A is displayed. It should be noted that the stop positions of the symbols in FIG. 27A are pseudo stop positions (for the subsequent nudging), which is different from the positions for the symbols to be stopped.

Figure 27B:
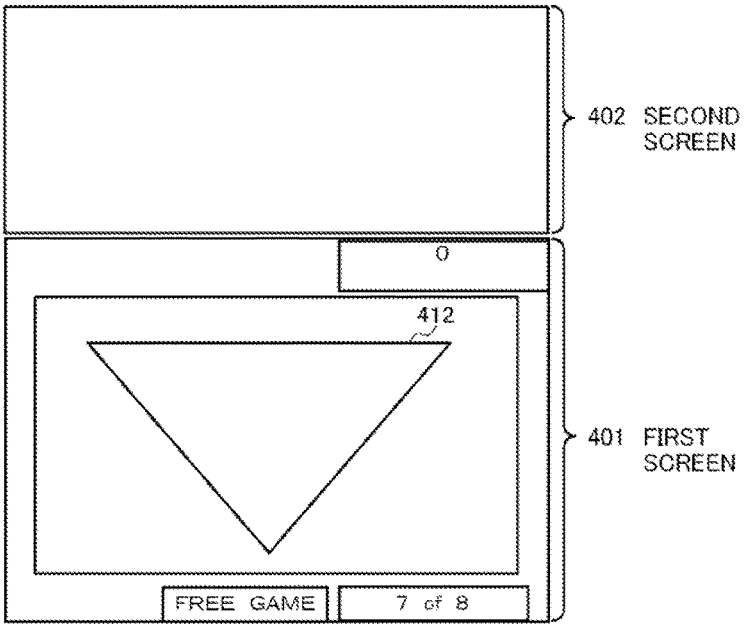

After displaying the stopped symbols as shown in FIG. 27A for a predetermined time, for example, the time for 20 frames, the symbol display region 4 displays an image 412 of a big diamond as shown in FIG. 27B. At this time, the symbol display region 4 does not show the symbol arrays.

Figure 28A:
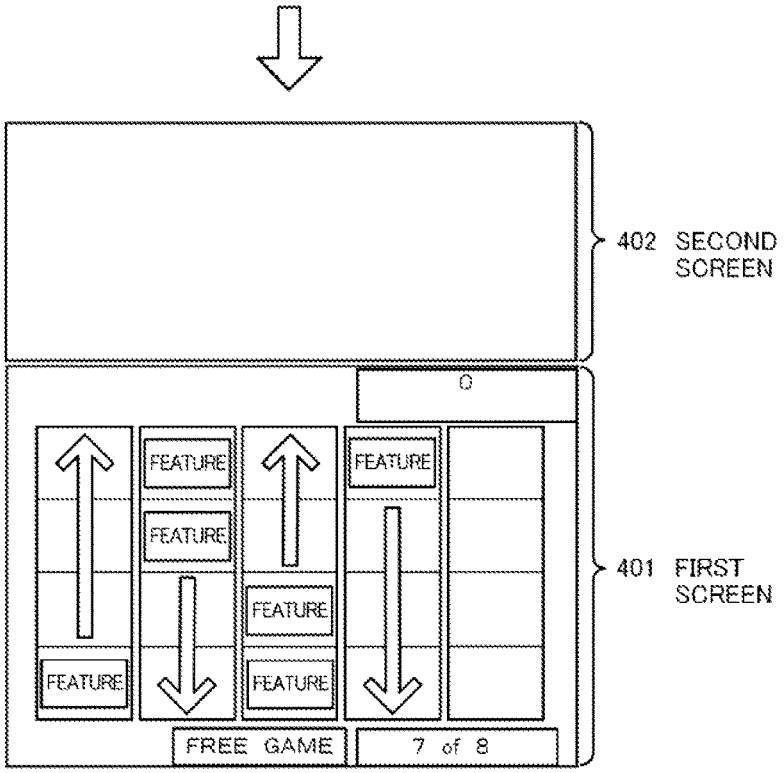
FIGS. 28A and 28B are views for illustrating predictive effects implementation processing for predictive effects of Prediction 2.
Figure 28B:
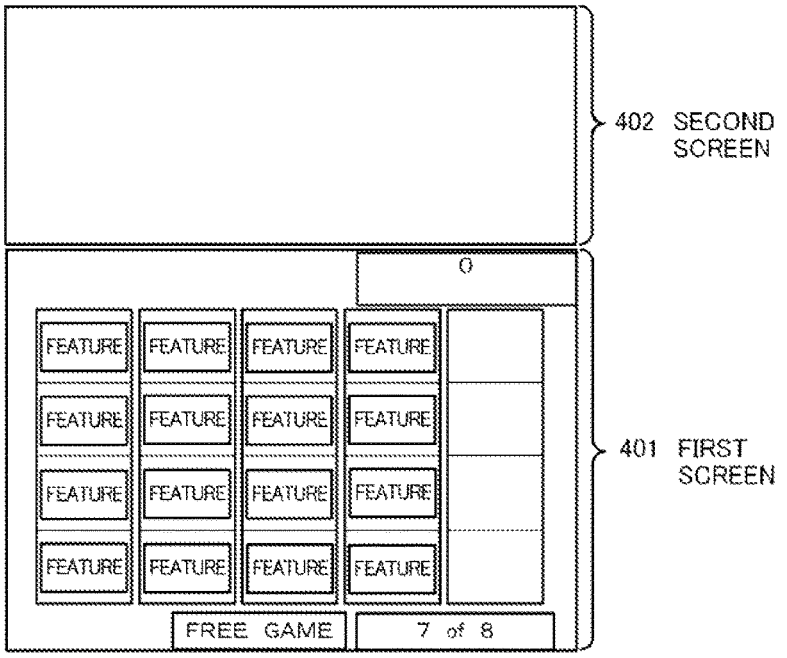

After displaying the image 412 of a big diamond as shown in FIG. 27B for a predetermined time, the symbol display region 4 changes to the state of FIG. 28A where the symbol arrays are nudged based on a relevant spin table. After the nudging, the symbol display region 4 shows the symbols stopped at the positions to be stopped as shown in FIG. 28B. Subsequently, payout effects for a line payout for each winning line and payout effects for a bonus payout depending on the feature symbols are implemented based on the stopped symbols in the display and free games are started.

With reference to FIGS. 29A to 32B, described are requirements for the stop position of the symbols determined by the symbol lottery processing to be suitable for nudging. FIG. 29A indicates four symbols suitable for upward nudging in a free game for each of the first to the fifth reels. These four symbols are the four symbols from the top of the feature symbols arranged consecutively along the symbol array as noted from FIGS. 6A to 7B. FIG. 29B indicates four symbols suitable for downward nudging in a free game for each of the first to the fifth reels. These four symbols are the four symbols from the bottom of the feature symbols arranged consecutively along the symbol array as noted from FIGS. 6A to 7B.

Accordingly, the stop position of the symbols suitable for nudging is to show either one of the arrangements shown in FIGS. 29A and 29B on each of the first to the fifth reels. That is to say, the reel showing feature symbols is required to show four feature symbols in all regions from the upper region to the lower region. However, this requirement needs to be satisfied by at least the first reel, the second reel, and the third reel. Regarding each of the fourth reel and the fifth reel, all the symbols need to be feature symbols or alternatively, the symbols must not include a feature symbol. Accordingly, the total number of feature symbols satisfying the requirements is 12, 16, or 20.

Next, determination of the pseudo stop position for the symbols is described. The code numbers of the first reel indicated on the left of FIG. 30A are the symbols to be stopped determined by symbol lottery processing; this arrangement is suitable for nudging according to FIG. 29A. When this position is determined for the symbols to be stopped, a pseudo stop position for this position is selected and determined from (A-1), (A-2), and (A-3) by lottery. The position (A-1) is lower than the position for the symbols to be stopped by three symbols; nudging the symbols upward by three symbols leads to the position for the symbols to be stopped. The position (A-2) is lower than the position for the symbols to be stopped by two symbols; nudging the symbols upward by two symbols leads to the position for the symbols to be stopped. The position (A-3) is lower than the position for the symbols to be stopped by one symbol; nudging the symbols upward by one symbol leads to the position for the symbols to be stopped.

In similar, the code numbers of the first reel indicated on the left of FIG. 30B are the symbols to be stopped determined by symbol lottery processing; this arrangement is suitable for nudging according to FIG. 29B. When this position is determined for the symbols to be stopped, a pseudo stop position for this position is selected and determined from (B-1), (B-2), and (B-3) by lottery. The position (B-1) is upper than the position for the symbols to be stopped by three symbols; nudging the symbols downward by three symbols leads to the position for the symbols to be stopped. The position (B-2) is upper than the position for the symbols to be stopped by two symbols; nudging the symbols downward by two symbols leads to the position for the symbols to be stopped. The position (B-3) is upper than the position for the symbols to be stopped by one symbol; nudging the symbols downward by one symbol leads to the position for the symbols to be stopped.

Figure 31A:
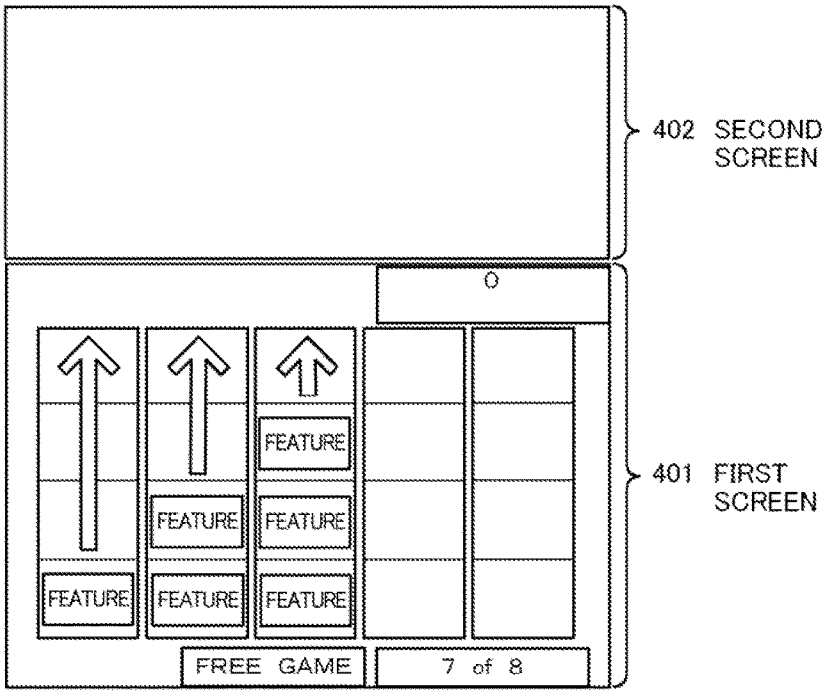
FIGS. 31A and 31B are views for illustrating predictive effects implementation processing for predictive effects of Prediction 2.

The example of nudging illustrated in FIG. 31A is described. As to the first reel, the symbols to be stopped determined by symbol lottery processing satisfy the arrangement suitable for nudging according to FIG. 29A and the above-described pattern (A-1) is selected as the pseudo stop position therefor. In this case, nudging the symbols upward by three symbols leads to the symbols to be arranged at the position to be stopped. As to the second reel, the symbols to be stopped determined by symbol lottery processing satisfy the arrangement suitable for nudging according to FIG. 29A and the above-described pattern (A-2) is selected as the pseudo stop position therefor. In this case, nudging the symbols upward by two symbols leads to the symbols arranged at the position to be stopped. As to the third reel for the symbols, the symbols to be stopped determined by symbol lottery processing satisfy the arrangement suitable for nudging according to FIG. 29A and the above-described pattern (A-3) is selected as the pseudo stop position therefor. In this case, nudging the symbols upward by one symbol leads to the symbols arranged at the position to be stopped. As to the fourth and the fifth reels, feature symbols do not appear.

In this example, symbols on all of the first, the second, and the third reels are displayed at the pseudo stop positions and they are repositioned to the positions to be stopped by the subsequent nudging; however, some of these reels may be arranged not to be nudged without display at the pseudo stop positions.

Figure 31B:
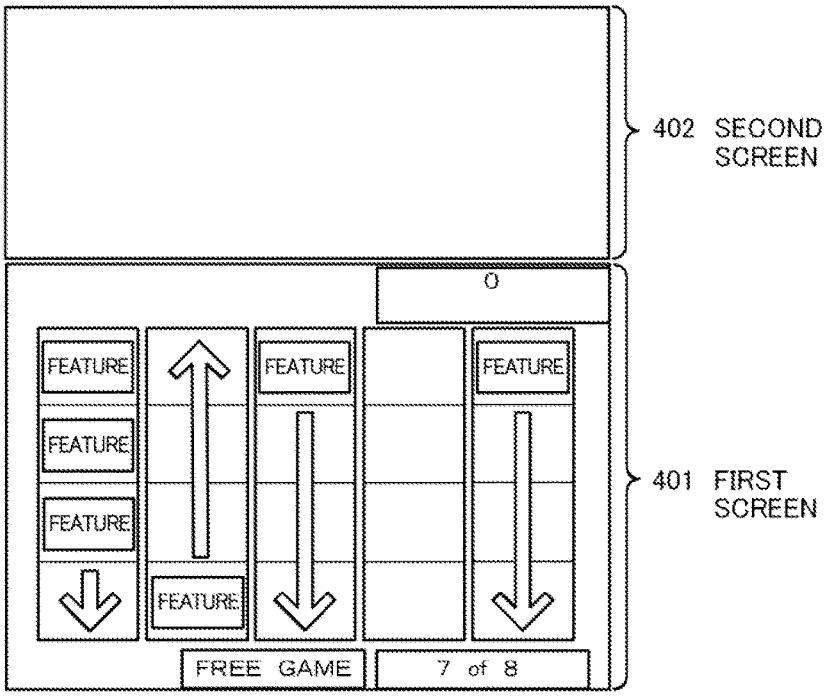

The example of nudging illustrated in FIG. 31B is described. As to the first reel, the symbols to be stopped determined by symbol lottery processing satisfy the arrangement suitable for nudging according to FIG. 29B and the above-described pattern (B-3) is selected as the pseudo stop position therefor. In this case, nudging the symbols downward by one symbol leads to the symbols arranged at the position to be stopped. As to the second reel, the symbols to be stopped determined by symbol lottery processing satisfy the arrangement suitable for nudging according to FIG. 29A and the above-described pattern (A-2) is selected as the pseudo stop position therefor. In this case, nudging the symbols upward by two symbols leads to the symbols arranged at the position to be stopped. As to the third reel, the symbols to be stopped determined by symbol lottery processing satisfy the arrangement suitable for nudging according to FIG. 29B and the above-described pattern (B-1) is selected as the pseudo stop position therefor. In this case, nudging the symbols downward by three symbols leads to the symbols arranged at the position to be stopped. As to the fourth reel, feature symbols do not appear. As to the fifth reel, the symbols to be stopped determined by symbol lottery processing satisfy the arrangement suitable for nudging according to FIG. 29B and the above-described pattern (B-1) is selected as the pseudo stop position therefor. In this case, nudging the symbols downward by three symbols leads to the symbols arranged at the position to be stopped.

As illustrated in FIG. 31B, both of the upward nudging and downward nudging may be performed depending on the positions for the symbols to be stopped determined by symbol lottery processing. In this example, symbols on all of the first, the second, the third, and the fifth reels are displayed at the pseudo stop positions and they are repositioned to the positions for the symbols to be stopped by the subsequent nudging; however, some of these reels may be arranged not to be nudged without display at the pseudo stop positions.

Prediction 2 is selected without exception when a free game trigger is established and the feature symbols are suitable for nudging; accordingly, the player can feel expectation for free games when seeing the effects. Since the player finds to gain a larger payout by seeing nudging, the player keeps the interest in the games until the end of the effects. When the feature symbols are suitable for nudging, the symbol display region 4 will display 12, 16, or 20 feature symbols, promising a larger number of free games. In the number-of-free-games determination processing illustrated in FIG. 23, each feature symbol provides a lottery to determine the number of games and the total sum of the numbers becomes the number of free games. Accordingly, as the number of feature symbols is larger, the expectation for more free games increases.

Prediction 2 is implemented as predictive effects at the start of a large number of free games promising a big benefit. At the beginning of Prediction 2, a small diamond is displayed like Prediction 1 and subsequently, symbols are displayed at pseudo stop positions where only one feature symbol is displayed on each reel. Accordingly, the player first expects start of a small number of free games (to receive a small benefit) and subsequently finds the start of free games to expect a big benefit by seeing the symbols nudged from the pseudo stop positions, so that the player can become aware of a chance to get an unexpected high payout. Conversely, expectation for Prediction 2 during the performance of predictive effects of Prediction 1 may reveal an unfortunate result of no performance of Prediction 2. In this way, the player pays close attention to the transitions of the predictive effects with expectation, increasing the interest and enjoyment.

<Predictive Effects Implementation Processing for Prediction 3>

Figure 32A:
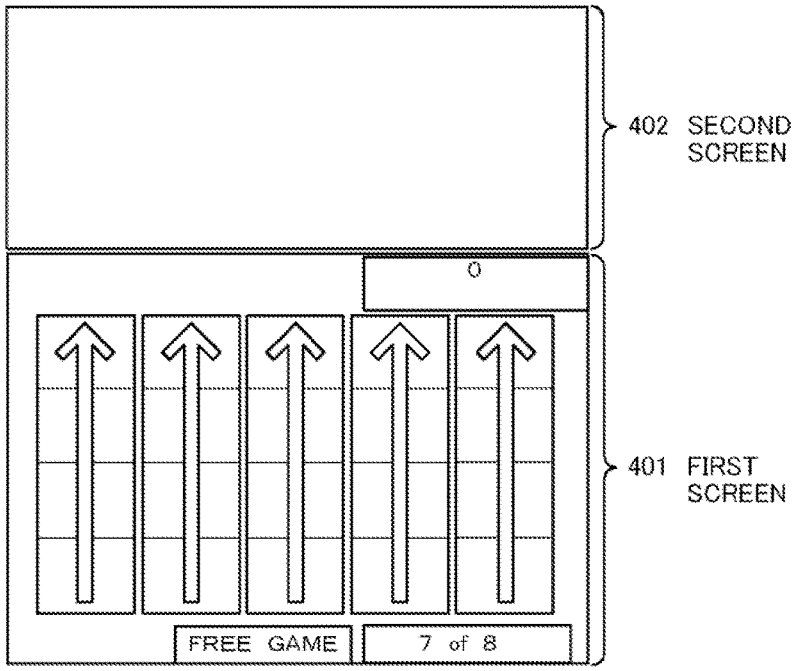
FIGS. 32A and 32B are views for illustrating predictive effects implementation processing for predictive effects of Prediction 3.
Figure 32B:
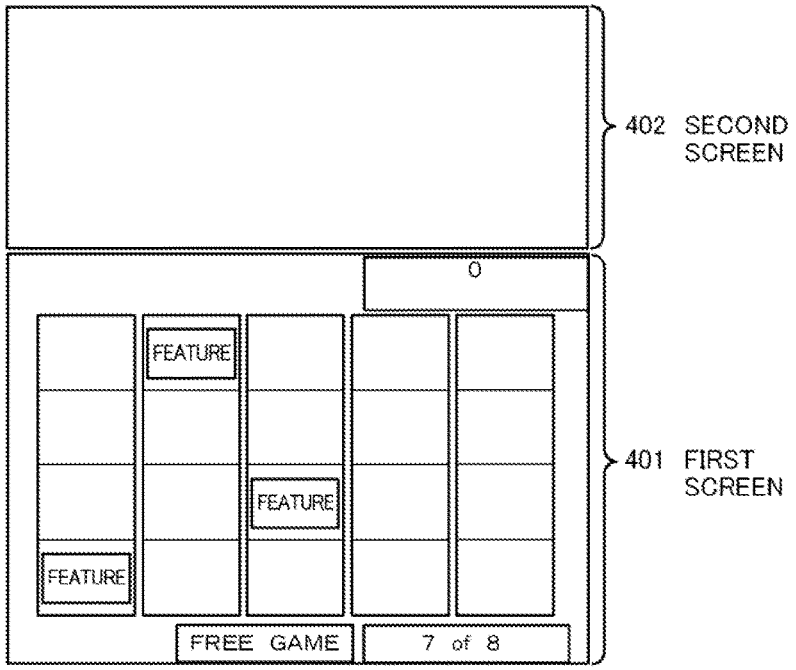

Next, with reference to FIGS. 32A and 32B, predictive effects implementation processing for predictive effects of Prediction 3 is described. FIGS. 32A and 32B are views illustrating specifics of the effects displayed on the upper image display panel 131 and the lower image display panel 141 of the gaming machine according to the embodiment of the present invention. The upper image display panel 131 corresponds to the second screen 402 which shows a game title, advertising slogans, and WIN signs of a normal game and a free game, and the like. The lower image display panel 141 corresponds to the first screen 401 which displays a symbol display region 4 for displaying the video reels 3, a variety of guidance, and various video effects. This section describes predictive effects implemented in a free game by way of example, although the predictive effects are implemented in a normal game as well.

FIG. 32A shows the initial state of a free game when feature symbols are determined to be stopped on the first, the second, and the third reels and Prediction 3 is determined through the predictive effects determination processing. First, the symbol arrays are scrolled in a direction opposite to the normal direction (that is, the symbol arrays are scrolled upward) in the symbol display region 4. This scrolling is performed based on a spin table for reverse spin effects.

After scrolling as illustrated in FIG. 32A for a predetermined time, the symbol display region 4 changes to the state of FIG. 32B where the scrolling of the symbol arrays on all reels are simultaneously stopped. Subsequently, payout effects for a line payout for each winning line and payout effects for a bonus payout depending on the feature symbols are implemented based on the stopped symbols in the display and free games are started.

Prediction 3 is selected at a given probability in the case where a free game trigger is established and the feature symbols are not suitable for nudging; accordingly, the player can feel expectation for free games when seeing the effects.

<Predictive Effects Implementation Processing for Prediction 4>

Next, with reference to FIGS. 33A to 34B, predictive effects implementation processing for predictive effects of Prediction 4 is described. FIGS. 33A to 34B are views illustrating specifics of the effects displayed on the upper image display panel 131 and the lower image display panel 141 of the gaming machine according to the embodiment of the present invention. The upper image display panel 131 corresponds to the second screen 402 which shows a game title, advertising slogans, and WIN signs of a normal game and a free game, and the like. The lower image display panel 141 corresponds to the first screen 401 which displays a symbol display region 4 for displaying the video reels 3, a variety of guidance, and various video effects. This section describes predictive effects implemented in a free game by way of example, although the predictive effects are implemented in a normal game as well.

Figure 33A:
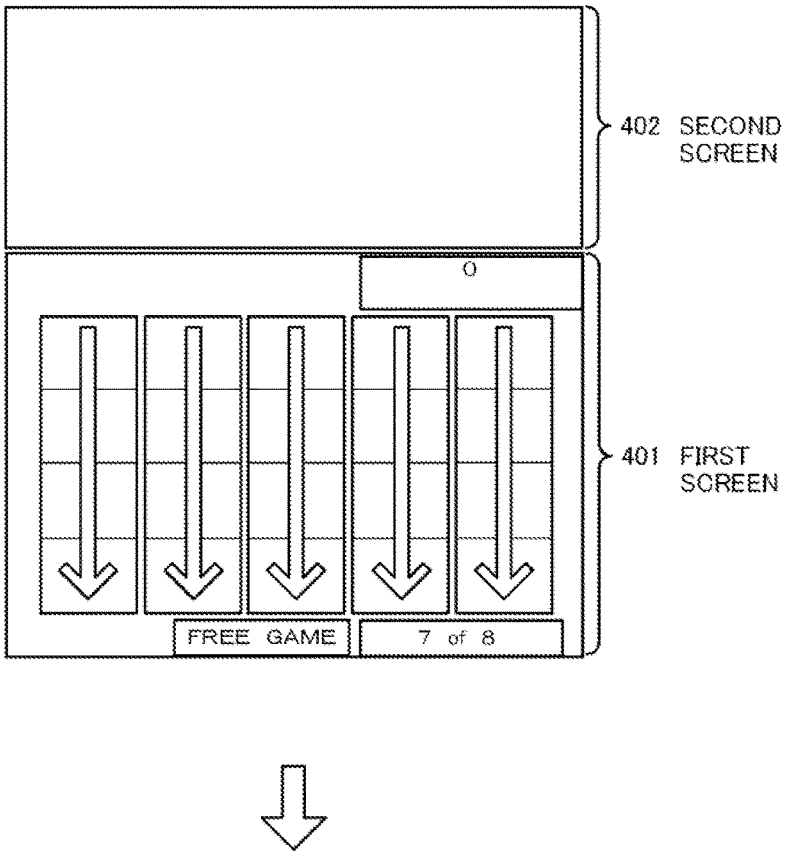
FIGS. 33A and 33B are views for illustrating predictive effects implementation processing for predictive effects of Prediction 4.

FIG. 33A shows the initial state of a free game when symbols different from feature symbols are determined to be stopped on the first, the second, and the third reels, a middle payout or high payout is determined to be provided, and Prediction 4 is determined through the predictive effects determination processing. First, the symbol arrays are scrolled in the symbol display region 4.

Figure 33B:
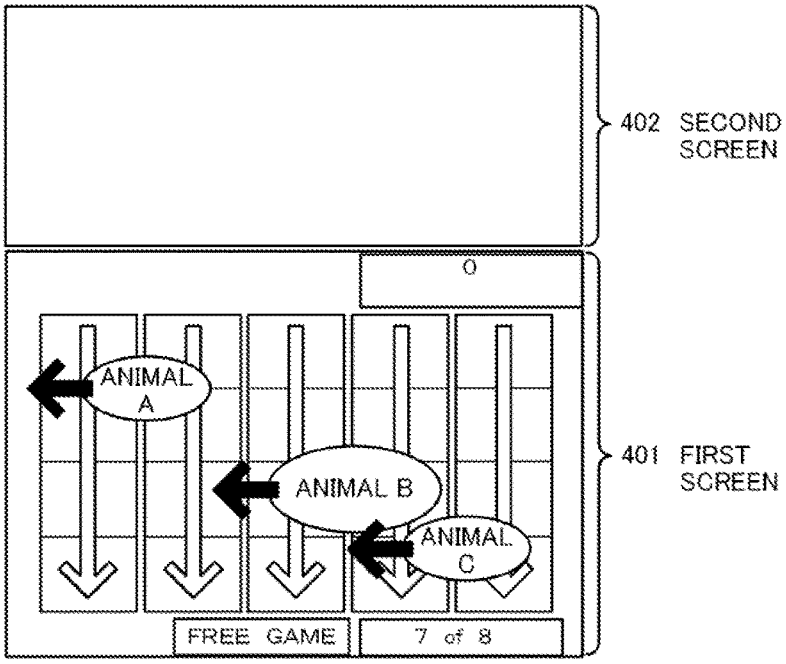

While the symbol arrays are being scrolled in the symbol display region 4, a small group (some images or animations indicating animals, for example) moves across the symbol display region 4 as illustrated in FIG. 33B based on a relevant spin table. Although this example controls the display so that the small group moves across the symbol display region 4 from the right to the left, the group may be moved in any direction.

Figure 34A:
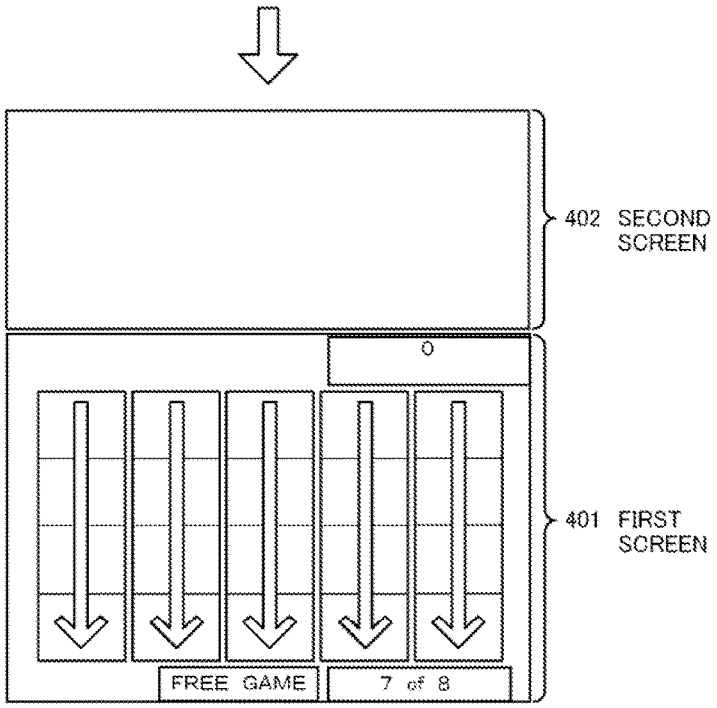
FIGS. 34A and 34B are views for illustrating predictive effects implementation processing for predictive effects of Prediction 4.
Figure 34B:
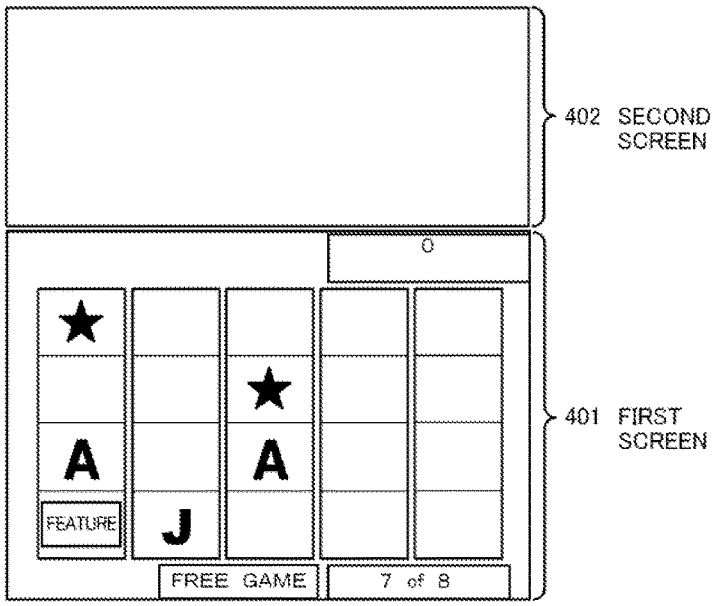

After the small group has crossed the symbol display region 4 and gone from the display, the scrolling of the symbol arrays is continued as illustrated in FIG. 34A and then stopped so that the stopped symbol arrays are displayed as shown in FIG. 34B. Subsequently, payout effects for a line payout for each winning line are implemented based on the stopped symbols in the display.

Prediction 4 is selected at a given probability in the case where a free game trigger is not established but the determined payout is a middle payout, which is not less than 10 times (and less than 20 times) of BETs, or a high payout, which is not less than 20 times of BETs; accordingly, the player can feel expectation for a high payout when seeing the effects.

<Predictive Effects Implementation Processing for Prediction 5>

Figure 35A:
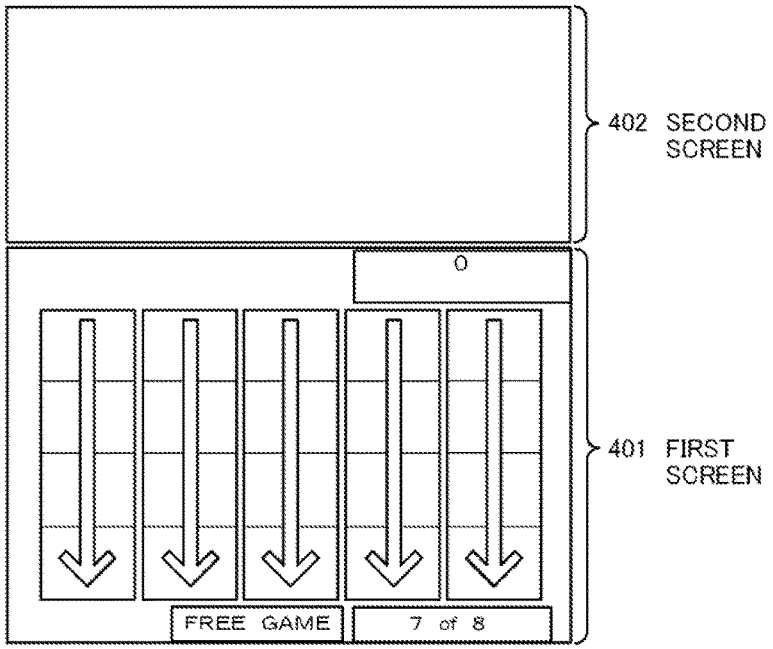
FIGS. 35A and 35B are views for illustrating predictive effects implementation processing for predictive effects of Prediction 5.
Figure 35B:
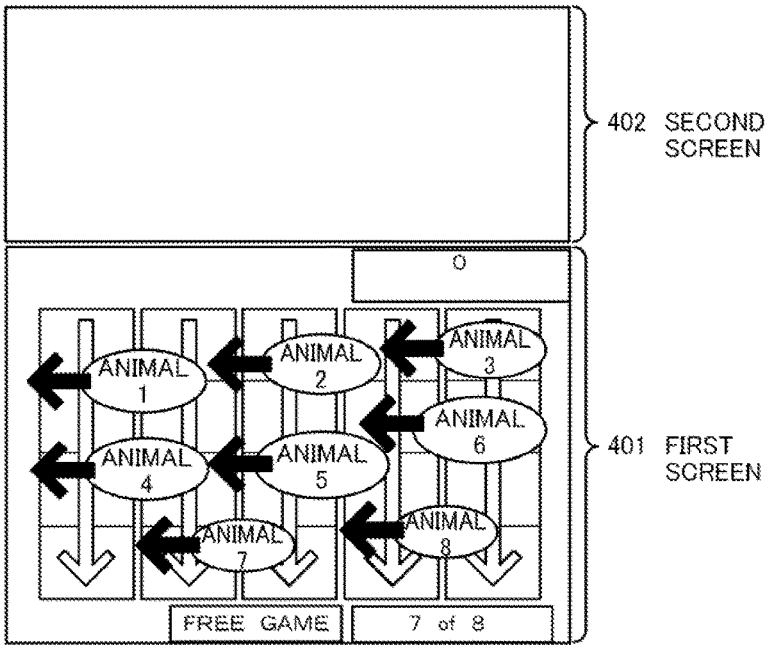

Next, with reference to FIGS. 35A and 35B, predictive effects implementation processing for predictive effects of Prediction 5 is described. FIGS. 35A and 35B are views illustrating specifics of the effects displayed on the upper image display panel 131 and the lower image display panel 141 of the gaming machine according to the embodiment of the present invention. The upper image display panel 131 corresponds to the second screen 402 which shows a game title, advertising slogans, and WIN signs of a normal game and a free game, and the like. The lower image display panel 141 corresponds to the first screen 401 which displays a symbol display region 4 for displaying the video reels 3, a variety of guidance, and various video effects. This section describes predictive effects implemented in a free game by way of example, although the predictive effects are implemented in a normal game as well.

FIG. 35A shows the initial state of a free game when symbols different from feature symbols are determined to be stopped on the first, the second, and the third reels, a high payout is determined to be provided, and Prediction 5 is determined through the predictive effects determination processing. First, the symbol arrays are scrolled in the symbol display region 4.

While the symbol arrays are being scrolled in the symbol display region 4, a large group (some images or animations indicating animals, for example) moves across the symbol display region 4 as illustrated in FIG. 35B based on a relevant spin table. Although this example controls the display so that the large group moves across the symbol display region 4 from the right to the left, the group may be moved in any direction. The large group means a group including more images (of animals, for example) than the small group in the foregoing Prediction 4.

After the large group has crossed the symbol display region 4 and gone from the display, the scrolling the symbol arrays is continued like in the case of Prediction 4 illustrated in FIG. 34A and then stopped so that the stopped symbol arrays are displayed like in the case of Prediction 4 illustrated in FIG. 34B. Subsequently, payout effects for a line payout for each winning line are implemented based on the stopped symbols in the display.

Prediction 5 is selected at a given probability in the case where a free game trigger is not established but the determined payout is a high payout, which is not less than 20 times of BETs; accordingly, the player can feel expectation for a very high payout when seeing the effects.

Hereinabove, predictive effects implementation processing for predictive effects of Prediction 1 to Prediction 5 has been described. As obvious from the configuration of the predictive effects lottery table in FIG. 11A, predictive effects may not be implemented even if a free game trigger is established (for example, in the case of Table D or Table E) or even if a middle payout or a high payout is determined (for example, in the case of Table B or Table C). Accordingly, the player can feel expectation for free games when seeing predictive effects and further, even when not seeing predictive effects, can feel expectation for a big benefit, so that the player can enjoy widely-varied games without losing interest.

<Number-of-Free-Games Lottery Effects>

Next, with reference to FIGS. 36A to 45, number-of-free-games lottery effects in starting free games are described. The number-of-free-games lottery effects display determining the number of free games by serially adding the numbers of games determined by lotteries.

FIGS. 36A to 45 (except for FIGS. 42B and 44B) are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects.

Figure 36A:
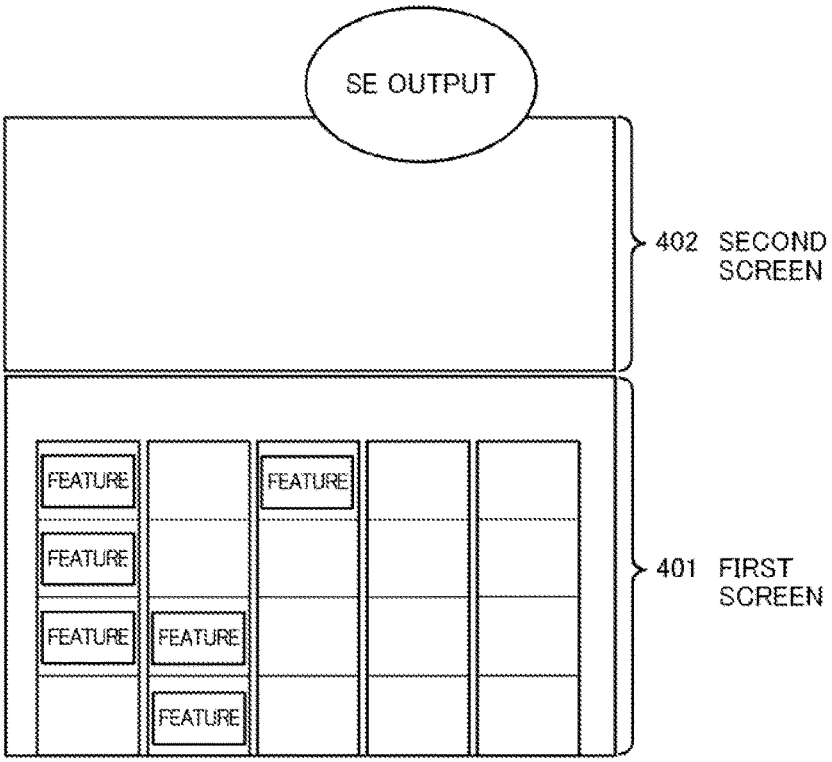
FIGS. 36A and 36B are views for illustrating number-of-free-games lottery effects in starting free games.
Figure 36B:
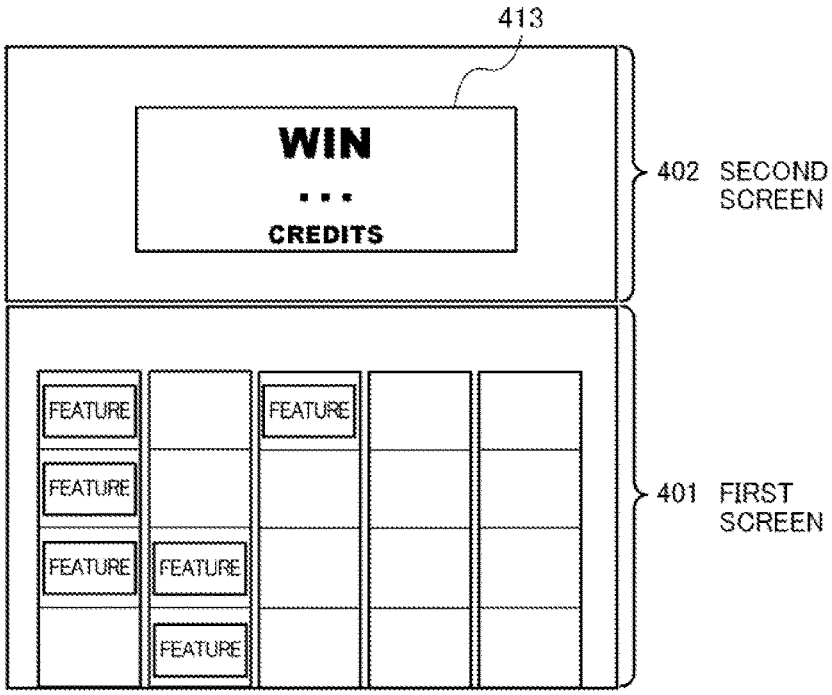

As illustrated in FIG. 36A, when at least one feature symbol appears on each of the first reel, the second reel, and the third reel in a normal game to establish a free game trigger, the speaker 112 outputs sound effects (SE). Subsequently, the second screen 402 displays a WIN sign 413 to notify the player of addition of credits as illustrated in FIG. 36B. In this example, six feature symbols are displayed so that the bonus payout is one according to the payout table in FIG. 10B. The WIN sign 413 indicates the gained credits calculated by taking account of BETs and by adding line payouts, if any. The WIN sign 413 can indicate the gained credits by increment indication which counts up the credits from zero to the number of gained credits one by one on the display. The player can skip this increment indication by pressing a specific button to change the display to the next phase.

This display control illustrated in FIGS. 36A and 36B is performed in, for example, the payout effects implementation processing of the main control processing illustrated in FIG. 15. The subsequent display control illustrated in FIGS. 37A to 45 is performed in the free-game-starting effects implementation processing of the free game processing illustrated in FIG. 22.

Figure 37A:
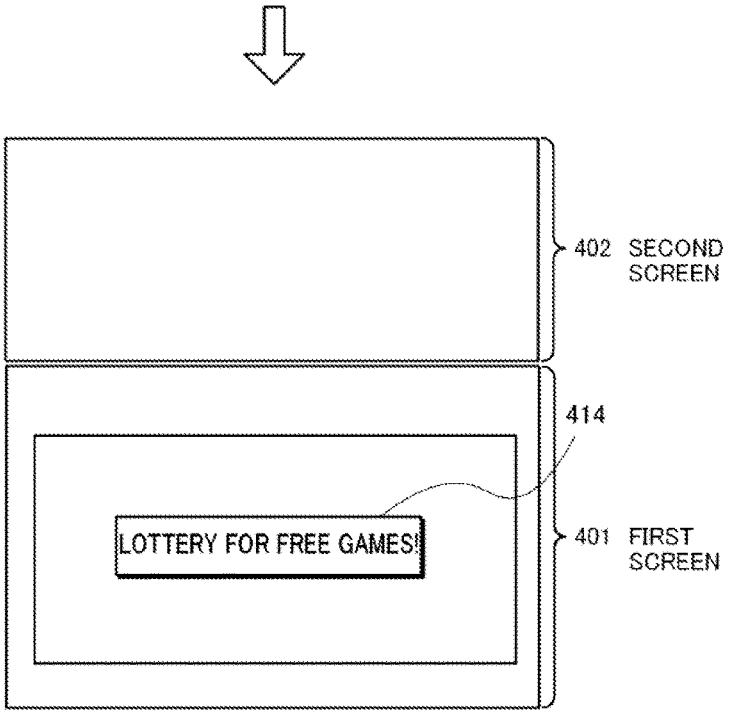
FIGS. 37 A and 37B are views for illustrating number-of-free-games lottery effects in starting free games.
Figure 37B:
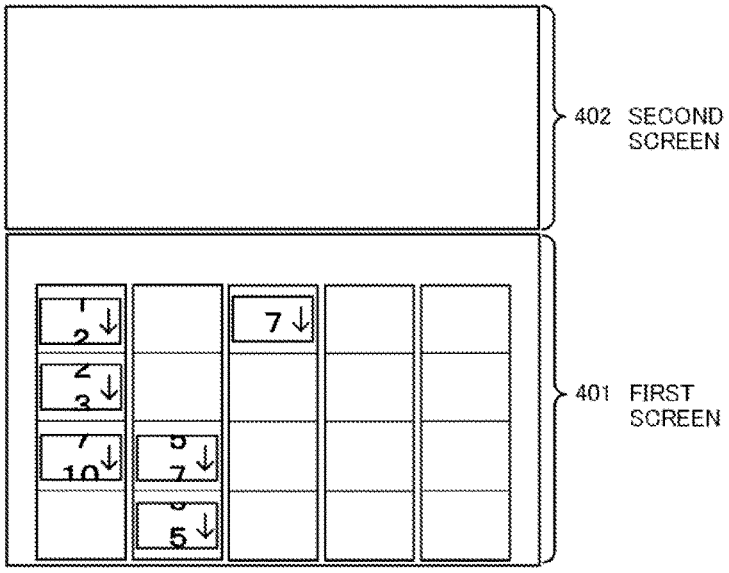

Next, the symbol display region 4 displays an introductory message 414 for starting free games, for example, "LOTTERY FOR FREE GAMES!" as illustrated in FIG. 37A. Thereafter, in each frame displaying a feature symbol involving the free game trigger (for example, each symbol appearing on the first reel, the second reel, and the third reel) in the symbol display region 4, figures indicating the numbers of games (candidate numbers of games associated with the feature symbol, which are 1, 2, 3, 5, 7, and 10 in this example) are rotationally displayed according to the corresponding spin table as illustrated in FIG. 37B.

For example, after the figures indicating the numbers of free games are scrolled downward for a predetermined time, the scrolling is stopped to show one of the figures determined by lottery. Although this section has provided an example of displaying a lottery where the figures indicating the numbers of free games are scrolled, the lottery can be displayed in various ways, such as by horizontally scrolling the figures, or by popping up figures rotating by animation one by one.

The number of free games for each feature symbol has already been determined by the number-of-free-games determination processing in the free game processing illustrated in FIG. 22; the spin table is determined depending on the number of games determined for the feature symbol. The spin table lottery table for number-of-free-games lottery in FIG. 12B determines (by lottery) the spin table to be used depending on the number of free games determined for the feature symbol; in accordance with the determined spin table, spinning figures are displayed at the place of the feature symbol.

For example, when the number of free games for a feature symbol is determined by lottery to be 5, determination of the spin table to be used for the feature symbol results in Table 4 at 60% probability or Table 5 at 40% probability in accordance with the spin table lottery table for number-of-free-games lottery. Each of Table 1 to Table 6 is a table defining the manner of spin of figures and the specifics of the effects at the place of the feature symbol.

Upon completion of the lottery for the number of free games for each feature symbol, the number of free games is indicated at the place of each feature symbol as the result of the lottery on the feature symbol. The feature symbols involving the free game trigger (the symbols indicating the number of free games in FIG. 38A) are distinguished from the other symbols by being enclosed by a frame or indicated brightly to make it clear that the symbols relate to the number of free games. Furthermore, a total number-of-free-games display region 415 for displaying the total number of free games is provided on the upper part of the first screen 401.

Figure 38A:
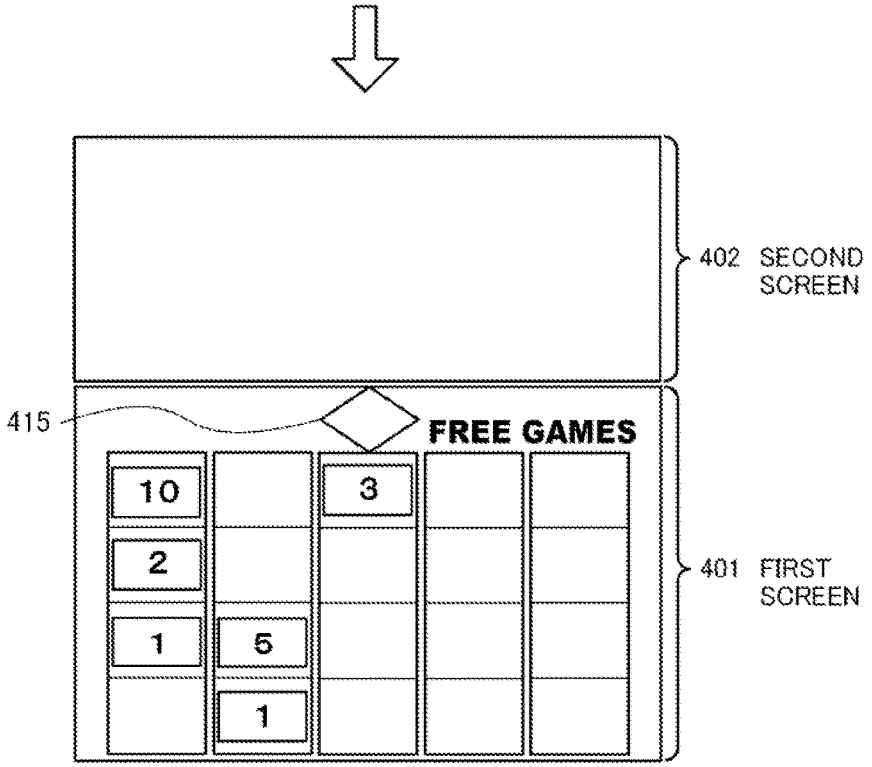
FIGS. 38 A and 38B are views for illustrating number-of-free-games lottery effects in starting free games.
Figure 38B:
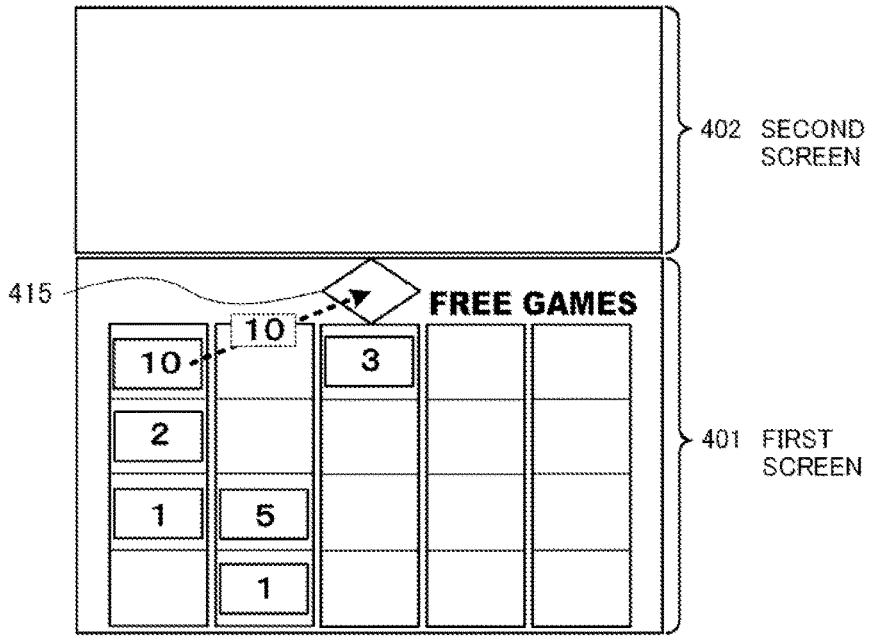
Figure 39A:
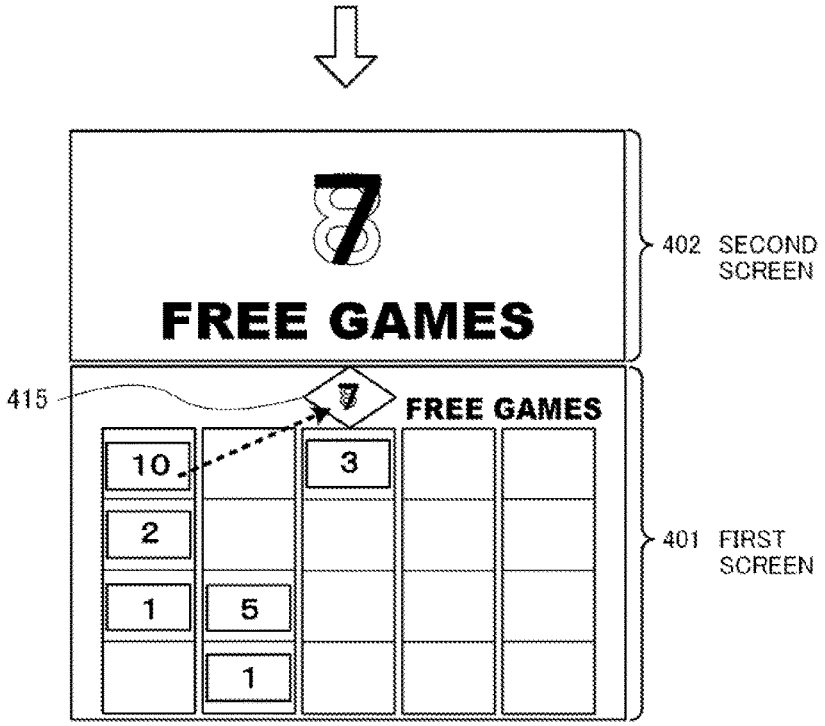
FIGS. 39 A and 39B are views for illustrating number-of-free-games lottery effects in starting free games.

Subsequently, as illustrated in FIG. 38B, the number of free games for each feature symbol is cumulatively added and the total is indicated in the total number-of-free-games display region 415. First, for the feature symbol in the upper region of the first reel, effects by animation (figure transfer animation) is implemented in which the number of free games "10" moves to the total number-of-free-games display region 415. Subsequently, as illustrated in FIG. 39A, effects (increment indication) are implemented to the total number-of-free-games display region 415 in which the number is counted up one by one from "1" to "10". Synchronously with this incrementing, the second screen 402 displays the number being incremented.

Figure 39B:
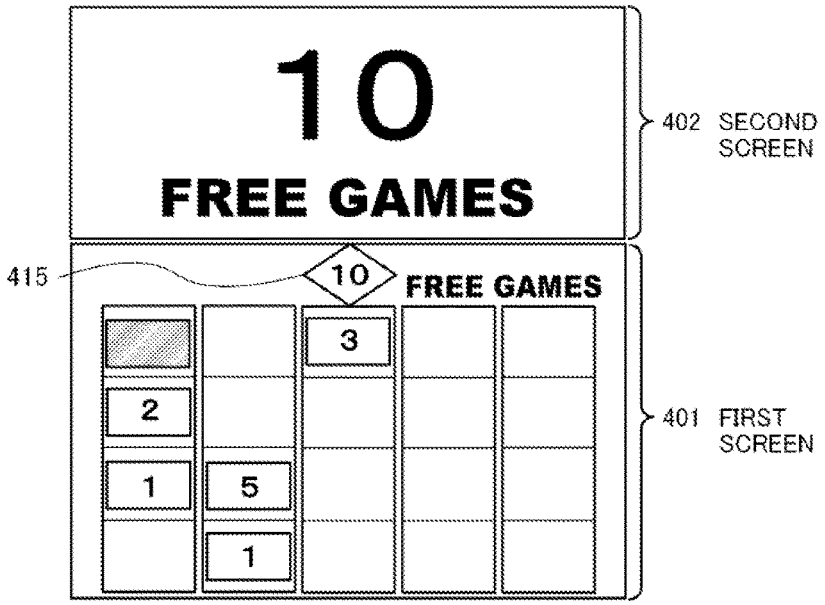

Eventually, as illustrated in FIG. 39B, the total number-of-free-games display region 415 indicates "10" and the second screen 402 indicates "10 FREE GAMES". Simultaneously, the indication of the feature symbol associated with this number of free games "10" is changed to be indistinctive, for example, by changing the color into gray.

The speed of incrementing the number of free games is controlled in accordance with the incrementing speed management table illustrated in FIG. 13A. The incrementing speed management table defines the incrementing speed per game depending on the number of free games to be added, although the example of FIG. 13A specifies eight frames (approximately 0.13 seconds) regardless of the number of free games to be added. Accordingly, in incrementing the number of free games up to 10, incrementing is performed in eight frames (approximately 0.13 seconds) per game and is completed in approximately 1.33 seconds for the number of free games of 10. Regarding the second feature symbol, the figure transfer animation to transfer the number of free games to the total number-of-free-games display region 415 is requested when the number of free games×8 frames has passed since the start of the figure transfer animation for the first feature symbol. It is obvious that the incrementing speed management table may be configured to vary the incrementing speed depending on the number of free games to be added.

During the increment indication, sound effects may be output with reference to the incrementing sound control table illustrated in FIG. 13B. The incrementing sound control table defines sound effect files to be used to output sound effects depending on the number of free games (increased cumulatively). For example, while the number of free games is being incremented from 0 to 9, File A is used as the sound effect file; when the number of free games reaches 10, File B is used as the sound effect file. Changing the sound effect depending on the number of free games provides realistic effects to the player, for example, by outputting cheerful tone music for a larger number of free games to provide a larger benefit.

Figure 40A:
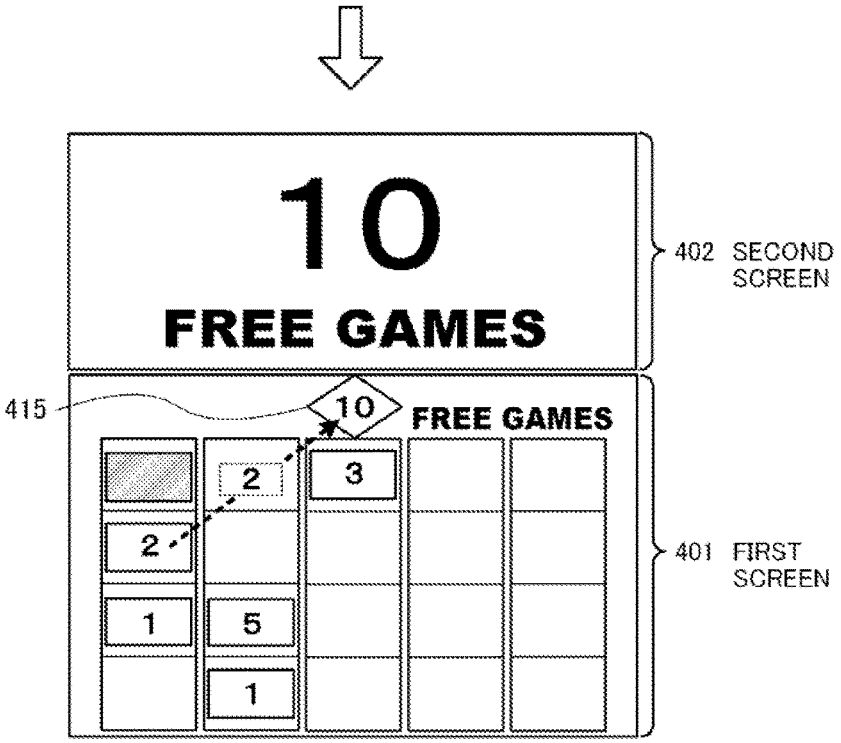
FIGS. 40 A and 40B are views for illustrating number-of-free-games lottery effects in starting free games.
Figure 40B:
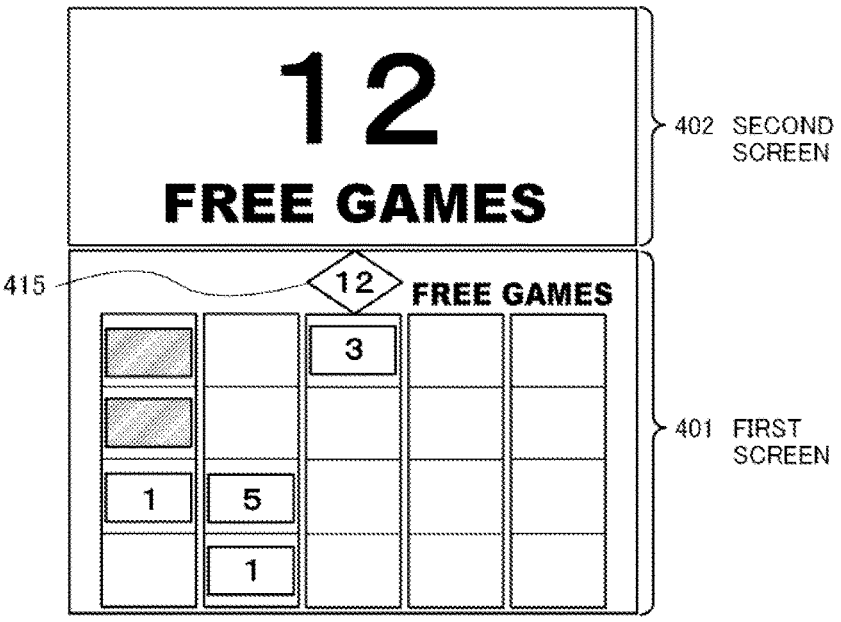

Next, as illustrated in FIG. 40A, effects by animation is implemented to the feature symbol in the upper central region of the first reel, in which the number of free games "2" moves to the total number-of-free-games display region 415. Subsequently, through the same incrementing as illustrated in FIG. 39A, the total number-of-free-games display region 415 displays "12" and the second screen 402 indicates "12 FREE GAMES" as illustrated in FIG. 40B. Simultaneously, the indication of the feature symbol associated with this number of free games "2" is changed to be indistinctive, for example, by changing the color into gray.

In this way, the numbers of free games for the feature symbols are successively added; the order of feature symbols for the addition is controlled by the order management table illustrated in FIG. 12A. In the example of the order management table in FIG. 12A, the addition is conducted from the upper region (the first row) of the first reel, the upper central region (the second row) of the first reel, the lower central region (the third row) of the first reel, and the lower region (the fourth row) of the first reel in this order. Subsequently, addition is conducted from the upper region to the lower region of the second reel, from the upper region to the lower region of the third reel, from the upper region to the lower region of the fourth reel, and from the upper region to the lower region of the fifth reel in this order. If no feature symbol appears at the corresponding place, the addition at the place is skipped.

Figure 41A:
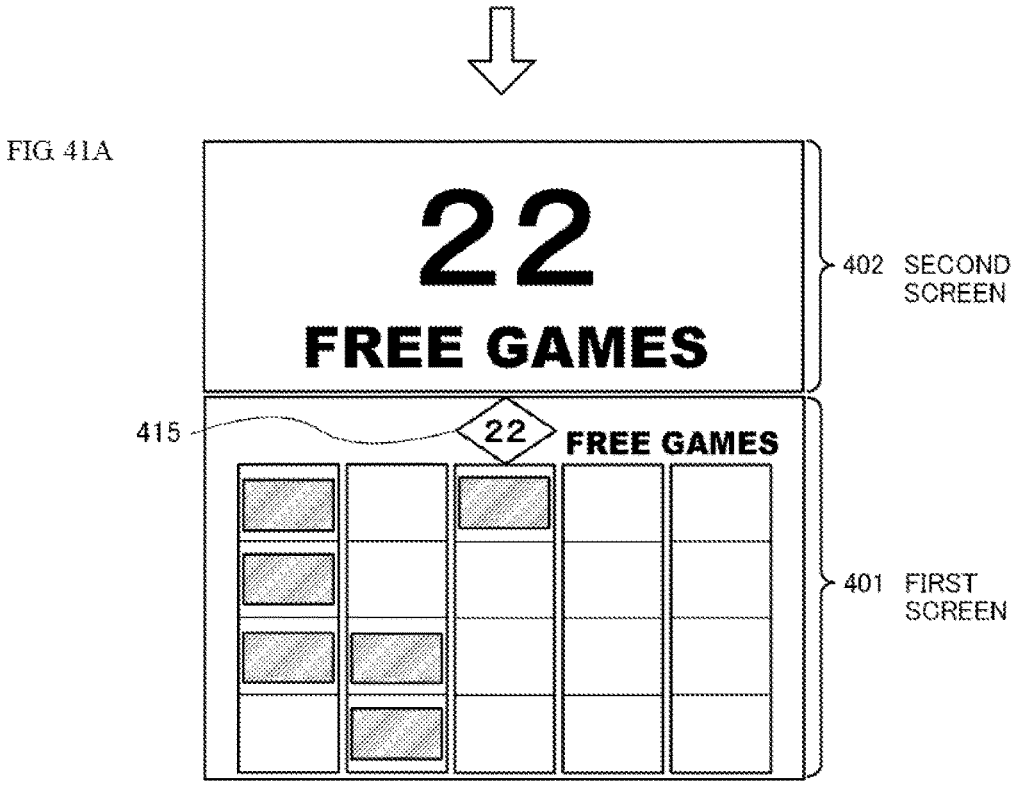
FIGS. 41 A and 41B are views for illustrating number-of-free-games lottery effects in starting free games.

When the addition of the number of free games is completed for all the feature symbols, the total number-of-free-games display region 415 indicates "22" and the second screen 402 indicates "22 FREE GAMES" as illustrated in FIG. 41A. The indication of all the feature symbols has been changed to be indistinctive, for example, by changing the color into gray.

Figure 41B:
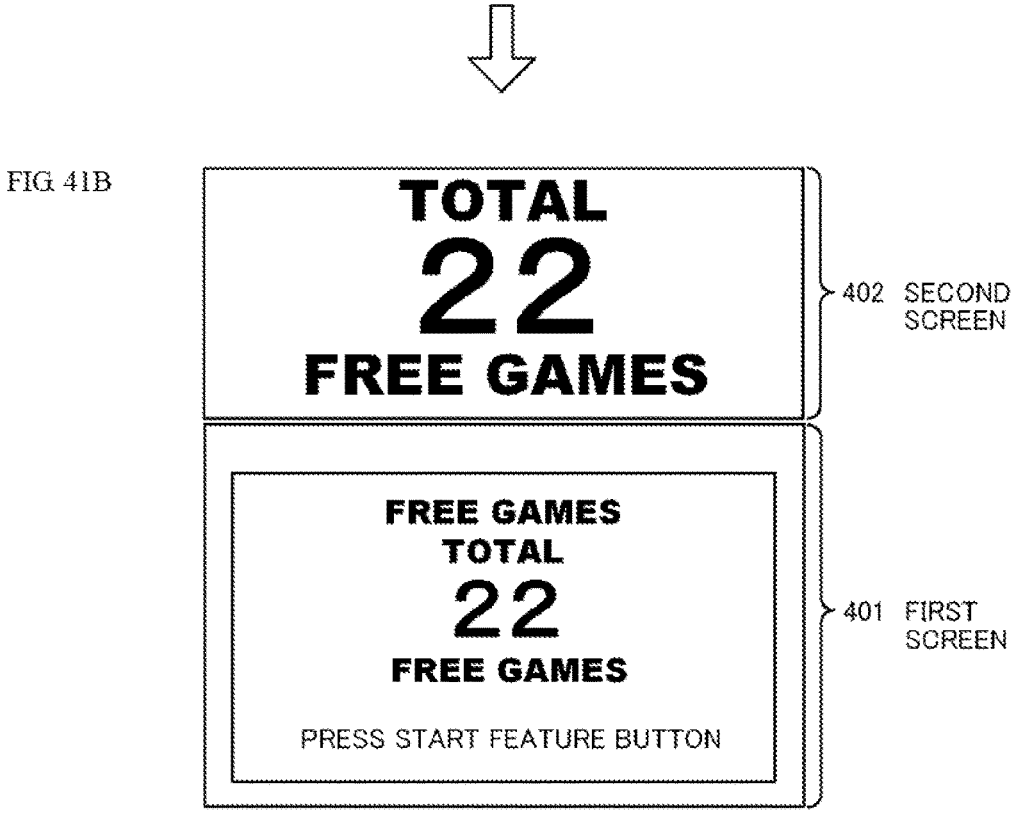

Next, as illustrated in FIG. 41B, the second screen 402 displays "TOTAL 22 FREE GAMES" and the first screen 401 displays a message "FREE GAMES, TOTAL 22 FREE GAMES, PRESS START FEATURE BUTTON".

Figures 42A, 42B:
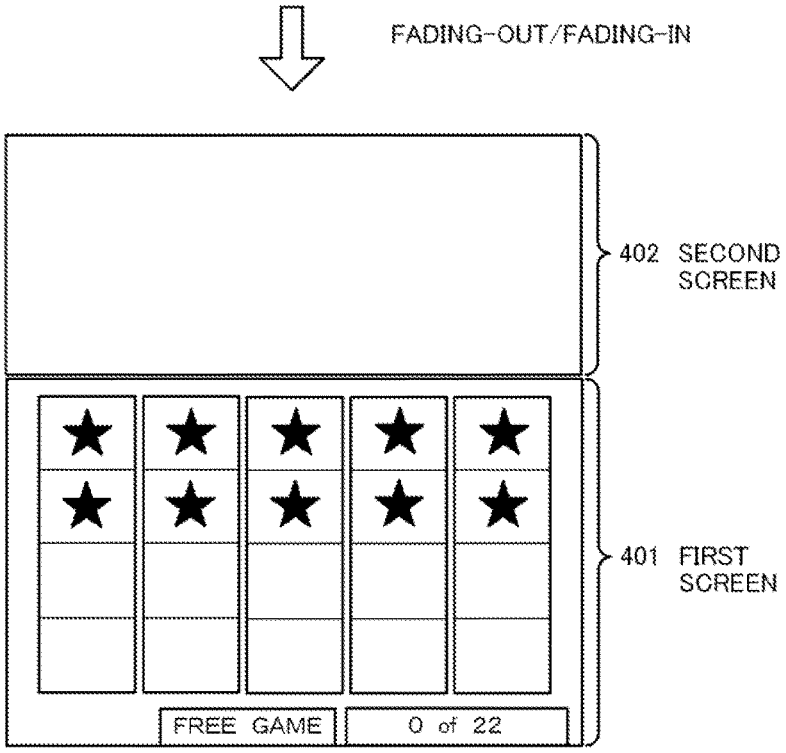
FIGS. 42 A and 42B are views for illustrating top symbol addition effects in starting free games.

At this phase, when the player presses the START FEATURE button assigned to a specific button, the display is changed to the one illustrated in FIG. 42A through graphic effects of fading out and fading in to implement top symbol addition effects. FIG. 42A illustrates a state where the reels are positioned to add top symbols. The same state denoted with code numbers is as illustrated in FIG. 42B.

In free games, the first reel is provided with top symbols (BLACK symbols) consecutively arranged from the code number=84 to the code number=109 as illustrated in FIGS. 6A to 7B; in FIG. 42A, the last two consecutive top symbols (BLACK symbols) are shown in the upper region and the upper central region on the first reel. Likewise, the second reel is provided with top symbols (BLACK symbols) consecutively arranged from the code number=112 to the code number=137 as illustrated in FIGS. 6A to 7B; in FIG. 42A, the last two consecutive top symbols (BLACK symbols) are shown in the upper region and the upper central region on the second reel. The same applies to the third reel, the fourth reel, and the fifth reel to show the top symbols at the same positions.

Figure 43:
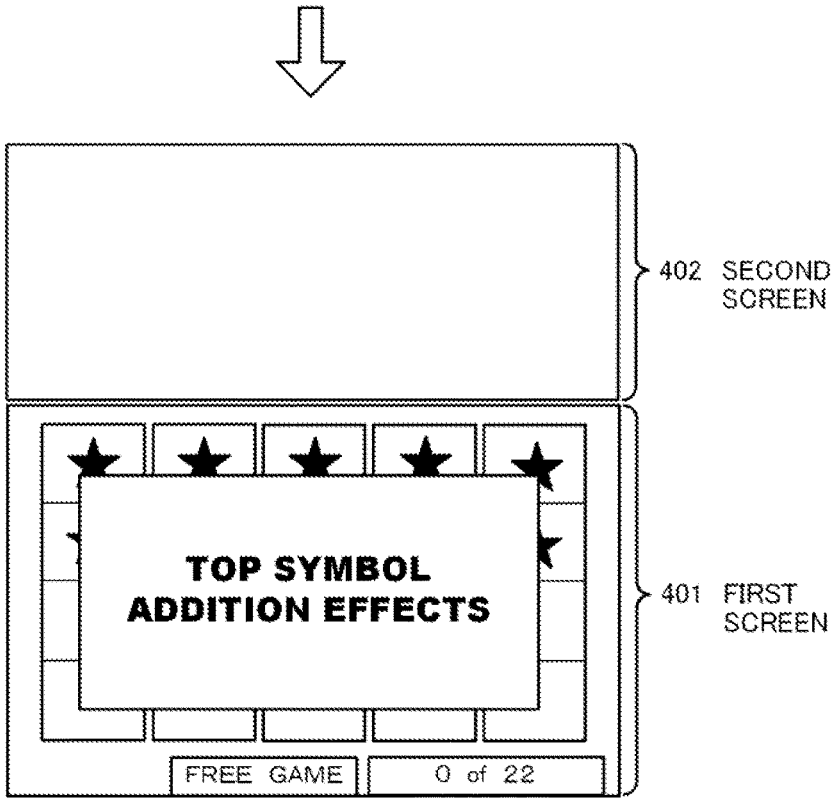
FIG. 43 is a view for illustrating top symbol addition effects in starting free games.

Next, the display is changed to the state illustrated in FIG. 43; top symbol addition effects are implemented to the symbol display region 4 of the first screen 401. If the player presses the SPIN button during the implementation of the effects, fast-forwarding of the effects can be started.

Figures 44A, 44B:
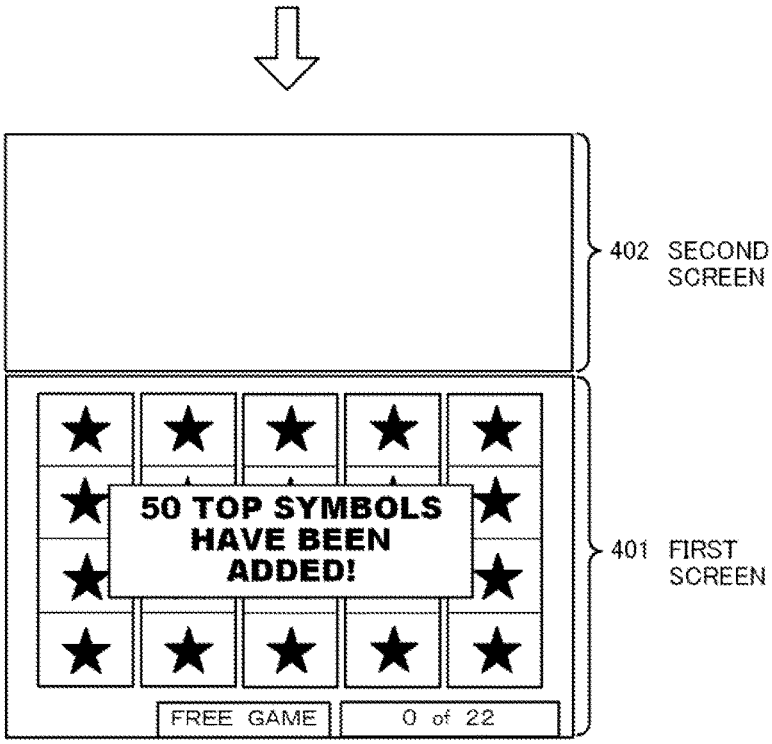
FIGS. 44A and 44B are views for illustrating top symbol addition effects in starting free games.
Figure 45:
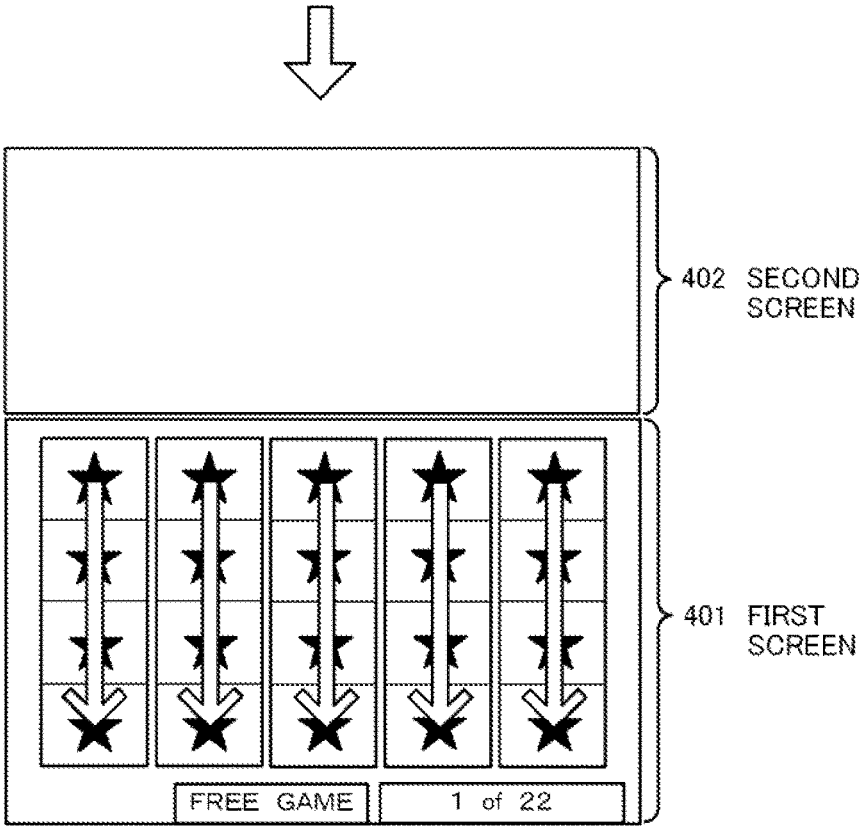
FIG. 45 is a view for illustrating top symbol addition effects in starting free games.

Subsequently, the display is changed to the state where all the reels show top symbols (BLACK symbols) only as illustrated in FIG. 44A. This state denoted with code numbers is as illustrated in FIG. 44B, which indicates that each reel is moved downward by two symbols from the state of FIGS. 42A and 42B. Furthermore, as illustrated in FIG. 44A, the first screen 401 outputs a message after addition of top symbols "50 TOP SYMBOLS HAVE BEEN ADDED!"

The message after addition of top symbols disappears after a predetermined time; symbol arrays starts scrolling from the state where all the reels show only top symbols (BLACK symbols) to start the first spin of the free games.

The top symbol addition effects are merely to display the reels at predetermined stop positions and then display the reels at the positions moved by two symbols. Accordingly, the number of top symbols is not increased internally. However, ten top symbols (BLACK symbols) per reel (50 symbols in total) are substantially increased in the symbol arrays in changing from normal games to free games (refer to FIGS. 4A to 7B). The top symbol addition effects are to inform the player of this substantial increase of top symbols (BLACK symbols).

<Number-of-Free-Games Lottery Effects at Retrigger>

Next, with reference to FIGS. 46A to 48B, number-of-free-games lottery effects at a retrigger are described, in which the number of free games is determined by serially adding the numbers of games determined by lotteries and the determined number is added to the current number of free games in the final phase.

FIGS. 46A to 48B are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects.

Figure 46A:
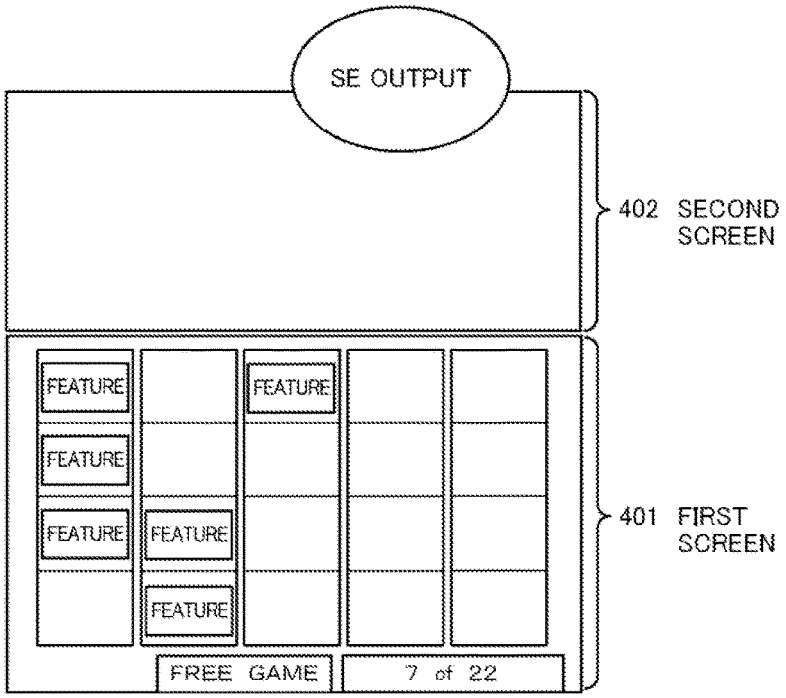
FIGS. 46A and 46B are views for illustrating number-of-free-games lottery effects at a retrigger.

As illustrated in FIG. 46A, when at least one feature symbol appears on each of the first reel, the second reel, and the third reel in a free game to establish a free game trigger (or a retrigger), the speaker 112 outputs sound effects (SE).

Figure 46B:
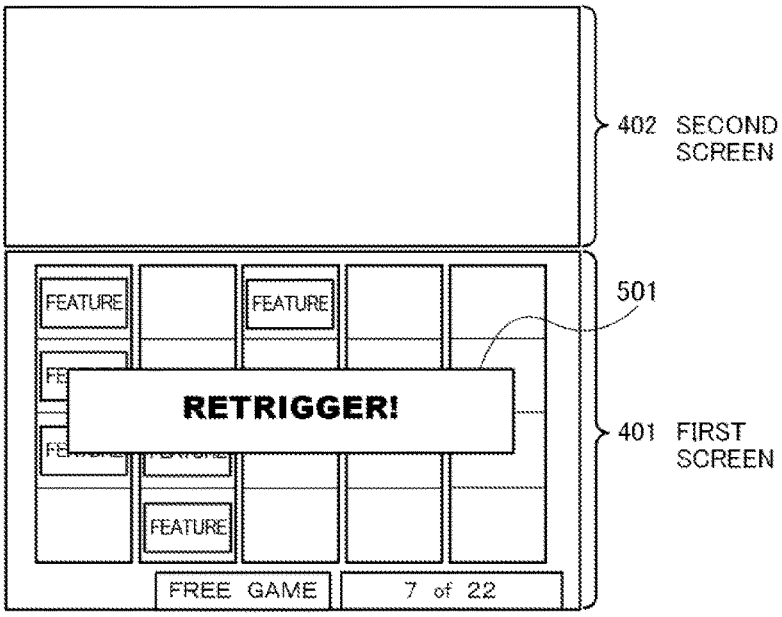

Subsequently, the symbol display region 4 displays a retrigger message 501 "RETRIGGER!" as illustrated in FIG. 46B. Although line payout effects and bonus payout effects are successively implemented, detailed description is omitted in this section. Such display control up to this phase is performed in the payout effects implementation processing of the free game processing illustrated in FIG. 22. The subsequent display control illustrated in FIGS. 46B to 48B is performed in the retrigger effects implementation processing of the free game processing illustrated in FIG. 22.

Figure 47A:
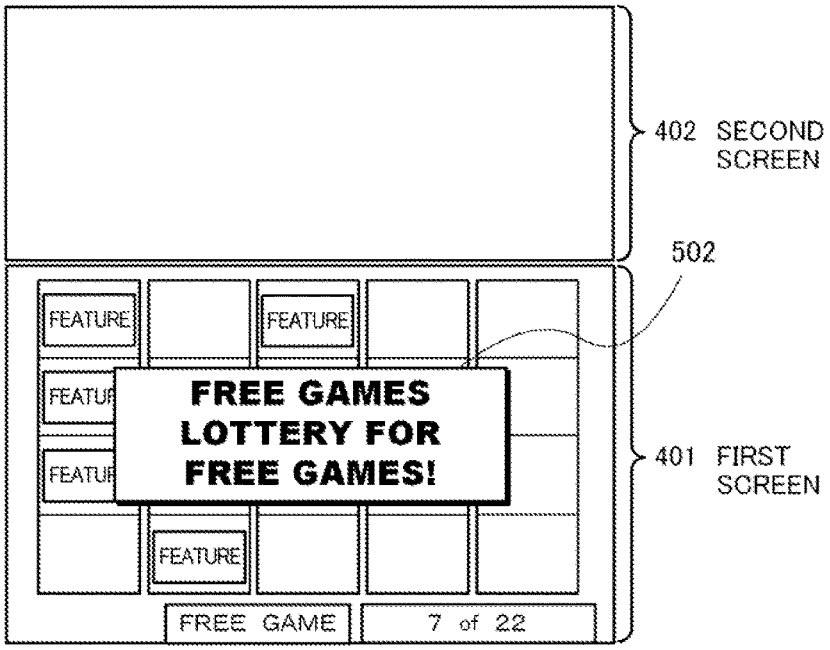
FIGS. 47A and 47B are views for illustrating number-of-free-games lottery effects at a retrigger.
Figure 47B:
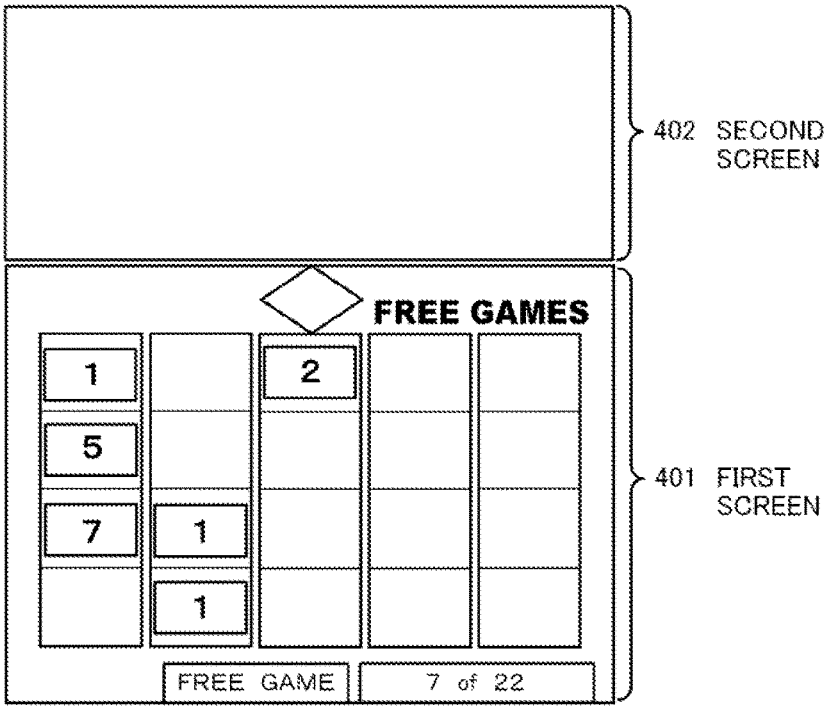

Next, the symbol display region 4 displays a message 502 about the number-of-free-games lottery at a retrigger, for example, "FREE GAMES, LOTTERY FOR FREE GAMES!" as illustrated in FIG. 47A. After the message 502 about the number-of-free-games lottery at a retrigger disappears, the symbol display region 4 starts displaying the performance of conducting a lottery for the number of free games on each feature symbol like at the first trigger and indicates the number of free games determined by the lottery on each feature symbol as illustrated in FIG. 47B.

Figure 48A:
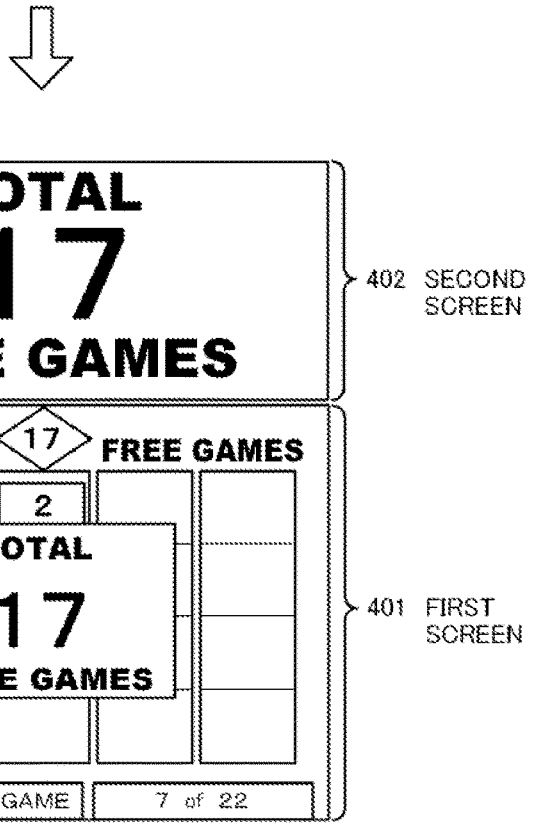
FIGS. 48A and 48B are views for illustrating number-of-free-games lottery effects at a retrigger.

Subsequently, through increment indication of the number of feature games on each feature symbol as done at the first trigger, the second screen 402 displays a message "TOTAL 17 FREE GAMES" and the first screen 401 displays a message "TOTAL 17 FREE GAMES" as illustrated in FIG. 48A. This state is kept for, for example, two seconds. The player may press a specific button to skip to the next display.

Figure 48B:
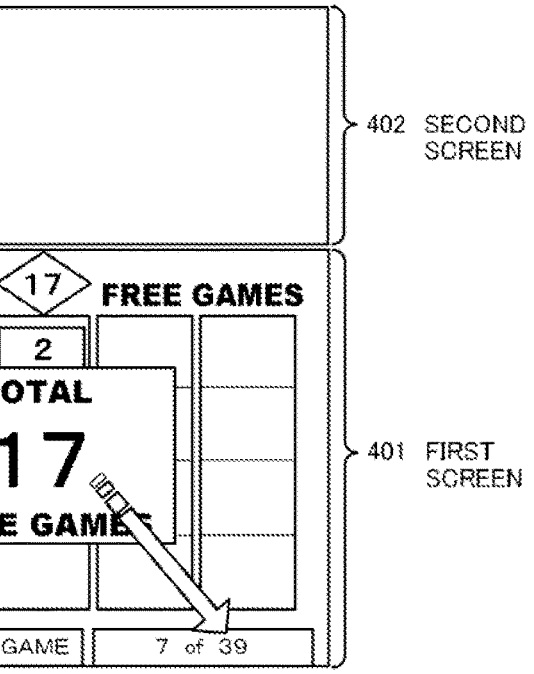

Next, the number of free games acquired at this retrigger is added to the current total number of free games as illustrated in FIG. 48B. In this example, the number of free games acquired at this retrigger is 17, which is added to the total number of free games of 22, so that the new number of free games becomes 39. At this phase, effects by animation may be implemented in which the number of free games (the number of free games acquired at this retrigger) displayed on the first screen 401 moves toward and added to the number of free games (the current total number of free games) shown on the lower right of the first screen 401. Thereafter, the next spin of the free games is started.

<Free-Game-Ending Effects>

Figure 49A:
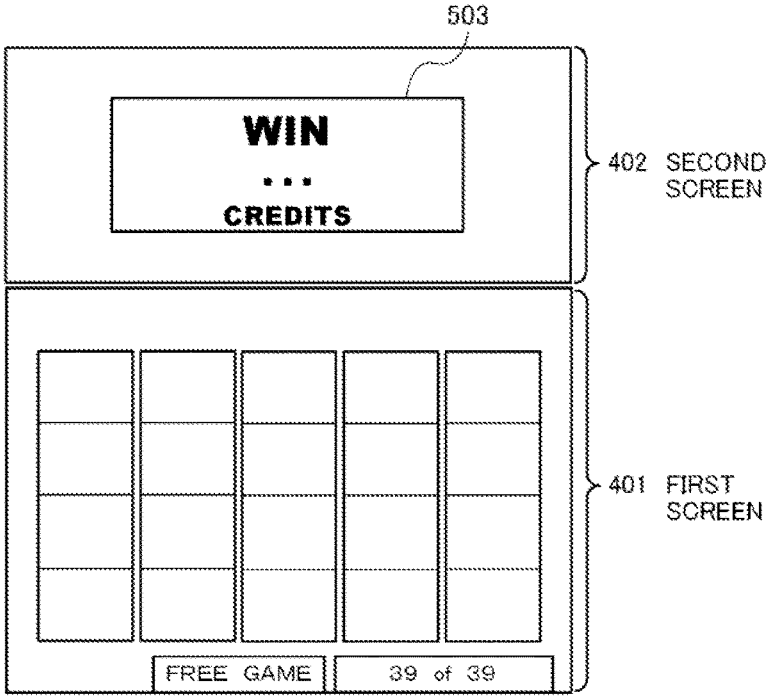
FIGS. 49A and 49B are views for illustrating free-game-ending effects.
Figure 49B:
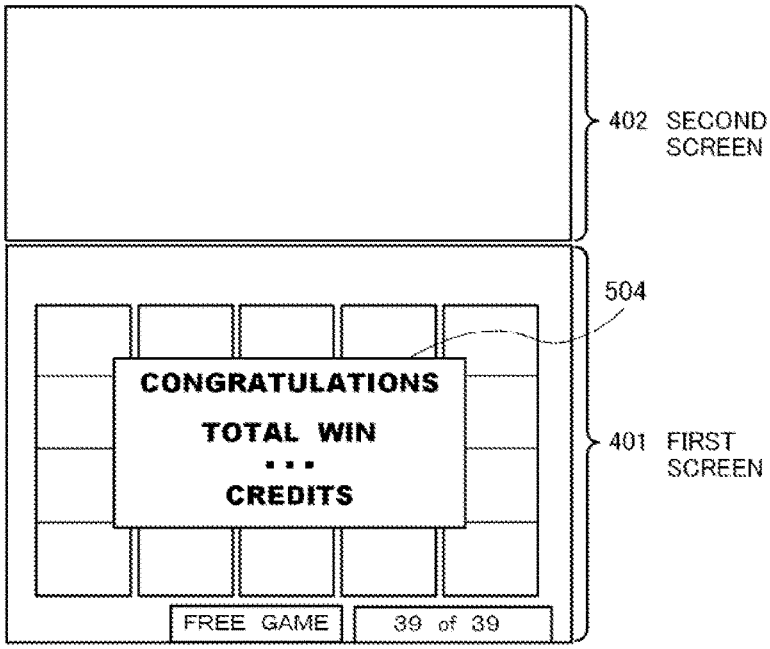

Next, with reference to FIGS. 49A and 49B, free-game-ending effects are described. FIGS. 49A and 49B are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects. This processing is conducted in the free-game-ending effects implementation processing of the free game processing illustrated in FIG. 22.

FIG. 49A illustrates a state in which a WIN sign 503 is displayed during the final spin in the free games. This WIN sign 503 is not displayed if the number of gained credits is zero.

When the WIN sign 503 disappears, a free game total WIN sign 504 appears as illustrated in FIG. 49B. This free game total WIN sign 504 is not displayed if the number of credits gained in the free games is zero. After showing the free game total WIN sign 504, the displays are changed to those of normal games. The display of the free game total WIN sign 504 can be changed variously depending on the number of gained credits, which is described later in detail. When a predetermined time (for example, four seconds) is passed after the display of free game total WIN sign 504, the player can erase the free game total WIN sign 504 by pressing a specific button to proceed to the next operation.

<Effects at Winning in Free Games>

Next, with reference to FIGS. 50A to 52B, effects (WIN effects) when a line payout (win) is gained as a result of a spin in normal games or free games is described. FIGS. 50A to 52B (except for FIG. 50B) are views illustrating specifics of the effects displayed on the upper image display panel 131 and the lower image display panel 141 of the gaming machine according to the embodiment of the present invention. The upper image display panel 131 corresponds to the second screen 402, which displays a game title, advertising slogans, WIN signs of a normal game and a free game, and the like. The lower image display panel 141 corresponds to the first screen 401, which displays a symbol display region 4 for displaying the video reels 3, a variety of guidance, and various video effects. This section describes the effects implemented in a free game by way of example, although these effects are implemented in a normal game as well. The description of the effects for a bonus payout based on the number of feature symbols is omitted.

Figures 50A, 50B:
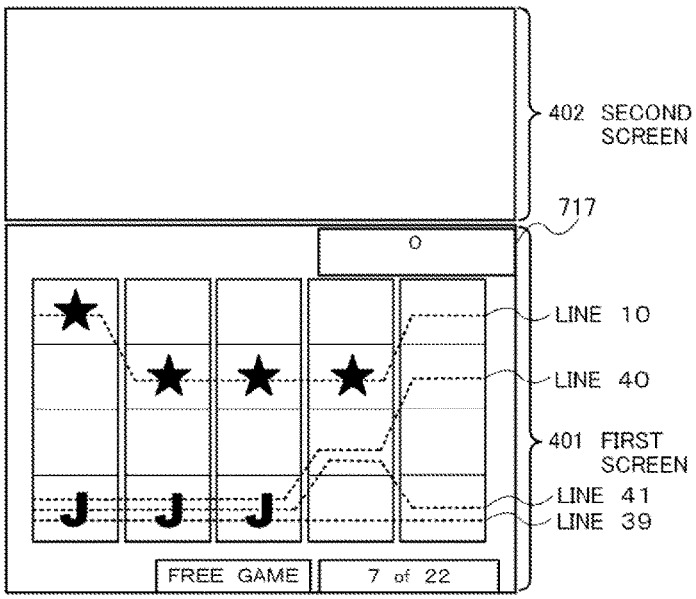
FIGS. 50A and 50B are views for illustrating effects in providing line payouts.

FIG. 50A shows a state of a free game after the video reels are spun and stopped in the symbol display region 4. In FIG. 50A, the symbols denoted by "★" correspond to the BLACK symbols indicated in the payout table of FIG. 10A, the symbols denoted by "J" corresponds to the JACK symbols indicated in the same payout table. The winning lines involving line payouts are denoted by dotted lines. Although FIG. 50A includes dotted lines indicating the winning lines for convenience of explanation, the symbol display region 4 may actually show the dotted lines indicating the winning lines. Alternatively, the cells (on the first to the fourth rows) of the video reels corresponding to the winning lines may be indicated with specific display effects (such as bright display or blinking).

The display can be controlled to select the symbols involving wins in the game among the symbols stopped in the symbol display region 4 and show them by animation or blinking, regardless of the winning line or line number related to the effects. These symbols can be shown by animation and blinking.

As illustrated in FIG. 50A, the winning line denoted by LINE 41 corresponds to the winning line of the pattern 41 (Line No.=41) in the winning line definition table of FIG. 9B, which is the line connecting the fourth row of the first reel, the fourth row of the second reel, the fourth row of the third reel, the third row of the fourth reel, and the fourth row of the fifth reel. In this description, indication of the row numbers of the first reel to the fifth reel (for example, (3, 3, 3, 2, 3)) represent the specifics of the line.

There are a plurality of other winning lines involving line payouts except for the foregoing Line No.=41; in the case of FIG. 50A, 16 winning lines exist in total. FIG. 50B indicates all the winning lines, in which thirteen winning lines are provided for the top symbols of BLACK symbols and three winning lines are provided for JACK symbols. For example, Pattern 10 (Line No.=10) indicates the required number of BLACK symbols=4 and the line payout=25 based on the payout table of FIG. 10A. For the BLACK symbols, the required number=3 and the required number=2 further correspond to a line payout; a plurality of patterns of winning lines (Patterns 12, 13, 34, 4, 5, 6, 9, 11, 14, 15, 16, and 17) correspond to a line payout.

As to the JACK symbols, Patterns 39, 40, and 41 correspond to a line payout and their required numbers of JACK symbols are all three as illustrated in FIG. 50B.

Figure 51A:
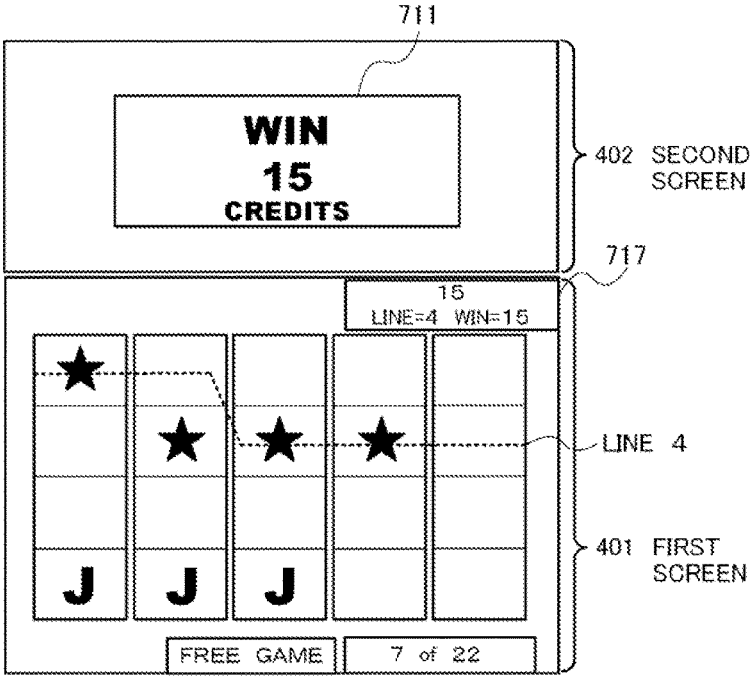
FIGS. 51A and 51B are views for illustrating effects in providing line payouts.

Turning to FIG. 51A, effects at winning (WIN effects) are implemented when a predetermined time has passed after the video reels are spun and stopped in the symbol display region 4 in a free game. For each winning line providing a line payout, a WIN sign 711 is displayed on the second screen 402 and the indication of the WIN meter 717 on the first screen 401 is updated. These serial video effects are implemented by implementing the effects for a scatter WIN first, if applicable, and subsequently implementing the effects for line payouts in ascending order of line number.

FIG. 51A illustrates the state where the effects for the first line payout are being implemented. In FIG. 51A, effects for the smallest line number, Line No.=4 (0, 0, 1, 1, 1) are being implemented. As to this winning line, the required number of BLACK symbols is three and the corresponding payout is 15 (assuming the number of BETs=1 for this winning line); accordingly, 15 credits are to be gained. The WIN sign 711 shows increment indication of the gained credits from 0 to 15. The increment indication in the WIN sign 711 is linked with the indication on the first row of the WIN meter 717 or the indication of the total credits (the number of credits gained in the game cycle); the WIN meter 717 shows incrementing numbers from 0 to 15. The second row of the WIN meter 717 indicates the description of the gained credits: the Line No. of the winning line and a line payout for the line payout being processed.

Figure 51B:
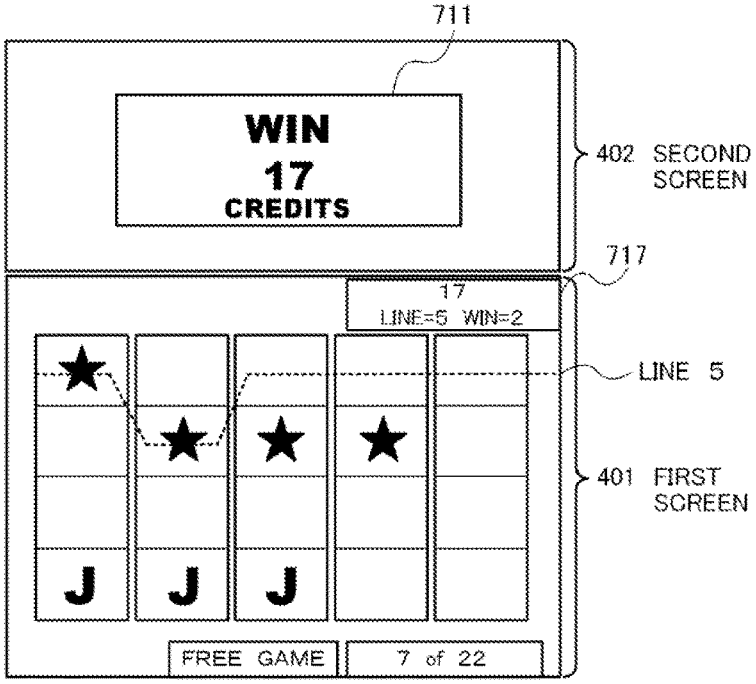

When a predetermined time has passed since the end of increment indication, the WIN sign 711 disappears and the display in FIG. 51A changes to the state shown in FIG. 51B. At this phase, effects for the next Line No.=5 (0, 1, 0, 0, 0) are implemented. As to this winning line, the required number of BLACK symbols is two and the corresponding payout is 2 (assuming the number of BETs=1 for this winning line); accordingly, two credits are to be gained. The WIN sign 711 shows increment indication of the gained credits from 15 to 17 by adding the gained credits of 2. In this example, the WIN sign 711 indicates the accumulated credits (total WINs) gained in the spin; but the WIN sign 711 can be configured to indicate other figures (such as the credits gained in the free games or the credits gained on the winning line being evaluated). The increment indication in the WIN sign 711 is linked with the indication on the first row of the WIN meter 717; the WIN meter 717 shows incrementing numbers from 15 to 17. The second row of the WIN meter 717 indicates the description of the gained credits: the Line No. of the winning line and a line payout for the line payout being processed.

Figure 52A:
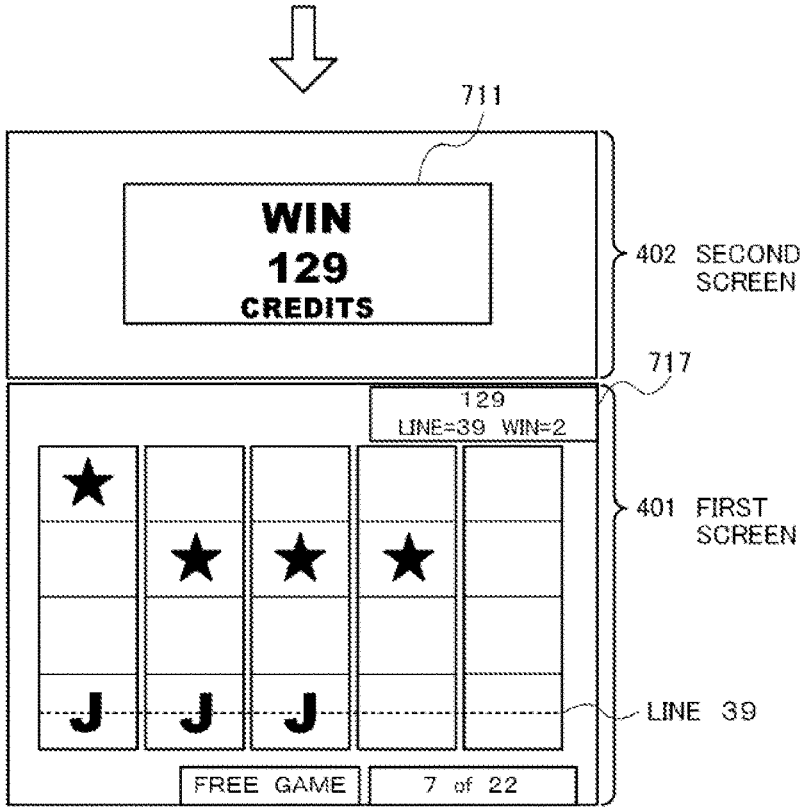
FIGS. 52A and 52B are views for illustrating effects in providing line payouts.

Through implementation of the effects for a plurality of winning lines, the effects for the Line No.=39 (3, 3, 3, 3, 3) are eventually implemented as illustrated in FIG. 52A. As to this winning line, the required number of JACK symbols is 3 and the corresponding payout is 2 (assuming the number of BETs=1 for this winning line); accordingly, two credits are to be gained. The WIN sign 711 shows increment indication of the gained credits from 127 to 129. The increment indication in the WIN sign 711 is linked with the indication on the first row of the WIN meter 717; the WIN meter 717 shows incrementing numbers from 127 to 129. The second row of the WIN meter 717 indicates the description of the gained credits: the Line No. of the winning line and a line payout for the line payout being processed.

Figure 52B:
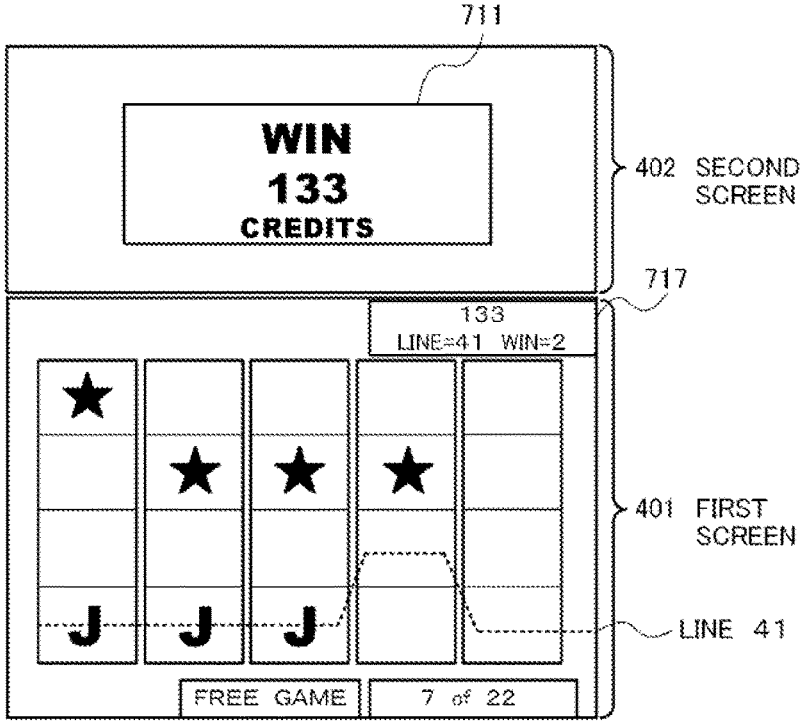

Next, the effects for the winning line of Line No.=40 are implemented and the effects for the last winning line of Line No.=41 are implemented. That is to say, the effects for Line No.=41 (3, 3, 3, 2, 3) are implemented as illustrated in FIG. 52B. As to this winning line, the required number of JACK symbols is 3 and the corresponding payout is 2 (assuming the number of BETs=1 for this winning line); accordingly, two credits are to be gained. The WIN sign 711 shows increment indication of the gained credits from 131 to 133.

The increment indication in the WIN sign 711 is linked with the indication on the first row of the WIN meter 717; the WIN meter 717 shows incrementing numbers from 131 to 133. The second row of the WIN meter 717 indicates the description of the gained credits: the Line No. of the winning line and a line payout for the line payout being processed.

When the increment indication in the WIN sign 711 and the increment indication of the total credits indicated on the first row of the WIN meter 717 are finished, the total credits (total WINs) gained in the spin may be indicated on the third row of the WIN meter 717. Simultaneously, the winning lines may be serially indicated (for example, by dotted lines along the winning lines, bright display, or blinking) in ascending order of line number.

This example controls the effects at winning in a free game to be implemented in ascending order of line number to serially indicate the gained credits. However, the effects may be implemented in various orders, for example, descending order of the amount of payout or order of relation of symbol type.

<Effects in Displaying WIN Sign in Free Games>

Next, with reference to FIGS. 53A to 53D, effects for the WIN sign 711 displayed on the second screen 402 are described. This section describes the effects implemented in a free game by way of example, although these effects are implemented in a normal game as well.

The gaming machine of the present embodiment controls the display of the WIN sign 711 in different ways depending on the total credits (total WINs) gained in a spin. For example, the way (effects) of displaying the WIN sign 711 varies depending on the number of total WINs as illustrated in FIG. 53A. Specifically, when the total WINs are less than 20 times of total BETs, the WIN sign 711 is displayed as a silver sign; when the total WINs are not less than 20 times and less than 50 times of total BETs, the WIN sign 711 is displayed as a gold sign and coins (coin-shaped figures) are displayed around the sign; when the total WINs are not less than 50 times of total BETs, the WIN sign 711 is displayed as a gold sign and coins (coin-shaped figures) and bills (bill-shaped figures) are displayed around the sign. The total BETs are obtained by multiplying the number of BETs specified by the player by the number of winning lines.

FIG. 53B illustrates the WIN sign 711*a* displayed when the total WINs are less than 20 times of total BETs. The number of total WINs is 130, which is less than 20 times of the total BETs (in this example, the number of BETs (1)×the number of winning lines (50)×20=1000), so that the WIN sign 711*a* is displayed as a silver sign.

FIG. 53C illustrates the WIN sign 711*b* displayed when the total WINs are not less than 20 times and less than 50 times of total BETs. The number of total WINs is 1456, which is not less than 20 times of the total BETs (in this example, the number of BETs (1)×the number of winning lines (50)×20=1000) and less than 50 times of the total BETs (in this example, the number of BETs (1)×the number of winning lines (50)×50=2500), so that the WIN sign 711*b* is displayed as a gold sign surrounded by coins.

Figure 53D:
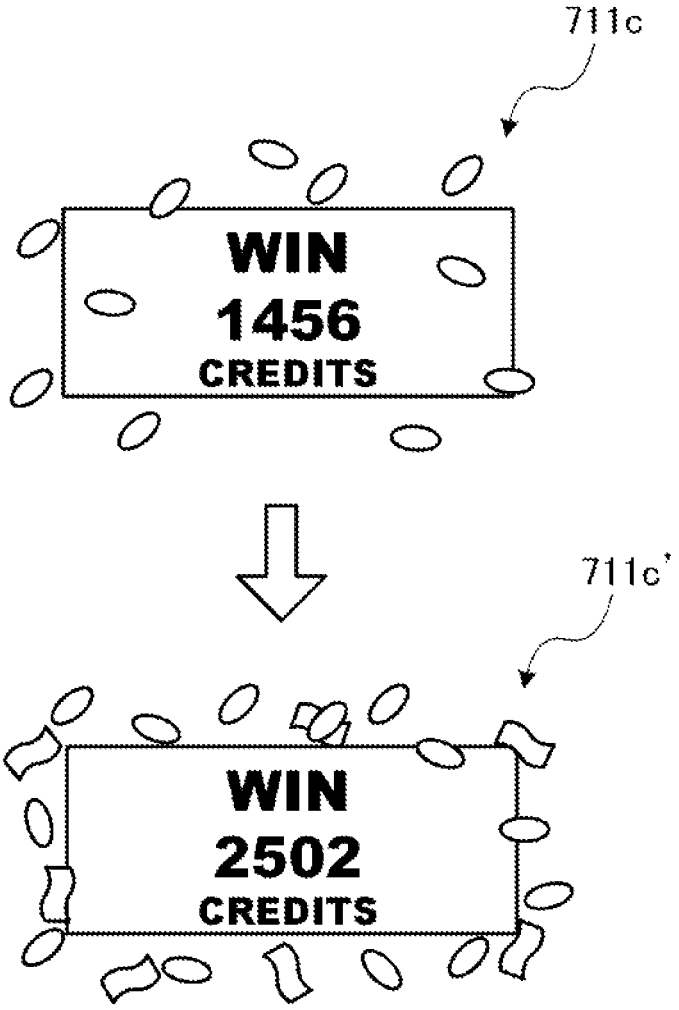

FIG. 53D illustrates the WIN sign 711*c* displayed when the total WINs are not less than 50 times of total BETs. In this example, total WINs are indicated incrementally. A gold WIN sign 711*c* surrounded by coins is changed to a gold WIN sign 711*c*' surrounded by coins and bills when the number exceeds 2500. The final number of total WINs is 2502, which is not less than 50 times of the total BETs (in this example, the number of BETs (1)×the number of winning lines (50)×50=2500).

Although this example controls the display of the WIN sign differently depending on the relation between the total WINs and the total BETs, the display of the WIN sign may be controlled differently depending on the relation between the number of credits gained in the game, spin, or other cycle and the number of BETs specified by the player.

<Effects for Increment Indication in WIN Sign>

Figure 55:
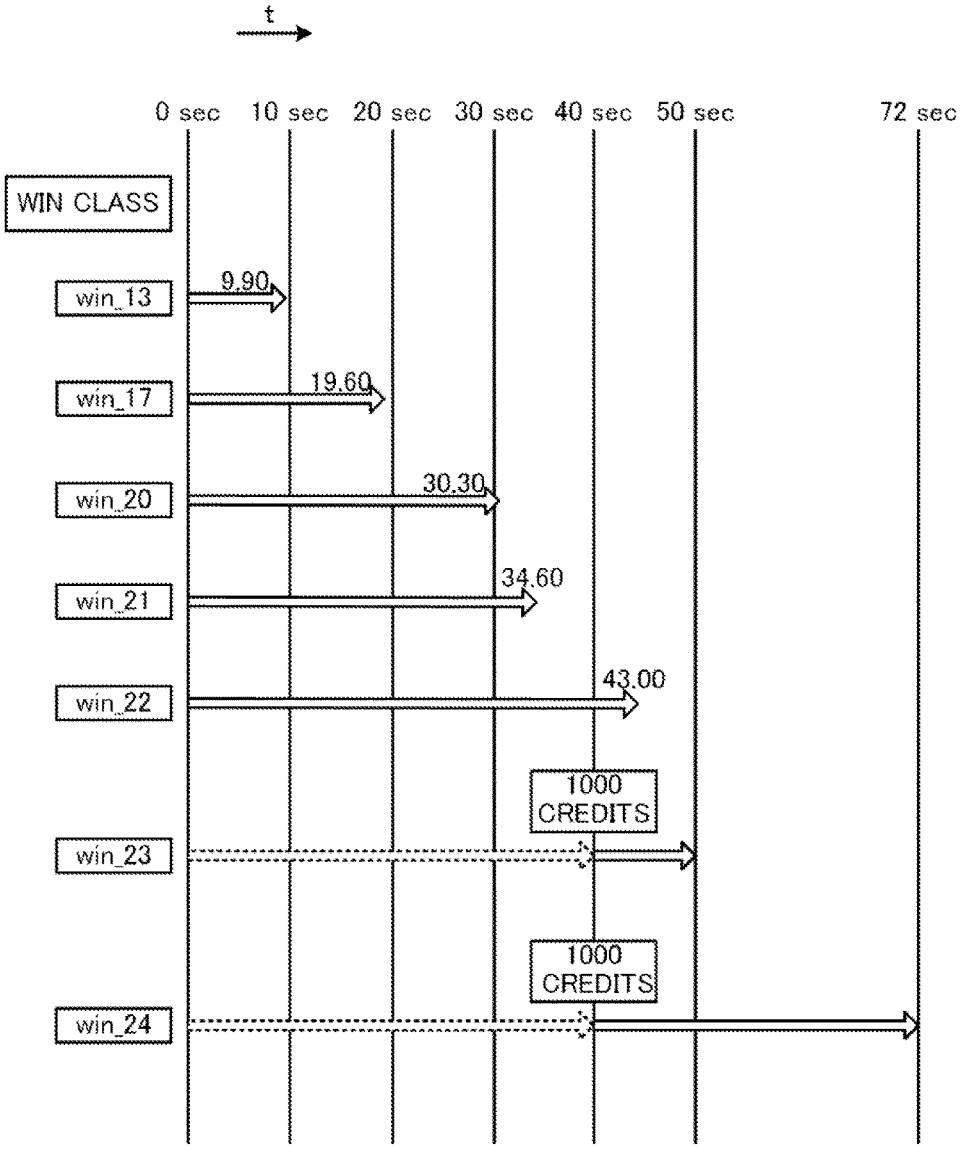
FIG. 55 is a view for illustrating times of increment indication in the WIN sign.

Next, with reference to FIGS. 54 and 55, effects for increment indication in the WIN sign 711 are described. FIG. 54 illustrates a WIN sign incrementing speed management table for the WIN sign 711. The increment indication in the WIN sign 711 changes the incrementing speed in accordance with the settings in the WIN sign incrementing speed management table in FIG. 54, that is, based on the criterion how many times more the total WINs are than total BETs.

For example, in the case of a WIN class "win_1" where total WINs are less than 0.1 times of total BETs, the incrementing speed is controlled so that increment indication of credits corresponding to the total WINs is completed in 0.50 seconds. Each increment is basically made at an equal time interval obtained by dividing the 0.50 seconds by the number of increments.

FIG. 55 illustrates a detailed time chart of increment indication. For example, in the case of a WIN class "win_13" where total WINs are not less than 4 times and less than 5 times of total BETs, the incrementing speed is controlled so that incrementing indication of credits corresponding to the total WINs is completed in 9.90 seconds. In the case of a WIN class "win_17" where total WINs are not less than 8 times and less than 10 times of total BETs, the incrementing speed is controlled so that incrementing indication of the credits corresponding to the total WINs is completed in 19.60 seconds. In the case of a WIN class "win_20" where total WINs are not less than 15 times and less than 20 times of total BETs, the incrementing speed is controlled so that increment indication of the credits corresponding to the total WINs is completed in 30.30 seconds. In the case of a WIN class "win_21" where total WINs are not less than 20 times and less than 30 times of total BETs, the incrementing speed is controlled so that increment indication of the credits corresponding to the total WINs is completed in 34.60 seconds. In the case of a WIN class "win_22" where total WINs are not less than 30 times and less than 40 times of total BETs, the incrementing speed is controlled so that increment indication of the credits corresponding to the total WINs is completed in 43.00 seconds.

In the case of a WIN class "win_23" where total WINs are not less than 40 times and less than 50 times of total BETs, the incrementing speed is controlled so that increment indication of the credits corresponding to the total WINs is completed in 50.00 seconds. In this case, however, until the credits of the total WINs reach 20 times of the total BETs (for example of this case, the number of BETs (1)×the number of winning lines (50)×20=1000), incrementing is conducted at the speed of counting ½ of the total BETs (for example of this case, the number of BETs (1)×the number of winning lines (50)/2=25) per second and thereafter, conducted at the equal time intervals obtained by dividing the remaining seconds by the number of remaining increments.

That is to say, in the case of WIN class "win_23", incrementing for the first 1000 credits is conducted by 40.00 seconds and incrementing for the remaining credits (1000 to 1499 credits) is conducted by 50.00 seconds at equal intervals.

In the case of a WIN class "win_24" where total WINs are not less than 50 times of total BETs, the incrementing speed is controlled so that increment indication of the credits corresponding to the total WINs is completed in 72.00 seconds. In this case, however, until the credits of the total WINs reach 20 times of the total BETs (for example of this case, the number of BETs (1)×the number of winning lines (50)×20=1000), incrementing is conducted at the speed of counting ½ of the total BETs (for example of this case, the number of BETs (1)×the number of winning lines (50)/2=25) per second and thereafter, conducted at the equal time intervals obtained by dividing the remaining time in seconds by the number of remaining increments. That is to say, in the case of WIN class "win_24", incrementing for the first 1000 credits is conducted by 40.00 seconds and incrementing for the remaining credits (more than 1000 credits) is conducted by 72.00 seconds at equal intervals.

Although this example controls the incrementing speed in the WIN sign to be changed depending on the relation between the total WINs and the total BETs, the incrementing speed in the WIN sign may be controlled to be changed depending on the relation between the number of credits gained in the game, spin, or other cycle and the number of BETs specified by the player. Although the increment indication in the WIN sign 711 is linked with the increment indication in the WIN meter 717, the increment indication in the WIN meter 717 can be made at a different incrementing speed.

<Effects at Winning Line Payout with Special Symbol>

Figure 56A:
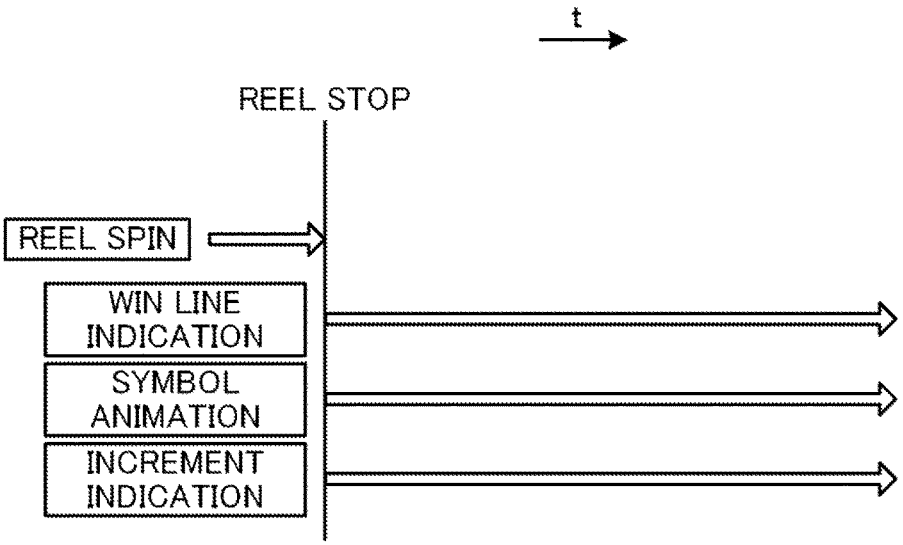
FIGS. 56A and 56B are views for illustrating effects at winning a line payout with special symbols.
Figure 56B:
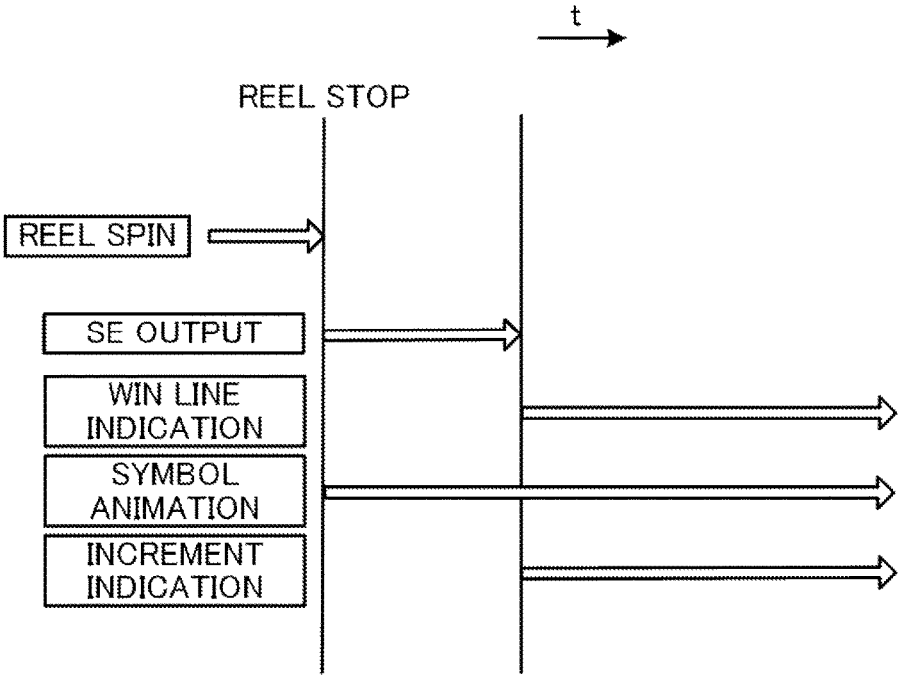

Next, with reference to FIGS. 56A and 56B, effects at winning a line payout with three or more special symbols appearing along a winning line in a normal game or a free game is described.

FIG. 56A illustrates timing of performances in the case of winning a line payout with symbols other than the special symbol. As illustrated in FIG. 56A, when the spinning of the video reels 3 are stopped in the symbol display region 4, description of the credits (the winning line and the corresponding payout) gained in the spin is indicated on the second row of the WIN meter 717 displayed on the first screen 401, animation of the symbols involving the win is displayed, and increment indication of the credits is displayed in the WIN sign 711 on the second screen 402 and on the first row of the WIN meter 717 on the first screen 401.

FIG. 56B illustrates timing of performances in the case of winning a line payout with special symbols (where three or more special symbols appear on a winning line). As illustrated in FIG. 56B, when the spinning of the video reels 3 are stopped in the symbol display region 4, the sound effects (SE) for the winning pattern is outputted and animation of the symbols involving the win is displayed. After a predetermined time, the output of the sound effects is stopped and simultaneously, description of the credits (the winning line and the corresponding payout) gained in the spin is indicated on the second row of the WIN meter 717 displayed on the first screen 401, and increment indication of the credits is displayed in the WIN sign 711 on the second screen 402 and on the first row of the WIN meter 717 on the first screen 401. The animation of the symbols is kept to be played.

Figure 57A:
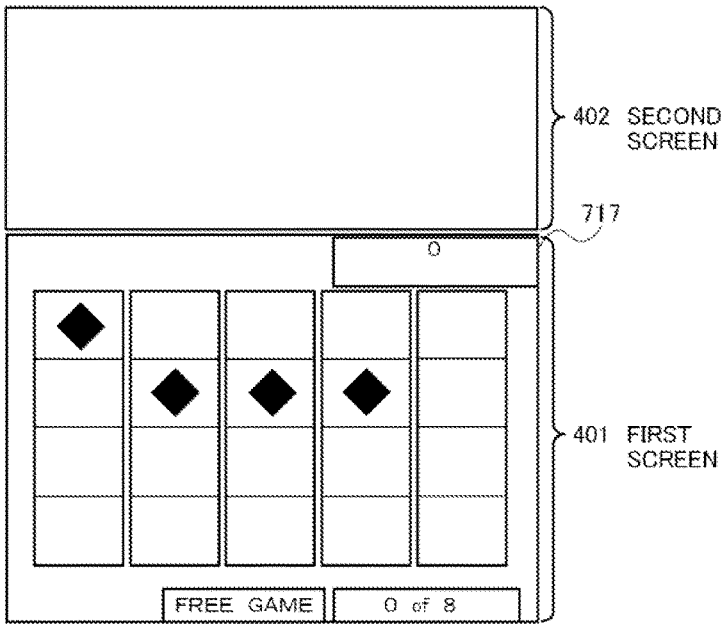
FIGS. 57A and 57B are views for illustrating effects at winning a line payout with special symbols.
Figure 57B:
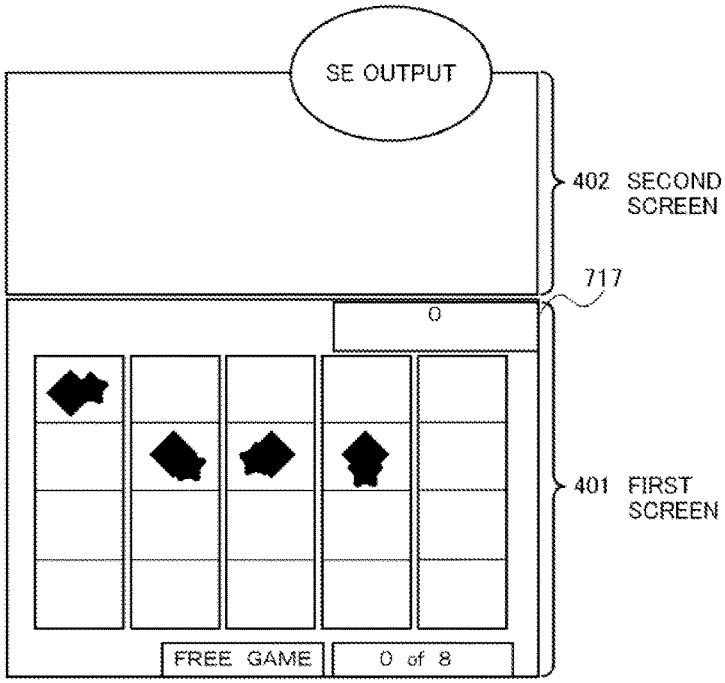
Figure 58:
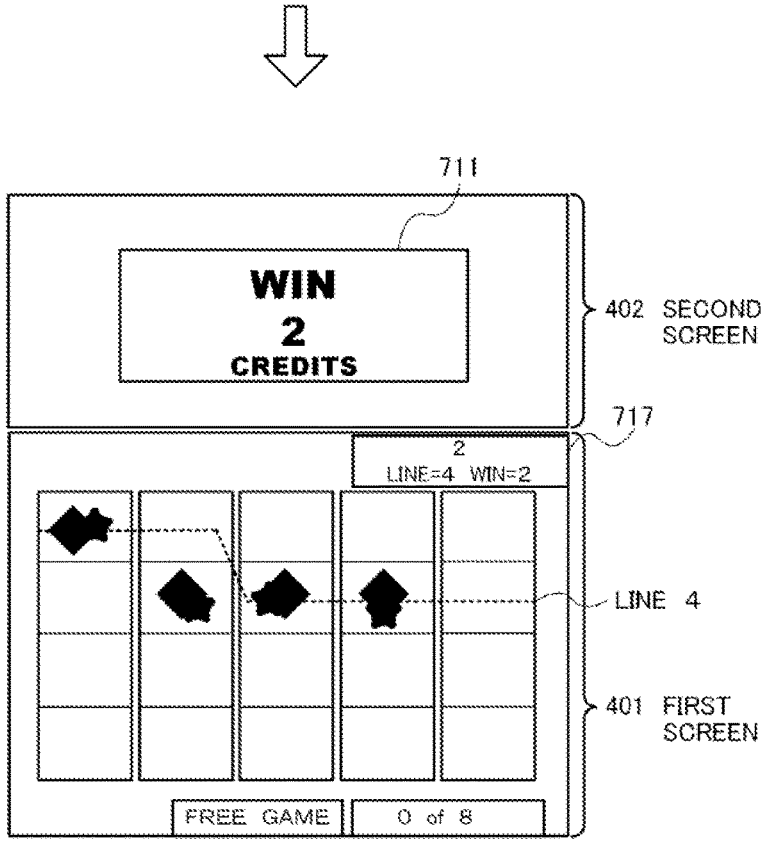
FIG. 58 is a view for illustrating effects at winning a line payout with special symbols.

FIGS. 57A to 58 illustrate the performances to be played in the case of winning a line payout with the special symbols. FIG. 57A illustrates the state where four special symbols (★) are displayed when spinning of the video reels are stopped in the symbol display region 4. FIG. 57B illustrates the state where the sound effects are outputted and the special symbols (★) are displayed by animation.

After a predetermined time, as illustrated in FIG. 58, the output of the sound effects is stopped, and simultaneously, the description of the credits (winning line=4, corresponding payout=2) gained by the spin is indicated on the second row of the WIN meter 717 on the first screen 401 and further incrementing indication of the credits (from 0 to 2) is displayed in the WIN sign 711 on the second screen 204 and on the first row of the WIN meter 717 on the first screen 401. The animation of the symbols is kept to be displayed.

<Effects at Appearance of Three or More Feature Symbols>

Next, with reference to FIGS. 59 to 61B, effects at appearance of three or more feature symbols in a normal game or a free game is described. It is to be noted that feature symbols shown on the first reel, the second reel, and the third reel in a free game becomes a retrigger, as described above.

Figure 59:
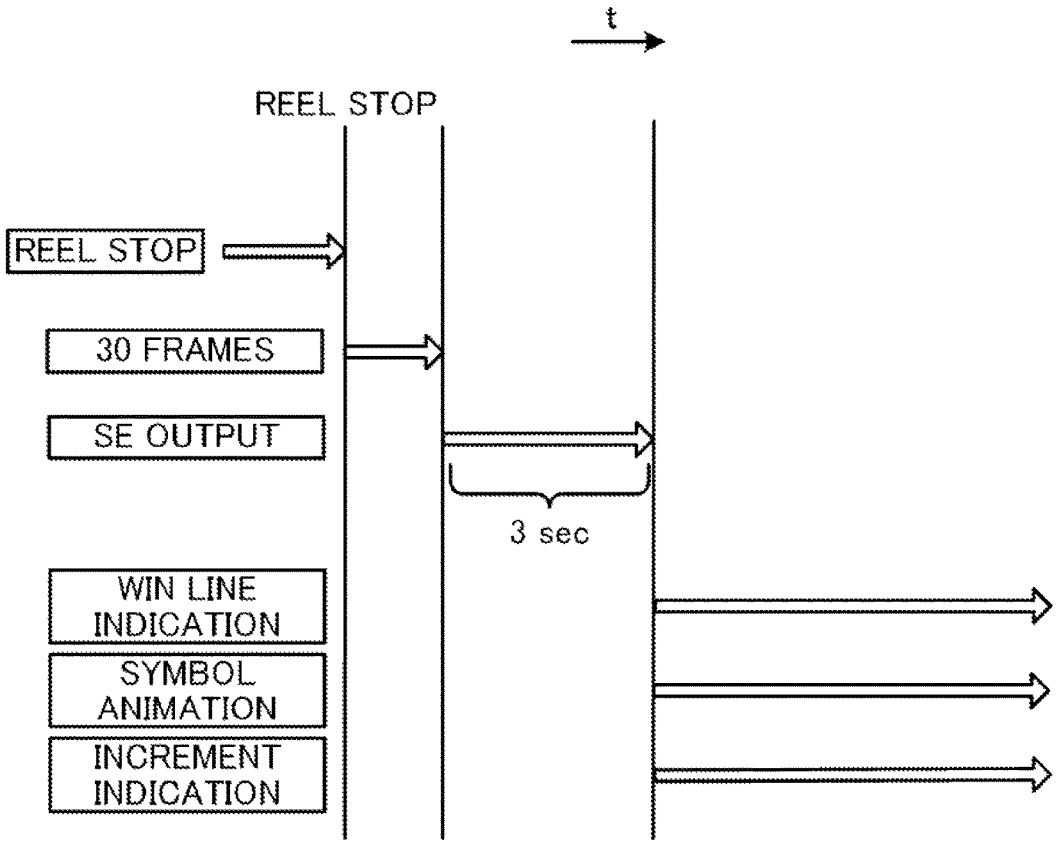
FIG. 59 is a view for illustrating effects at appearance of three feature symbols.

FIG. 59 illustrates timing of performances in the case where three or more feature symbols appear in a free game. As illustrated in FIG. 59, after 30 frames (which is, a time corresponding to the time in which a symbol array moves by 30 frames) have passed since the spinning of the video reels 3 are stopped in the symbol display region 4, the sound effects (SE) are outputted for a predetermined time (for example, three seconds). Then, description of the credits (the winning line and the corresponding payout) gained in the spin is indicated on the second row of the WIN meter 717 displayed on the first screen 401, animation of the symbols involving the win is displayed, and increment indication of the credits is displayed in the WIN sign 711 on the second screen 402 and on the first row of the WIN meter 717 on the first screen 401.

Figure 60A:
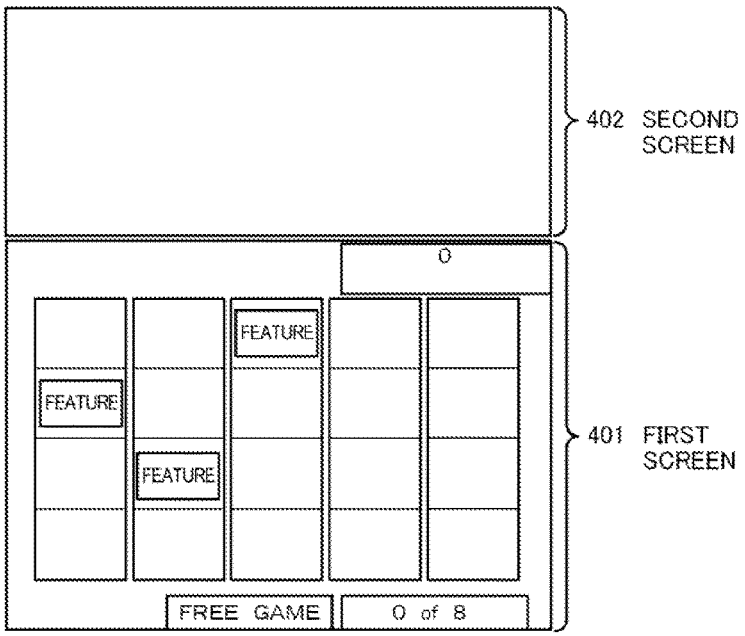
FIGS. 60A and 60B are views for illustrating effects at appearance of three feature symbols.
Figure 60B:
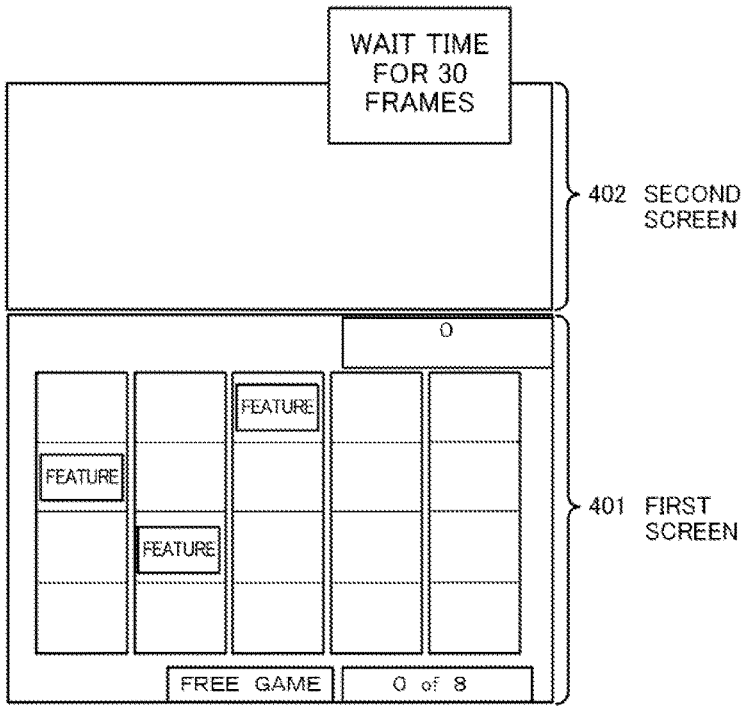

FIGS. 60A to 61B illustrate the effects in the case where three or more feature symbols appear in a free game. FIG. 60A illustrates the state where three feature symbols are displayed when spinning of the video reels are stopped in the symbol display region 4. FIG. 60B illustrates the state where a waiting time for 30 frames is provided and the first screen 401 and the second screen 402 suspend the display. FIG. 61A illustrates the state where sound effects are outputted after the waiting time of 30 frames. The first screen 401 and the second screen 402 still suspend the display.

Figure 61A:
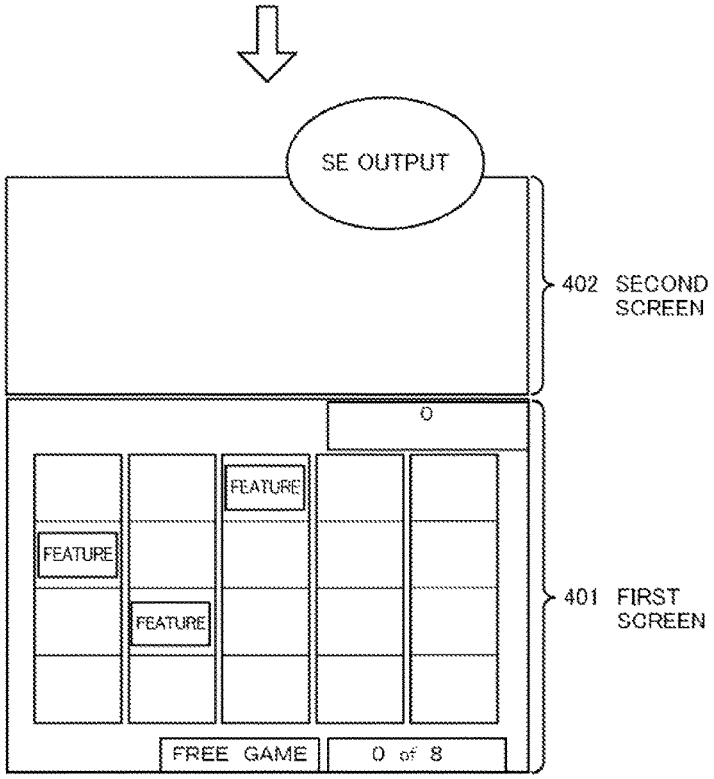
FIGS. 61A and 61B are views for illustrating effects at appearance of three feature symbols.
Figure 61B:
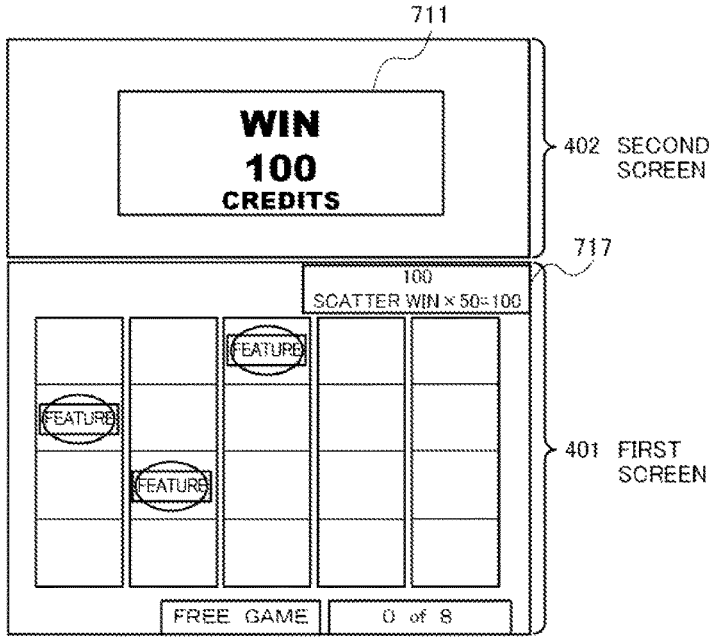

After three seconds of outputting the sound effects, as illustrated in FIG. 61B, the sound effects are stopped and simultaneously, the description of the credits (SCATTER WIN, corresponding payout=2×50) gained by the spin is indicated on the second row of the WIN meter 717 displayed on the first screen 401, animation of the symbols involving the win is displayed, and further increment indication of the credits (from 0 to 100) is displayed in the WIN sign 711 on the second screen 204 and on the first row of the WIN meter 717 on the first screen 401.

<Effects at Big WIN>

Figure 62:
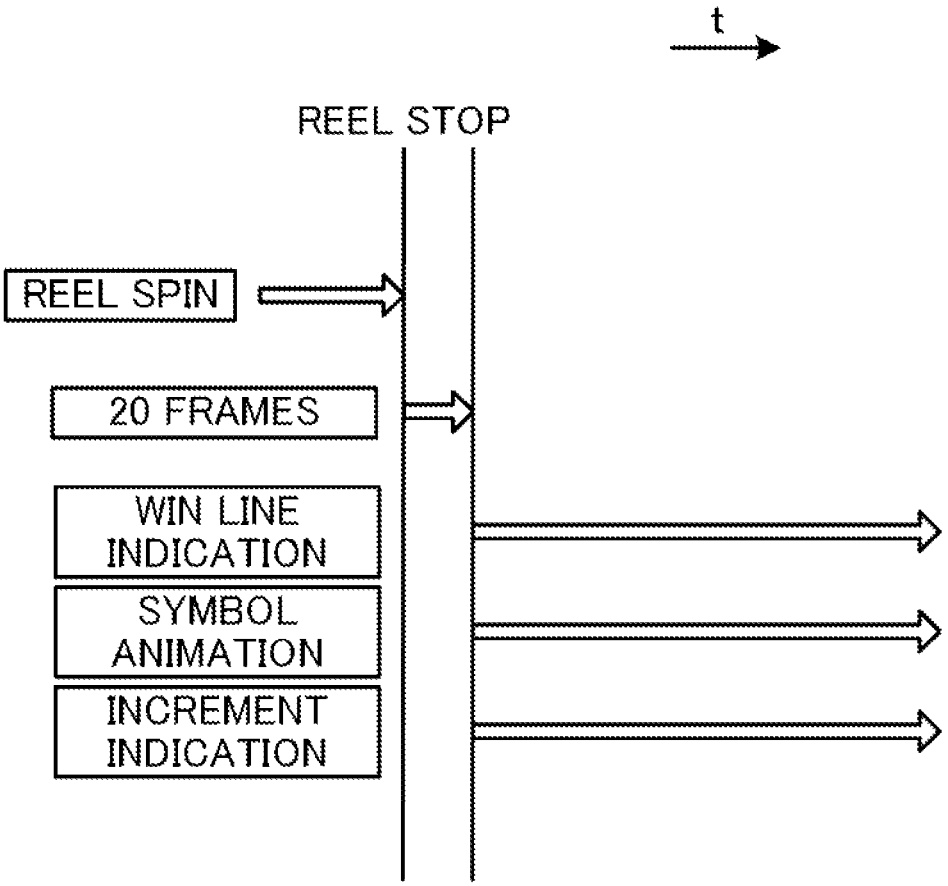
FIG. 62 is a view for illustrating effects at a big WIN.

Next, with reference to FIG. 62, effects at occurrence of a big WIN (gaining a high payout). The big WIN is a state where the total WINs are not less than 20 times of total BETs, for example.

FIG. 62 illustrates timing of performances in the case where a big WIN occurs in a free game. As illustrated in FIG. 62, after 20 frames (which is, a time corresponding to the time in which a symbol array moves by 20 frames) has passed since the spinning of the video reels 3 are stopped in the symbol display region 4, description of the credits (the winning line and the corresponding payout) gained in the spin is indicated on the second row of the WIN meter 717 displayed on the first screen 401, animation of the symbols involving the win is displayed, and increment indication of the credits is displayed in the WIN sign 711 on the second screen 402 and on the first row of the WIN meter 717 on the first screen 401. However, the effects can be controlled to be omitted when a specific number of special symbols appear or when conditions for implementing different effects are satisfied.

<Effects in Displaying Total WIN Sign in Ending Free Games>

Next, with reference to FIGS. 63A to 63D, effects in displaying a free game total WIN sign 718 displayed on the first screen 401. The gaming machine of the present embodiment controls the display of the free game total WIN sign 718 in different ways depending on the total credits (total gained credits) gained in a series of free games.

For example, the way (effects) of displaying the free game total WIN sign 718 varies depending on the number of total gained credits as illustrated in FIG. 63A. Specifically, when the total gained credits are less than 20 times of total BETs, the free game total WIN sign 718 is displayed as a silver sign for 3.6 seconds. When the total gained credits are not less than 20 times and less than 50 times of total BETs, the free game total WIN sign 718 is displayed as a gold sign surrounded by coins (coin-shaped figures) for 6 seconds. When the total gained credits are not less than 50 times of total BETs, the free game total WIN sign 718 is displayed as a gold sign surrounded by coins (coin-shaped figures) and bills (bill-shaped figures) for 10 seconds.

The total BETs are obtained by multiplying the number of BETs specified by the player by the number of winning lines. When the aforementioned indication time has passed, the free game total WIN sign 718 is erased. The display of the free game total WIN sign 718 can be skipped by press of a specific button (for example, the SPIN button) after a predetermined time (for example, 4 seconds) has passed since the free game total WIN sign 718 appears.

FIG. 63B illustrates the free game total WIN sign 718*a* displayed when the total gained credits are less than 20 times of total BETs. The number of total gained credits is 130, which is less than 20 times of the total BETs (in this example, the number of BETs (1)×the number of winning lines (50)×20=1000), so that the free game total WIN sign 718 is displayed as a silver sign.

FIG. 63C illustrates the free game total WIN sign 718*b* displayed when the total gained credits are not less than 20 times and less than 50 times of total BETs. The number of total gained credits is 1450, which is not less than 20 times of the total BETs (in this example, the number of BETs (1)×the number of winning lines (50)×20=1000) and less than 50 times of the total BETs (in this example, the number of BETs (1)×the number of winning lines (50)×50=2500), so that the free game total WIN sign 718*b* is displayed as a gold sign surrounded by coins. The free game total WIN sign 718*b* is also provided with a text of "CONGRATULATIONS!"

Figure 63D:
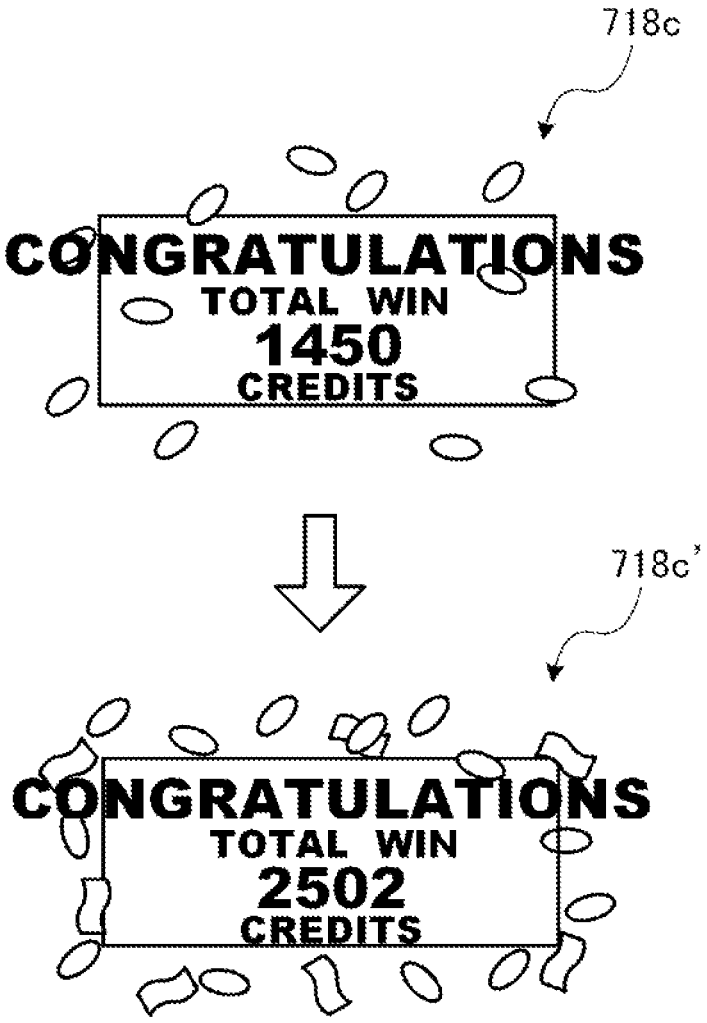

FIG. 63D illustrates the free game total WIN sign 718*c* displayed when the total gained credits are not less than 50 times of total BETs. In this case, indication of the total gained credits is incremented and when it exceeds 2500, a gold free game total WIN sign 718*c* surrounded by coins is changed to a gold free game total WIN sign 718*c*' surrounded by coins and bills. The final number of total gained credits is 2502, which is not less than 50 times of the total BETs (in this example, the number of BETs (1)×the number of winning lines (50)×50=2500). The free game total WIN signs 718*c* and 718*c*' are also provided with a text of "CONGRATULATIONS!"

Although this example controls the display of the total WIN sign differently depending on the relation between the total gained credits and the total BETs, the display of the total WIN sign may be controlled differently depending on the relation between the number of credits gained in the game, spin, or other cycle and the number of BETs specified by the player.

What is claimed is:

1. A gaming machine for determining a payout based on rearranged symbols, the gaming machine comprising:

a plurality of reels on outer surfaces of which a plurality of symbols are attached;

a bill validator;

a display device; and a controller, which controls first games, each of the first games rearranging a part of the plurality of symbols in a display region of the display device by spinning and stopping the plurality of reels, and which performs the following processing of (0-1) to (0-3) and (1-1) to (1-5):

(0-1) accepting, via a game medium acceptor, a physical game medium with a monetary value which establishes a credit balance stored in a memory;

(0-2) receiving, via a bet input device, a bet whose amount is designated by the player based on the credit balance stored in the memory;

(0-3) executing a first game as a result of the player's bet;

(1-1) determining, by a first lottery, symbols to be rearranged in the first game;

(1-2) randomly determining, by a second lottery, a symbol rearrangement for a predictive effect of start of a second game from among a plurality of predictive effects before performing a rearrangement of symbols, in a winning pattern, including a specific type of symbols, which indicates the start of the second game, if the processing of (1-1) determines, by the first lottery, that the second game starts as a win; and (1-3) performing, on the display device by using the reels, the rearrangement of symbols, in the winning pattern, including the specific type of symbols after performing the symbol rearrangement for the predictive effect determined by the second lottery;

(1-4) displaying on the display device a game result of the second game; and (1-5) paying out, via a cash-out, to the player or establishes the credit balance stored in the memory, according to a winning outcome of the game result, wherein, while the rearrangement of symbols in the winning pattern is performed from the predictive effect, the controller controls the specific type of two or more same symbols which are consecutively arranged on a reel to be scrolled upward or downward from outside of the display region to the display region so that all symbols displayed on a region corresponding to the reel in the display region becomes the specific type of same symbols, after a display phase of the predictive effect in which a part of the specific type of symbols on at least a part of the plurality of reels are temporarily stopped at pseudo stop positions in the display region.

2. The gaming machine according to claim 1, wherein the pseudo stop positions in the predictive effects are determined by a third lottery based on positions of the symbols to be rearranged determined by the first lottery.

3. The gaming machine according to claim 2, wherein the specific type of symbols are consecutively attached on each of the reels, and wherein the controller is programmed to perform the following processing of:

determining, by the first lottery, the symbols to be rearranged in an arrangement satisfying a condition that the specific type of symbols consecutively appear in the display region;

switching the first games to the second games under a condition where the first conditions are satisfied; and determining a number of second games by conducting fifth lotteries for the specific number of times in the switching to the second games.

4. The gaming machine according to claim 3, wherein the display region shows a predetermined number of symbols on each of the plurality of reels along a direction of the scrolling, wherein numbers of the specific type of symbols attached on the plurality of reels are larger than the predetermined number, and wherein the processing of determining by the first lottery determines the symbols to be rearranged in an arrangement satisfying a condition that the predetermined number of the specific type of symbols consecutively appear in the display region.

5. The gaming machine according to claim 4, wherein the symbols attached on each of the plurality of reels include an uppermost symbol located uppermost among the specific type of symbols consecutively attached on the reel and a lowermost symbol located lowermost among the specific type of symbols consecutively attached on the reel, wherein the controller is programmed to perform the processing of:

determining, by the third lottery, the pseudo stop position satisfying a condition that the uppermost symbol appears in the display region, if the symbols to be rearranged includes the uppermost symbol; and determining, by the third lottery, the pseudo stop position satisfying a condition that the lowermost symbol appears in the display region, if the symbols to be rearranged includes the lowermost symbol.

6. The gaming machine according to claim 5, wherein the controller is programmed to perform the processing of:

implementing the nudge phase by moving the symbols in a forward direction to show the symbols to be rearranged including the specific type of symbols in the display region, if the uppermost symbol stops at the pseudo stop position; and implementing the nudge phase by moving the symbols in a direction opposite to the forward direction to show the symbols to be rearranged including the specific type of symbols in the display region, if the lowermost symbol stops at the pseudo stop position.

7. The gaming machine according to claim 1, wherein the predictive effects further include:

a phase in which a first image is displayed in the display region before the spinning of the plurality of reels is started; and a phase in which a second image is displayed in the display region after the part of the specific number of the specific type of symbols are temporarily stopped at the pseudo stop positions in the display region and before the nudge phase is started.

8. The gaming machine according to claim 1, wherein the processing of (1-2) includes the following processing of (1-2-1):

(1-2-1) determining, by a fourth lottery, whether to implement predictive effects for informing a player in advance of start of second games, if the processing of (1-1) determines, by the first lottery, that symbols are to be rearranged in the display region in an arrangement satisfying second conditions including appearance of a specific number or more of the specific type of symbols, the predictive effects including a phase in which a first image is displayed in the display region before the spinning of the plurality of reels is started.

* * * * *